US011873714B2

(12) United States Patent
Clausen et al.

(10) Patent No.: US 11,873,714 B2
(45) Date of Patent: Jan. 16, 2024

(54) UNDERGROUND DRILL RIG AND SYSTEMS AND METHODS OF USING SAME

(71) Applicant: LONGYEAR TM, INC., Salt Lake City, UT (US)

(72) Inventors: Paul Clausen, Marden (AU); Shane Fox, Morphett Vale (AU); Lee Gagne, Cobalt (CA); Steve Corboy, Morphettville (AU); Geoff Moroney, Ellenbrook (AU); David Barrett, Albany (AU)

(73) Assignee: Longyear TM, Inc., Salt Lake City, UT (US)

( * ) Notice: Subject to any disclaimer, the term of this patent is extended or adjusted under 35 U.S.C. 154(b) by 74 days.

(21) Appl. No.: 17/599,265

(22) PCT Filed: Mar. 27, 2020

(86) PCT No.: PCT/US2020/025108

§ 371 (c)(1),
(2) Date: Sep. 28, 2021

(87) PCT Pub. No.: WO2020/205461

PCT Pub. Date: Oct. 8, 2020

(65) Prior Publication Data

US 2022/0186561 A1 Jun. 16, 2022

Related U.S. Application Data

(60) Provisional application No. 62/826,377, filed on Mar. 29, 2019.

(51) Int. Cl.
*E21B 7/02* (2006.01)
*E21B 3/02* (2006.01)
(Continued)

(52) U.S. Cl.
CPC ..... *E21B 7/022* (2013.01); *E21B 3/02* (2013.01); *E21B 7/024* (2013.01); *E21B 7/20* (2013.01);
(Continued)

(58) Field of Classification Search
CPC . E21B 7/022; E21B 7/024; E21B 7/20; E21B 3/02; E21B 10/26; E21B 17/042;
(Continued)

(56) References Cited

U.S. PATENT DOCUMENTS 2,855,181 A 10/1958 Olsen
3,120,282 A * 2/1964 Pickard ..... E21B 25/02 175/247
(Continued)

FOREIGN PATENT DOCUMENTS

WO WO0065193 A1 11/2000
WO WO 2019010572 1/2019

OTHER PUBLICATIONS

International Search Report and Written Opinion for PCT/US2020/025108 dated Oct. 29, 2020.

*Primary Examiner* — D. Andrews
(74) *Attorney, Agent, or Firm* — Ballard Spahr LLP

(57) ABSTRACT

A drill rig having a longitudinal drilling axis, a front portion, and a rear portion can comprise a feedframe aligned with the longitudinal drilling axis, a first head assembly coupled to the feedframe and configured to rotate a drill string, and a rod holder proximate the front portion of the drill rig. A second head assembly can be movable on the feedframe along the longitudinal axis and can include a powered water swivel assembly comprising a spindle having an interior bore a drill rod connector at a first end of the spindle, a motor that is configured to rotate the spindle, a clutch configured to disengage the motor from the spindle, a gearbox that
(Continued)

couples the motor to the spindle, and a water swivel that is configured to provide drilling fluid to the interior bore of the spindle.

16 Claims, 70 Drawing Sheets

(51) Int. Cl.

| | |
|---|---|
| ***E21B 7/20*** | (2006.01) |
| ***E21B 10/26*** | (2006.01) |
| ***E21B 17/042*** | (2006.01) |
| ***E21B 19/14*** | (2006.01) |
| ***E21B 19/16*** | (2006.01) |
| ***E21B 21/01*** | (2006.01) |
| ***E21B 31/18*** | (2006.01) |
| ***E21B 33/14*** | (2006.01) |
| ***E21B 44/00*** | (2006.01) |
| ***E21B 19/20*** | (2006.01) |
| *E21B 19/084* | (2006.01) |

(52) U.S. Cl.
CPC ..... *E21B 10/26* (2013.01); *E21B 17/042* (2013.01); *E21B 19/14* (2013.01); *E21B 19/164* (2013.01); *E21B 19/165* (2013.01); *E21B 19/20* (2013.01); *E21B 21/01* (2013.01); *E21B 31/18* (2013.01); *E21B 33/14* (2013.01); *E21B 44/00* (2013.01); *E21B 19/084* (2013.01)

(58) Field of Classification Search
CPC ..... E21B 19/14; E21B 19/164; E21B 19/165; E21B 19/084; E21B 21/01; E21B 31/18; E21B 33/14; E21B 44/00
See application file for complete search history.

(56) References Cited

U.S. PATENT DOCUMENTS

| | | | | |
|---|---|---|---|---|
| 3,994,350 | A | 11/1976 | Smith et al. | |
| 5,044,388 | A | 9/1991 | Barton et al. | |
| 5,174,389 | A | 12/1992 | Hansen | |
| 6,634,443 | B1 * | 10/2003 | Paech ..... | E21B 15/04 175/85 |
| 2012/0205159 | A1 | 8/2012 | Borges et al. | |
| 2013/0118752 | A1 | 5/2013 | Hannegan et al. | |
| 2014/0076583 | A1 | 3/2014 | Robichaux et al. | |
| 2014/0209382 | A1 | 7/2014 | Smith et al. | |
| 2017/0204666 | A1 | 7/2017 | Galler et al. | |
| 2017/0328147 | A1 | 11/2017 | Roy | |

* cited by examiner

UNDERGROUND DRILL RIG AND SYSTEMS AND METHODS OF USING SAME

CROSS-REFERENCE TO RELATED APPLICATION

This is a U.S. National Phase Application of International Application No. PCT/US2020/025108, filed Mar. 27, 2020, which claims priority to and the benefit of the filing date of U.S. Provisional Patent Application No. 62/826,377, filed Mar. 29, 2019. The entirety of each of these applications is hereby incorporated by reference herein.

FIELD

This application relates to underground drill rigs, and, in particular, to systems for reducing a need for an operator to physically interact with drill rig components during use.

BACKGROUND

Drill rigs, particularly for underground mining, typically require an operator to physically interact with a drill rig to anchor the drill rig in place, to add drill rods to a drill string, and to operate equipment, such as a wireline overshot. Operation of such drill rigs can be costly and require further expensive ventilation equipment for the operator. Accordingly, drill rigs comprising systems for minimizing or eliminating physical operator interaction with the drill rigs can be desirable.

SUMMARY

Described herein, in various aspects, is a drill rig having a longitudinal drilling axis, a front portion, and a rear portion. The drill rig can comprise a feedframe aligned with the longitudinal drilling axis. A first head assembly can be coupled to the feedframe and configured to rotate a drill string. A rod holder can be proximate the front portion of the drill rig and configured to grip an outer surface of a first drill string component of the drill string. A second head assembly can be movable on the feedframe along the longitudinal axis. The second head assembly can comprise a powered water swivel assembly comprising a spindle having an interior bore, a drill rod connector at a first end of the spindle, a motor that is configured to rotate the spindle, a clutch configured to disengage the motor from the spindle, a gearbox that couples the motor to the spindle, and a water swivel that is configured to provide drilling fluid to the interior bore of the spindle.

The second head assembly can further comprise an overshot loading assembly comprising an overshot loading chamber configured to receive an overshot tool and an overshot releaser.

An actuator can be configured to move at least a portion of the second head assembly between a first position in which the powered water swivel assembly is aligned with the longitudinal drilling axis and a second position in which the overshot loading assembly is aligned with the longitudinal drilling axis.

The overshot tool can be a pump-in wireline overshot or a catcher insert as disclosed herein.

The spindle can be a floating spindle that is configured to move along the longitudinal drilling axis.

The spindle can be spring-biased toward the front portion of the drill rig.

The drill rod connector can comprise at least one male thread.

The drill string component can comprise a drill rod.

A method of using a drill rig as disclosed herein in conjunction with a rod handler can comprise retracting the second head assembly toward the rear portion of the drill rig and away from a drill string to permit receipt of the first drill string component between the second head assembly and the drill string. A first drill string component can be received from the rod handler so that the first drill string component is coaxial with the longitudinal drilling axis. The second head assembly can be moved until the at least one male thread of the spindle engages at least one female thread of the first drill string component. The motor can be used to rotate the spindle to thereby threadedly couple the spindle to the first drill string component. The second head assembly can be moved forward via the feed frame until the first drill string component engages the drill string. The motor can be used to rotate the spindle to thereby threadedly couple the first drill string component to the drill string, thereby creating an extended drill string.

The method can further comprise using the clutch to decouple the motor from the spindle and using the first head assembly to rotate the extended drill string at a drilling speed.

The method can further comprise using the second head assembly to push the drill string into a bore.

A method of using a drill rig as disclosed herein in conjunction with a rod handler can comprise moving, via the feed frame, the second head assembly toward the front portion of the drill rig until the at least one male thread of the spindle engages at least one female thread of the drill string, using the motor to rotate the spindle to thereby threadedly couple the spindle to the first drill string component of the drill string that is at a proximal end of the drill string, and moving, via the feed frame, the second head assembly toward the rear portion of the drill rig to thereby draw the drill string rearward until a second drill string component that is distal of the first drill string component is received within the rod holder.

The method can further comprise gripping the second drill rod of the drill string with the rod holder to prevent rotation of the second drill rod and using the first head assembly, rotating the first drill string component with respect to the second drill string component to decouple the first drill string component from the second drill string component.

The method can further comprise gripping the first drill string component with the rod handler; using the motor to rotate the spindle to decouple the spindle from the first drill string component; and using the rod handler to remove the first drill string component from the drill rig.

A method of using a drill rig as disclosed herein in conjunction with a rod handler can comprise gripping a drill string with the rod holder, using the motor to rotate the spindle to decouple the spindle from the drill string, moving, via the feed frame, the second head assembly toward the rear portion of the drill rig, using the actuator to align the overshot loading assembly with the longitudinal drilling axis of the drill rig, using a water pump, pumping from the overshot loading chamber, an overshot until it engages a core tube assembly, using a wireline winch, retracting the core tube assembly until the overshot is received in the overshot loading assembly, moving, via the feed frame, the second head assembly toward the rear of the drill rig until the core tube assembly is removed entirely from the drill string, and gripping the core tube assembly with the rod handler.

The method can further comprise using the overshot releaser to decouple the core tube assembly from the overshot; and moving, via the rod handler, the core tube assembly from the drill rig.

A method of using a drill rig as disclosed herein in conjunction with a rod handler, wherein the rod connector comprises at least one male thread, can comprise using the rod handler to insert an empty core tube assembly into the drill string. The second head assembly can be moved, via the feedframe, toward the front portion of the drill rig until the overshot engages the empty core tube assembly. The rod handler can be disengaged from the empty core tube assembly. The second head assembly can be moved, via the feedframe, toward the front of the drill rig to further insert the empty core head assembly into the drill string. The overshot releaser can be used to release the overshot from the empty core tube assembly. The second head assembly can be moved, via the feedframe, toward the rear of the drill rig. The actuator can be used to align the spindle with the longitudinal drilling axis of the drill rig. The second head assembly can be moved, via the feedframe, toward the front portion of the drill rig until the spindle engages the drill string. The motor can rotate the spindle to thereby threadedly couple the spindle to the drill string.

The drill rig can be used in a method to dislodge a stuck drill string, the method comprising with the first head assembly engaged with the drill string and the spindle engaged with the drill string, simultaneously driving the first head assembly toward the rear of the drill rig and driving the second drill head toward the rear of the drill rig.

The second head assembly can be moved relative to the first head assembly.

The method can be performed with no physical contact between the drill rig and an operator.

A controller can be in communication with the first head assembly, the second head assembly, and the feedframe.

A controller can be in communication with the first head assembly, the second head assembly, the feedframe, the release latch, and the actuator.

Using the motor to rotate the spindle to thereby threadedly couple the spindle to the first drill string component can comprise rotating the spindle in a decoupling direction until the spindle moves forward, and rotating the spindle in a coupling direction.

A method can comprise drilling a first bore into a formation to a first depth, the bore having a bore wall and a first diameter that is sufficient to receive a casing pipe, driving a casing pipe into the drill bore, the casing pipe having a binder on an exterior surface of the casing pipe that is configured to secure the casing pipe to the bore wall, the casing pipe being secured to an anchoring nut at a proximal end and wherein the anchoring nut comprises a gripping feature, and engaging an anchoring clamp of a drill rig with the gripping feature of the anchoring nut to thereby anchor the drill rig to the formation.

The method can be performed without physical contact between the drill rig and a human operator.

The casing pipe can be welded to the anchoring nut.

The casing pipe and anchoring nut can be monolithically formed.

A casing gland can be fitted to the anchoring nut at a proximal end of the nut portion opposite the formation.

Drilling the bore can comprise using the drill rig to drill the bore.

According to some methods herein, a step of waiting for the binder to cure can be implemented.

The binder can be a resin.

Drilling the bore can comprise drilling the bore with a stepped drill bit.

The stepped drill bit can comprise a first cutting face between a rotational axis of the drill bit and a first radius and a second cutting face outside of the first radius, wherein the first cutting face is spaced from the second cutting face in a distal direction.

At least one method herein can further comprise drilling a second bore into the formation through the casing pipe, wherein the second bore has a second diameter that is smaller than an inner diameter of the casing pipe, wherein the second bore has an axis that is aligned with the axis of the first bore.

The anchoring clamp can be attached to a feed frame of the drill rig.

The gripping feature of the nut portion of the casing pipe can comprise a first radially extending rib and a second radially extending rib spaced axially from the first radially extending rib, thereby defining a recessed groove between the first radially extending rib and the second radially extending rib.

The anchoring clamp can comprise a plurality of jaws that have, in cross section in a plane including a central axis of the anchoring clamp, a complementary shape to the recessed groove.

The first rib and the second rib can define opposing tapered surfaces so that the groove has a taper toward a central axis of the nut portion of the casing pipe.

The anchoring clamp can be hydraulically actuated.

The drill rig can comprise a rotation head configured to grip both the casing pipe and drill string component, wherein the drill string component has an outer diameter that is less than an inner diameter of the casing pipe.

The binder can comprise resin sticks.

The nut portion of the casing pipe can comprise at least one female thread that is configured to couple to a drive rod of the drill rig.

Drilling the bore, driving the casing pipe into the bore, and engaging the anchoring clamp of the drill rig with the nut portion of the casing pipe can be performed without physical contact between the drill rig and an operator.

A system can comprise a casing pipe having a binder on an exterior surface of the casing pipe that is configured to secure the casing pipe to a bore wall, an anchoring nut secured to a proximal end of the casing pipe, wherein the anchoring nut comprises a gripping feature, and an anchoring clamp configured to engage the gripping feature of the anchoring nut.

The anchoring clamp can be configured to couple to a drill rig.

The anchoring clamp can be a portion of a drill rig.

A drilling system can comprise a casing pipe anchored in a bore in a formation, a drill rig coupled to the casing pipe, and a rod handler configured to provide rods to the drill rig, wherein the drilling system is configured for operation without physical contact between the drill rig and an operator.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
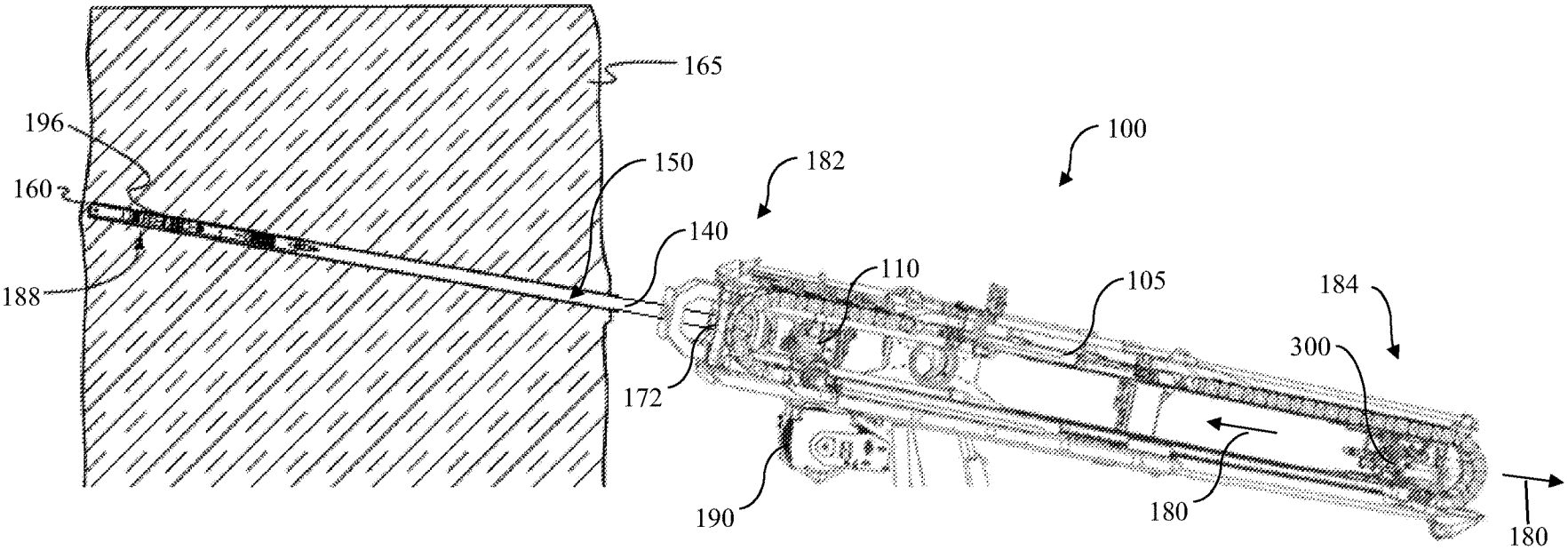
FIG. 1 illustrates an underground drill rig drilling into a formation, in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a drill rod" can refer to one or more of such drill rods, and so forth.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the terms "substantially" or "generally," it is contemplated that values within up to 15%, up to 10%, up to 5%, or up to 1% (above or below) of the particular value can be included within the scope of those aspects. When used with respect to an identified property or circumstance, "substantially" or "generally" can refer to a degree of deviation that is sufficiently small so as to not measurably detract from the identified property or circumstance, and the exact degree of deviation allowable may in some cases depend on the specific context.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of" For example, "at least one of A, B and C" explicitly includes only A, only B, only C, and combinations of each.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Disclosed below are underground drill rigs and drill rig components that provide the mechanical functions required for completely autonomous drilling, in conjunction with a robotic rod handler as is known in the art. In use, it is contemplated that the disclosed drill rig components can allow for completion of a drilling process without the need for physical intervention by a person (drill operator). As further disclosed herein, it is contemplated that the drill rig components can include a second head assembly that operates separately from a first head assembly. It is further contemplated that the disclosed second head assembly can perform the following functions in a hands-free and automated manner (in contrast to conventional systems that require manual labor for completion of these tasks): (a) connecting a water supply rotary union (water swivel) to the end of the last drill rod in a drill string for the purpose of supplying water to the drill string while drilling; connecting a hauling device to the drill string for the purpose of very quickly adding or removing rods from the drill string; and connecting a loading chamber to the drill string for the purpose of putting an overshot into the drill string for retrieving the core sample.

Further disclosed are systems and methods for fully automated/mechanized anchoring (without physical, manual intervention by a drill operator) of an underground drill rig. Optionally, such anchoring systems and methods can be used with the drill rigs disclosed herein. However, it is contemplated that such anchoring systems and methods can be used with any conventional drill rig.

Drill Rigs Having First and Second Head Assemblies

Disclosed herein, in various aspects and with reference to FIGS. 1-7 and 11-12, is a drill rig 100. In exemplary applications, the drill rig 100 can be used in underground drilling operations. The drill rig 100 can comprise a feedframe 105 and a first head assembly 110 that is movable on the feedframe 105. The first head assembly 110 can be configured to grip drill rods 140 and casings. The first head assembly 110 can comprise a conventional chuck drive rotation unit as is known in the art. One drill rod 140 can be threadedly coupled to additional drill rods 140 to create a drill string 150. In turn, the drill string 150 can be coupled to a drill bit 160 or other in-hole tool configured to interface with the material to be drilled, such as a formation 165 (e.g., an underground formation, such as a rock formation). A core tube assembly 188 (i.e., a core barrel assembly) can be disposed at a distal end of the drill string 150 to receive the material to be drilled (e.g., a core sample).

Figure 3:
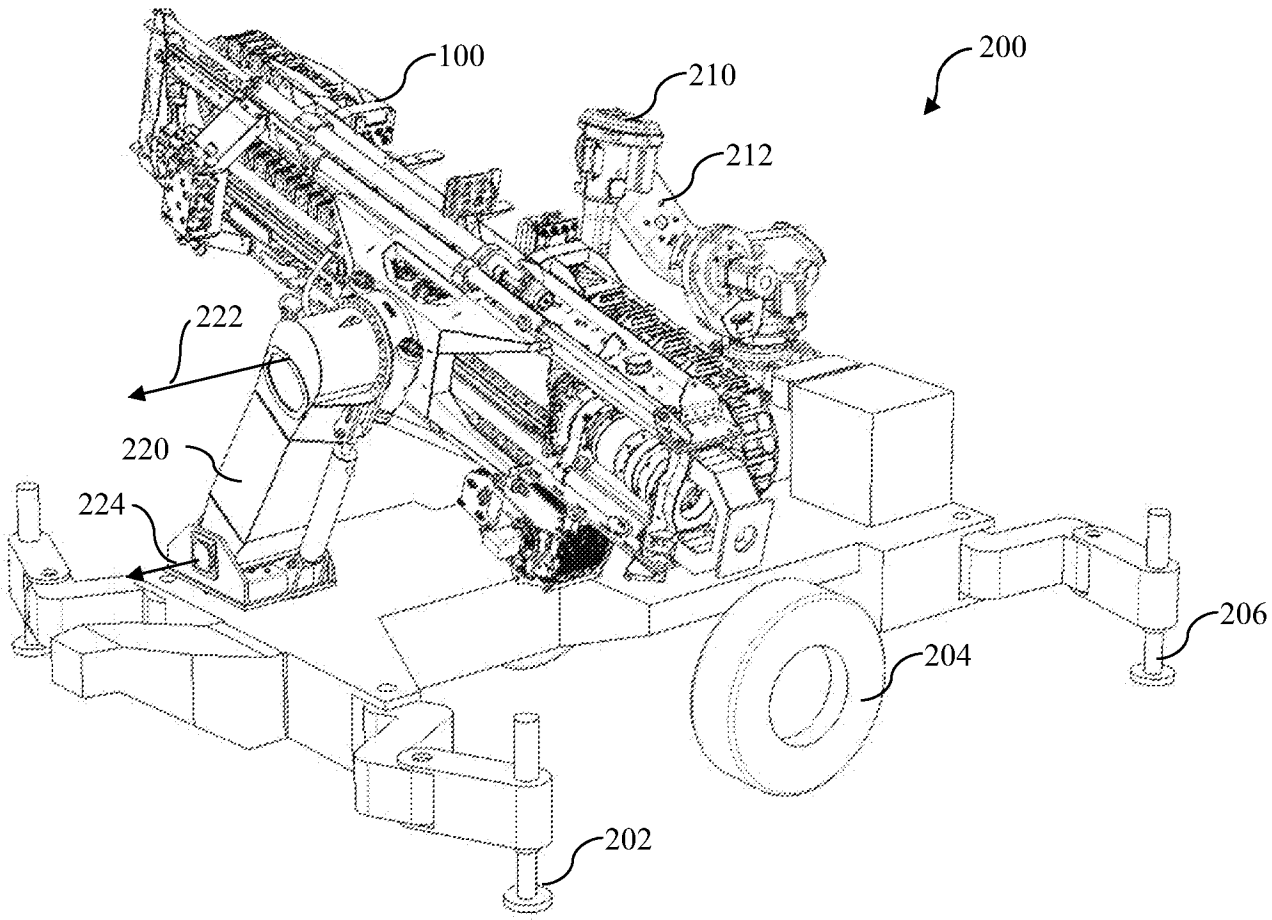
FIG. 3 illustrates a front, left perspective view of the drilling system of FIG. 2.

The feedframe 105 can be oriented such that the drill string 150 is generally horizontal or oriented upwardly relative to the horizontal, as shown in FIG. 1, or, as illustrated in FIG. 3, oriented downwardly relative to the horizontal. The drill rig 100 can thus have a longitudinal drilling axis 180 extending between a front portion 182 and a rear portion 184 of the drill rig 100. Further, the first head assembly 110 is configured to rotate the drill string 150 during a drilling process. In particular, the first head assembly 110 may vary the speed at which the drill string 150 rotates as well as the direction of rotation. The rotational rate of the drill head and/or the torque the first head assembly 110 transmits to the drill string 150 may be selected as desired according to the drilling process. At the front portion 182, the drill rig can comprise a rod holder 172, or foot clamp, that is configured to grip the drill string 150. The drill rig 100 can further comprise a wireline winch 190 that can be used to retract a wireline cable in a conventional manner. Optionally, in use, the wireline cable can be coupled to an overshot to permit retrieval of the overshot. According to at least one aspect, the overshot can be pumped down to engage the core tube assembly 188, and the wireline winch 190 can retract the overshot with the core tube assembly 188 attached thereto. In this way, the drilling system can be used to retrieve core samples.

Figure 2:
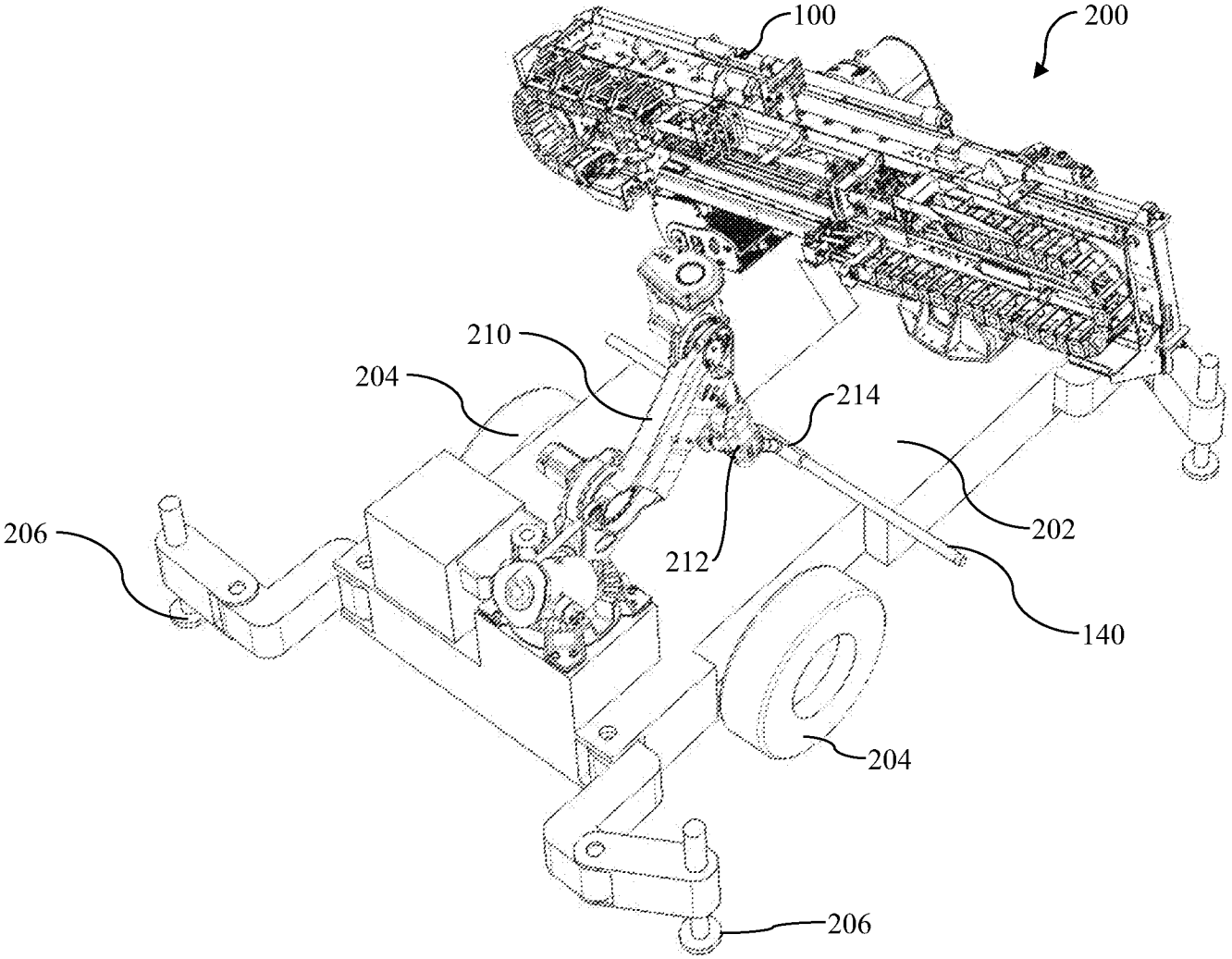
FIG. 2 illustrates a rear perspective view of an exemplary underground drilling system comprising a drilling rig of FIG. 1.
Figure 4:
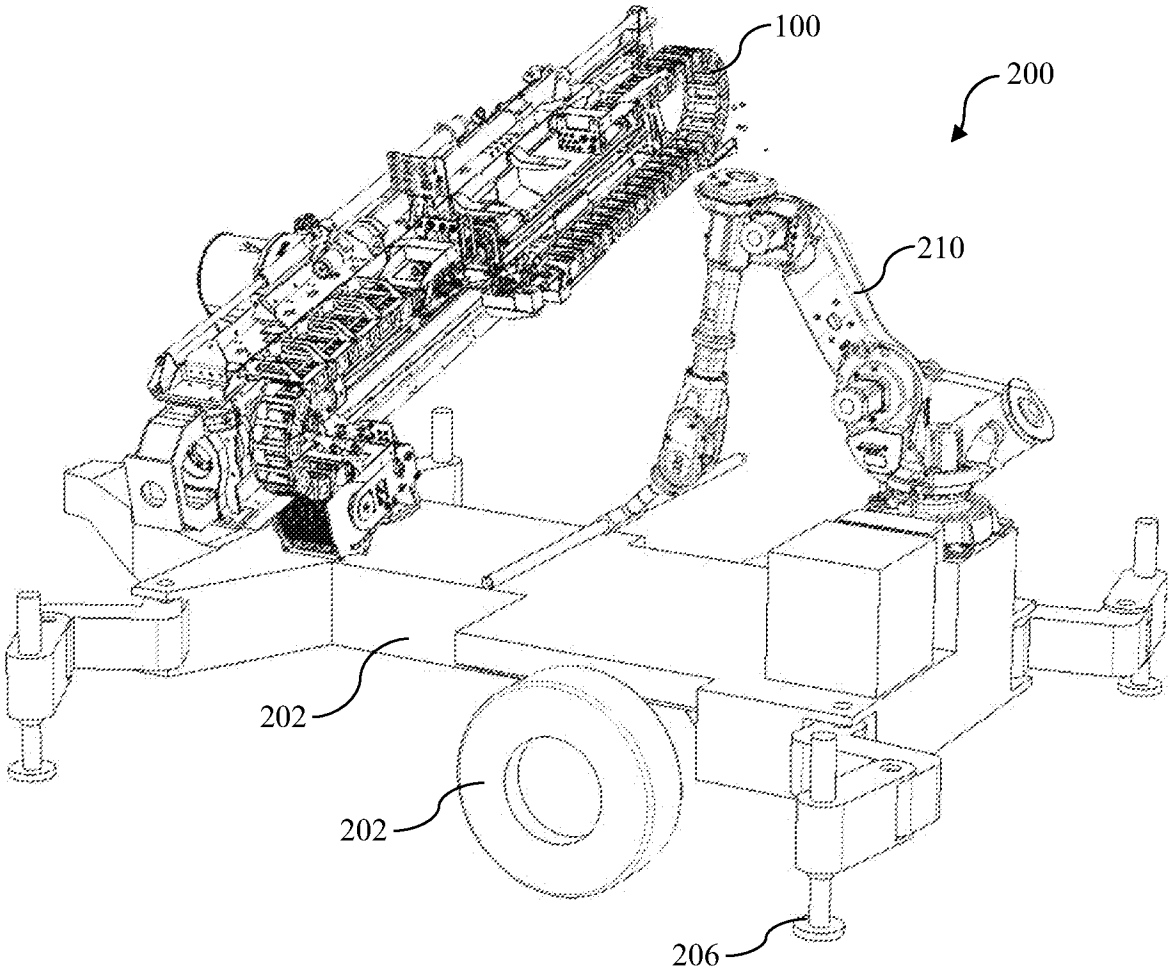
FIG. 4 illustrates a front, right perspective view of the drilling system of FIG. 2.
Figure 5:
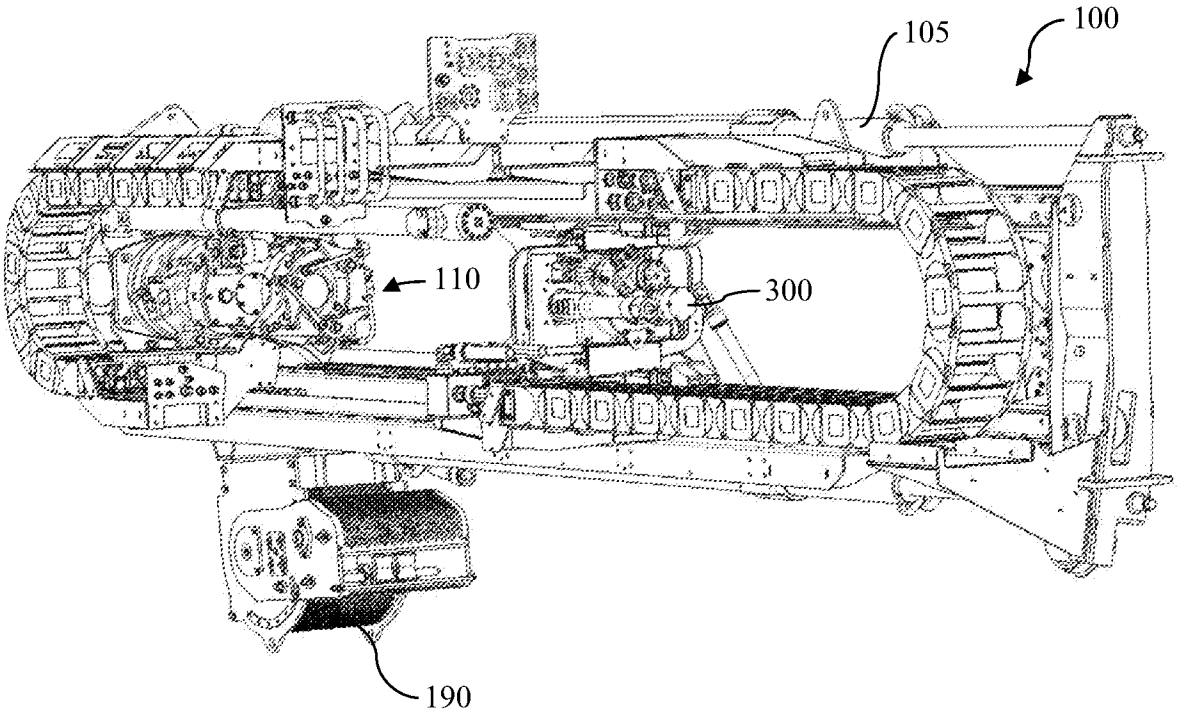
FIG. 5 illustrates an isolated rear, right perspective view of the drill rig of FIG. 1.
Figure 6:
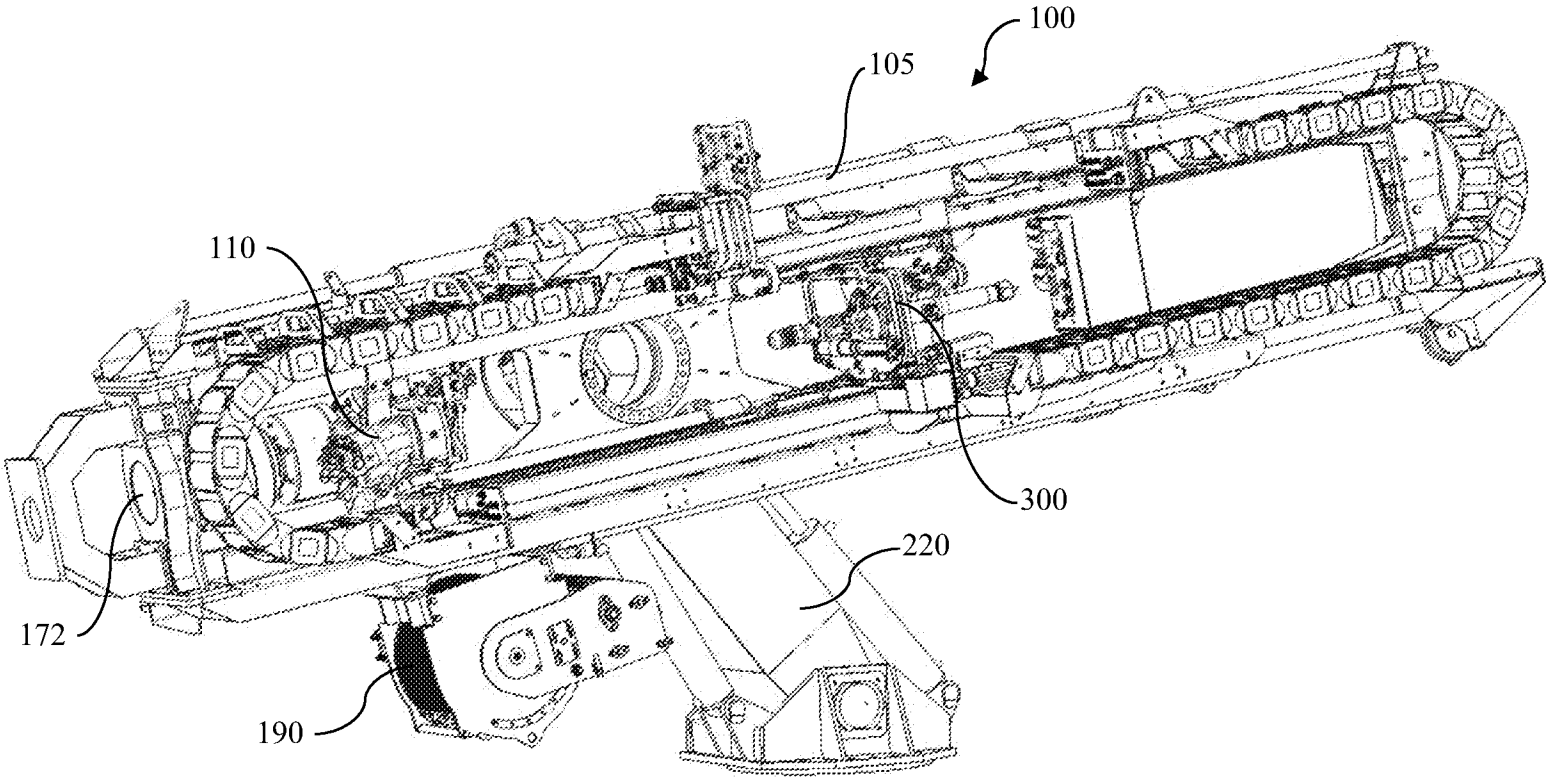
FIG. 6 illustrates an isolated right side perspective view of the drill rig of FIG. 1.
Figure 7:
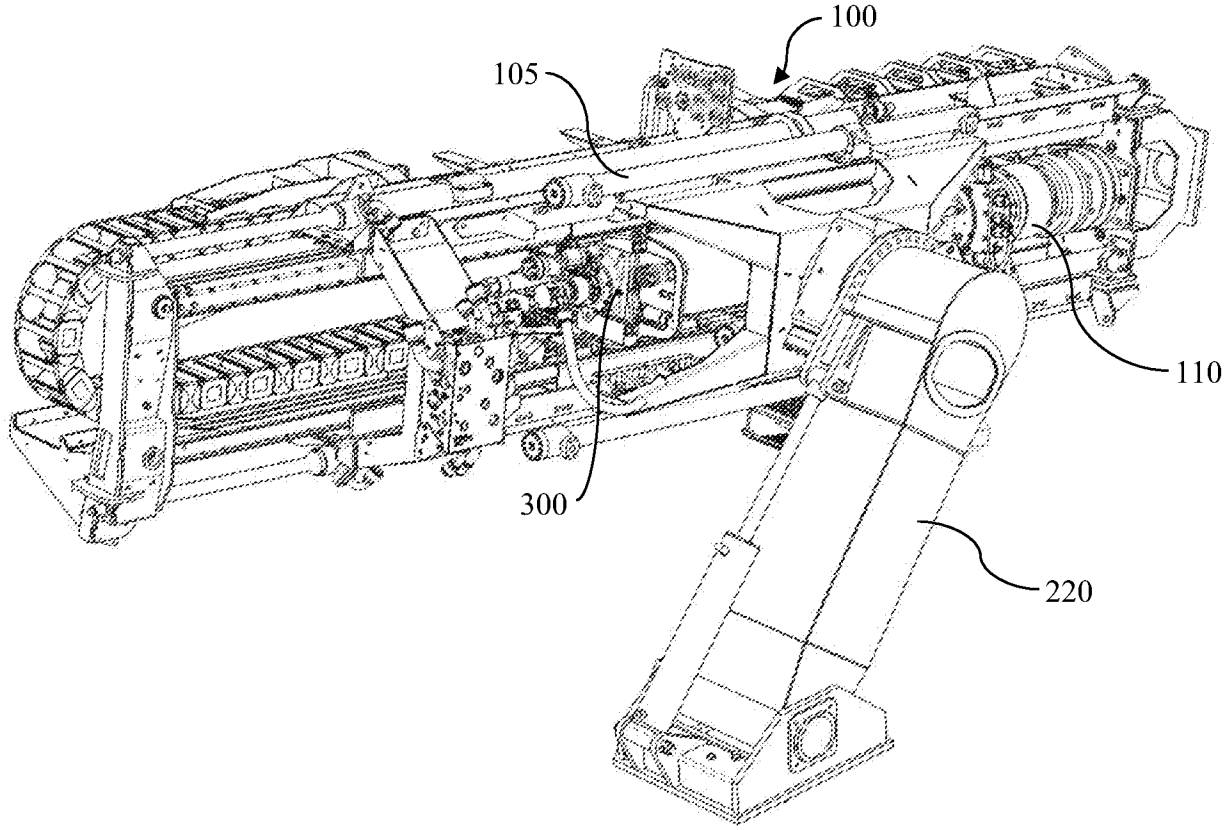
FIG. 7 illustrates an isolated rear, left perspective view of the drill rig of FIG. 1.

Referring also to FIGS. 2-4, a drilling system 200 can include the drill rig 100 and a support platform 202, which can optionally be movable about wheels 204 and supported by at least one jack 206 (optionally, a plurality of jacks). Optionally, a rod handler 210 can couple to the platform 202.

Figure 53:
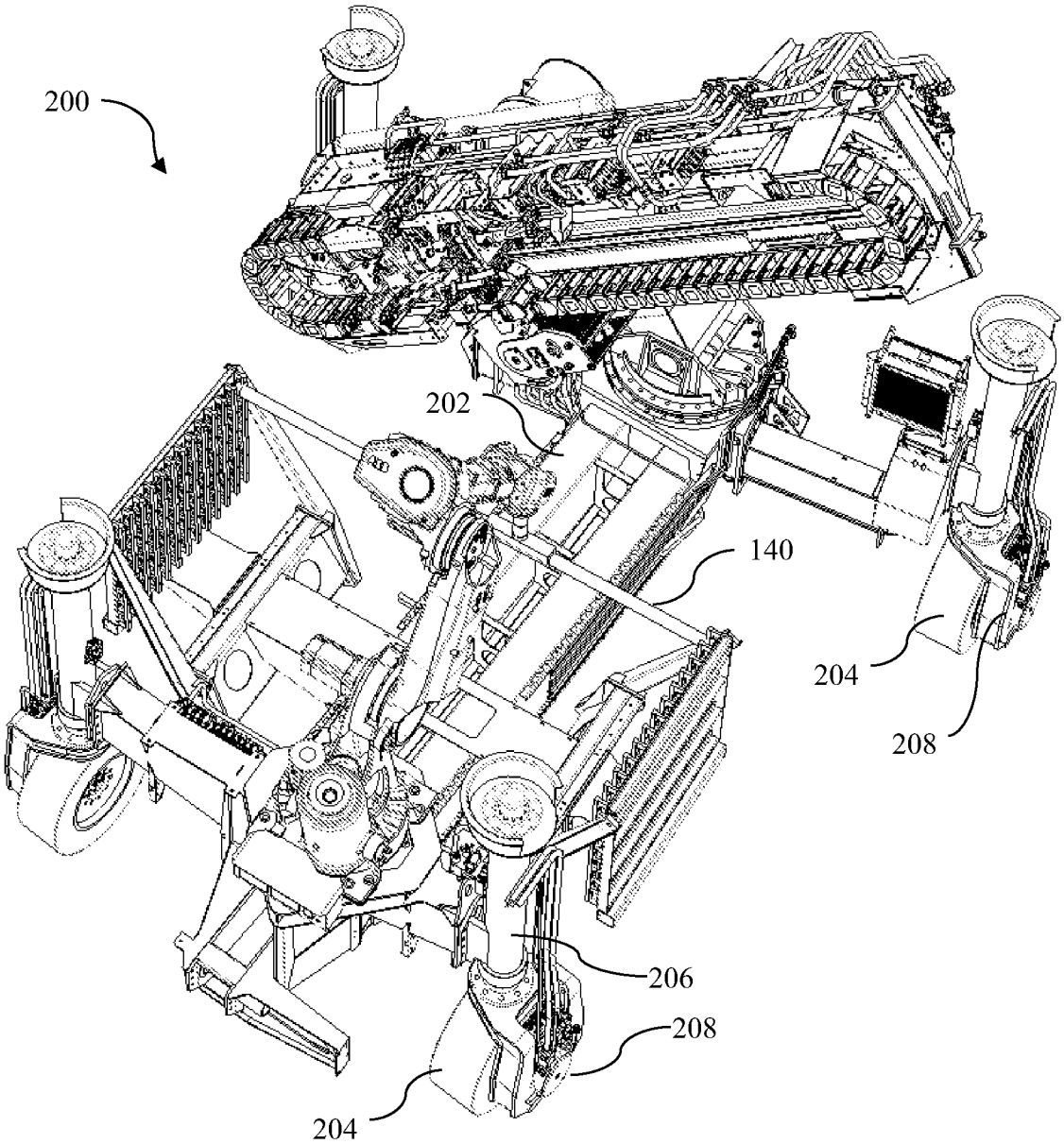
FIG. 53 is rear perspective view of a drilling system with driven wheels on jacks in accordance with embodiments disclosed herein.
Figure 54:
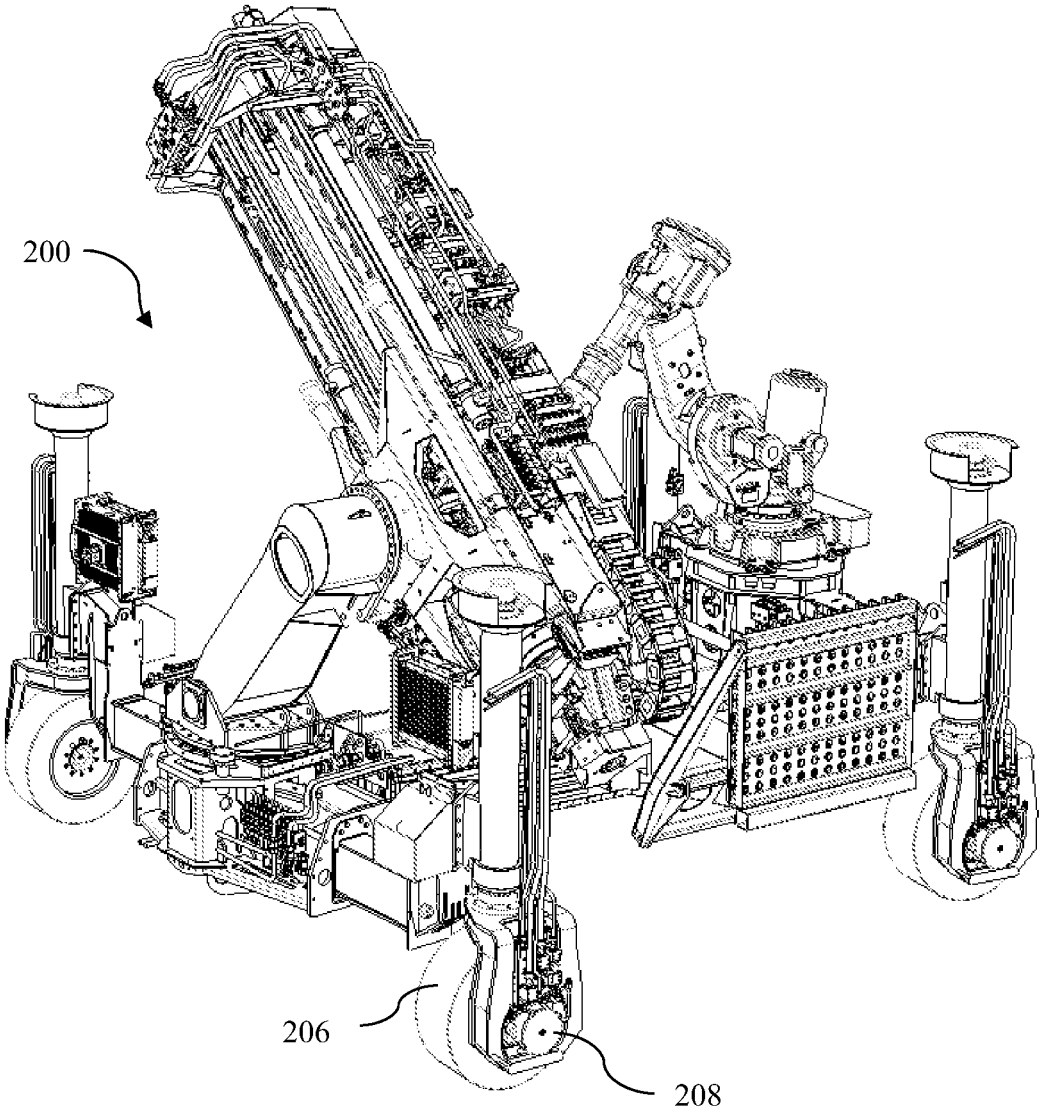
FIG. 54 is a rear perspective view of the drilling system of FIG. 53 in a second orientation.
Figure 55:
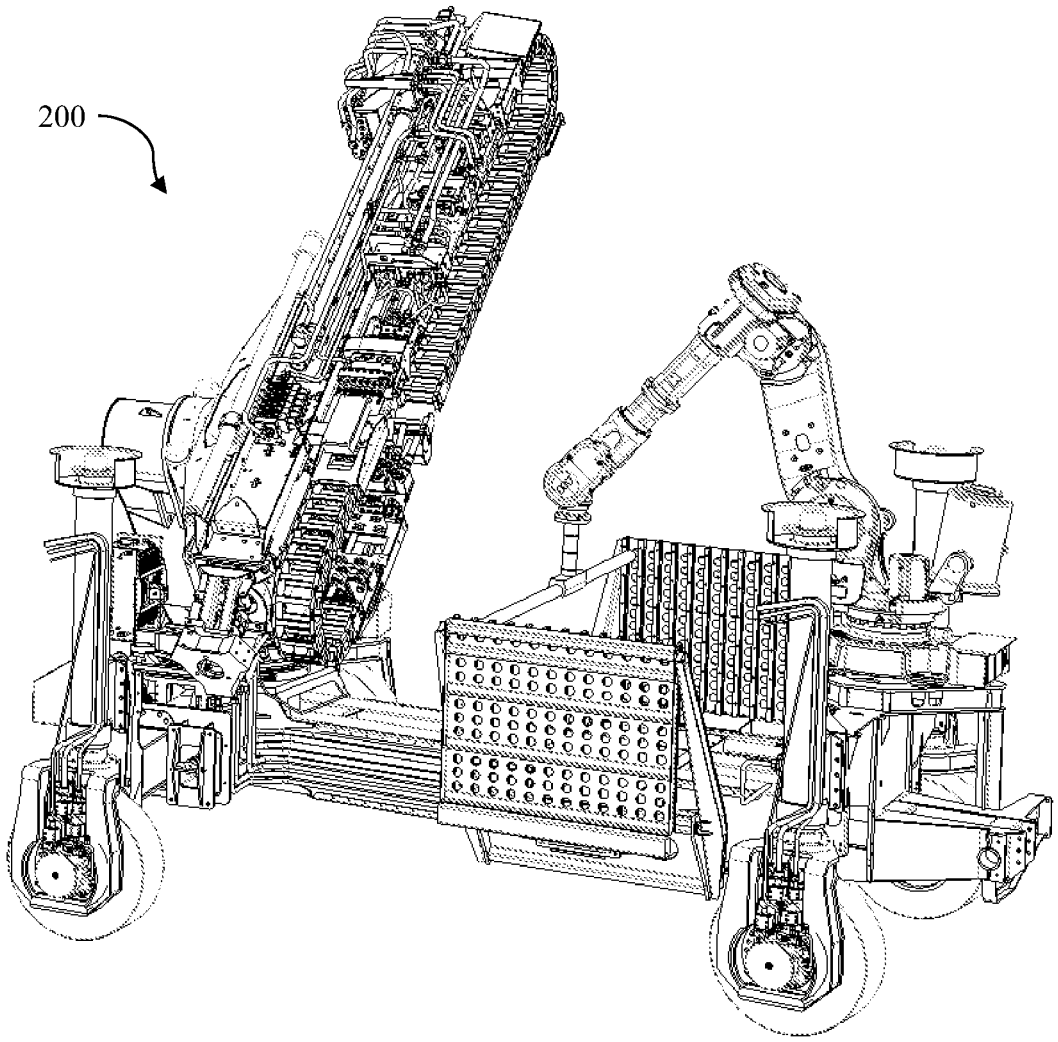
FIG. 55 is a rear perspective view of the drilling system of FIG. 53 in a third orientation.
Figure 56:
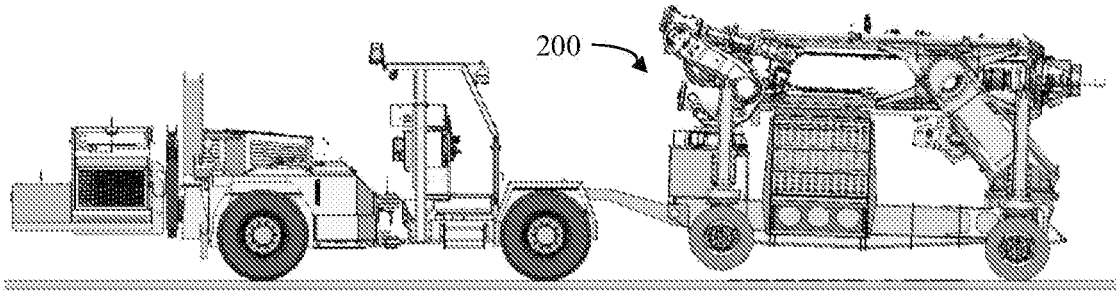
FIG. 56 is a side view of the drilling system of FIG. 53 being towed into position.

In further aspects, with reference to FIGS. 53-55, the support platform can be movable about a plurality wheels 202 that can be hydraulically or electrically driven. For example, hydraulic motors 208 can rotatably drive the wheels 204. Some or all of the wheels 204 can couple to the support platform 202 via jacks 206 so that the wheels 204 are independently vertically movable with respect to the support platform 202 in order to orient the platform 202 (e.g., so that the platform is level). In further aspects, some or all of the wheels 204 can be pivotable about respective vertical axes so that the platform can be steered in order to position the platform. The movement of the wheels 204 can be controlled remotely (e.g., via a wireless connection with a tablet, smartphone, or other remote computing device). In further aspects, the drilling system 200 can have a rack for holding drill rods 140 and other equipment (e.g., the casing pipe, one or more overshot assemblies, the extension rod, etc.). The drilling system of FIG. 53 can optionally have the some or all of the features of the drill rig 100 as described with reference to FIG. 2.

Figure 51:
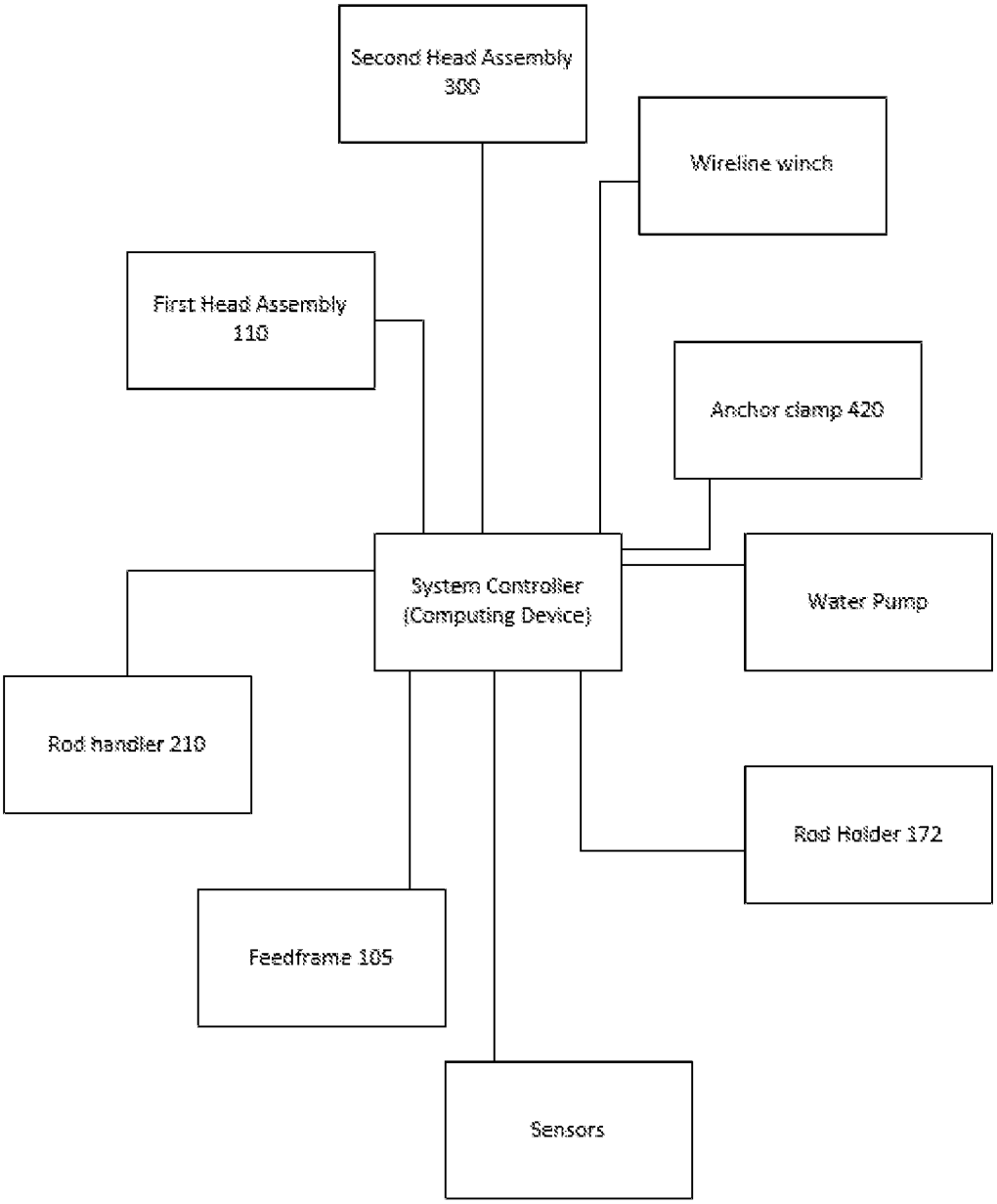
FIG. 51 is a block diagram of an exemplary control system for the drilling system of FIG. 2.

Referring also to FIGS. 2-4, the rod handler 210 can comprise a robotic arm 212 and a pair of jaws 214 that are configured to selectively grab the drill rods 140 to feed to, and remove from, the drill rig 100. In further embodiments, the rod handler 210 can employ switchable magnets (e.g., electromagnets) to selectively grip and release the drill rods 140. In exemplary aspects, the rod handler can have a controller that is operatively coupled to the robotic arm and the pair of jaws. In these aspects, the controller of the rod handler can be communicatively coupled (e.g., via wireless communication) with a computing device, such as a tablet, smartphone, or computer, which can provide control instructions to the controller of the rod handler. Optionally, the computing device that controls the rod handler can be the same computing device that controls operation of one or more of the other drill rig components disclosed herein. FIG. 51 illustrates a control system for controlling various aspects of drilling system 200.

It should be understood that although reference is made to the drill string 150 comprising drill rods 140 throughout this disclosure, various other drill string components (e.g., slip subs) could be included as portions of the drill string 150. Moreover, the drilling system 200 can handle such other drill string components in a similar manner (e.g., gripping, threading onto the drill string 150, and removing from the drill string 150). The drill rig 100 can couple to the platform 202 via an arm 220 (optionally, a plurality of arms) so that the drill rig 100 can be pivotable about a first axis 222 (at the connection between the arm and the platform) and a second axis 224 (at the connection between the arm and the drill rig). In some embodiments, the drill rig 100 can pivot about axis 222 (e.g., +/−45 degrees) and pivot about axis 224 (e.g., +/−45 degrees from vertical or where the arm 220 is perpendicular to an upper surface of the platform from which the arm extends). In this way, the drill rig 100 can pivot from pointing vertically upward to vertically downward. The arm 220 can further be pivoted or rotated about a vertical axis so that the longitudinal drilling axis of the drill rig 100 can be aligned with the direction of transportation (i.e. a horizontal axis that is perpendicular to the tires' rotational axes or that is parallel to a longitudinal axis of the platform). Optionally, such rotation of the arm 220 about the vertical axis can be up to 360 degrees.

Figure 8:
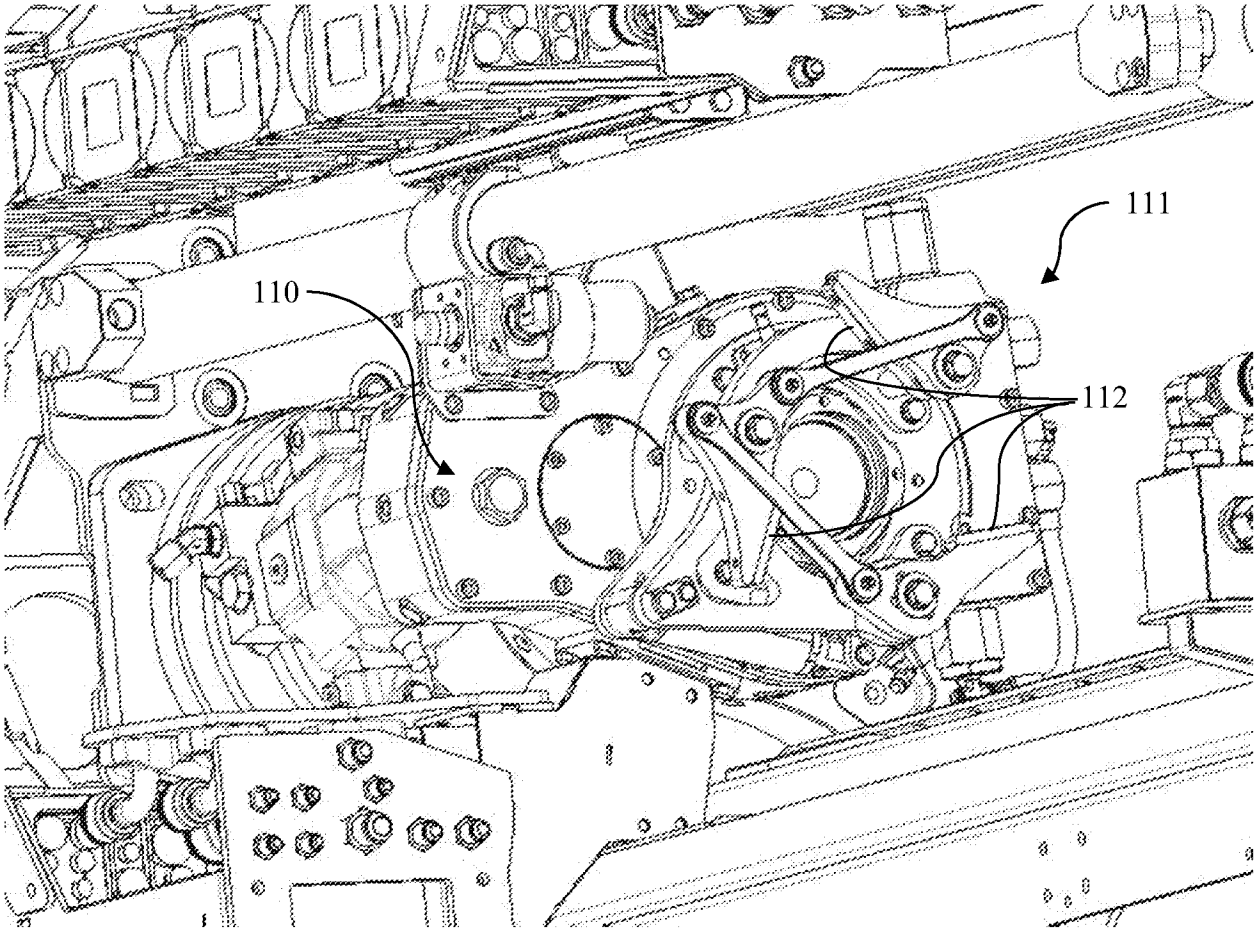
FIG. 8 illustrates a partial perspective view of a first head assembly of the drill rig of FIG. 1.
Figure 9:
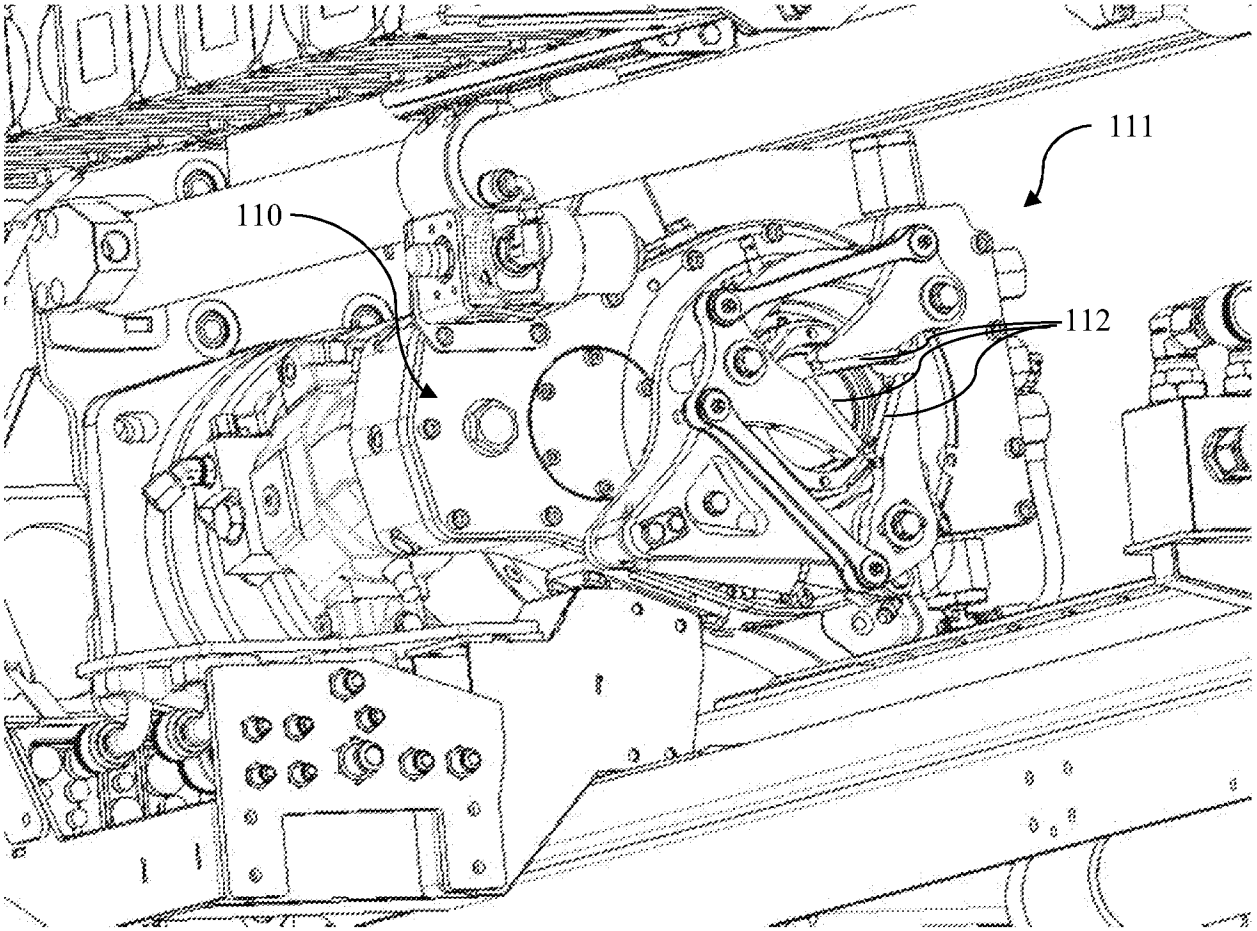
FIG. 9 illustrates another partial perspective view of the first head assembly of FIG. 8, following inward radial movement of the jaws of a centralizer as disclosed herein.

Referring to FIGS. 1, 8, and 9, the first head assembly 110 is configured to grip an exterior surface of the drill rods in order to provide both rotational force to rotate the drill bit 160 and an axial force to press the drill bit 160 against the formation 165. In addition to a rotation unit, the first head assembly 110 can further comprise a centralizer 111 comprising jaws 112. The jaws 112 can be mechanically linked together to move with equal spacing from longitudinal drilling axis 180. The jaws 112 of the centralizer 111 can radially locate new rods to align them with the drill string. The jaws 112 can comprise plastic or brass pads that engage the rods. The jaws 112 of the centralizer 111 can be configured to gently grip the drill rods 140 so that the rod can slide through them. The jaws 112 of the centralizer 111 can be further configured to grip the drill rods 140 with sufficient force to prevent the rods from sliding therein.

Figure 12:
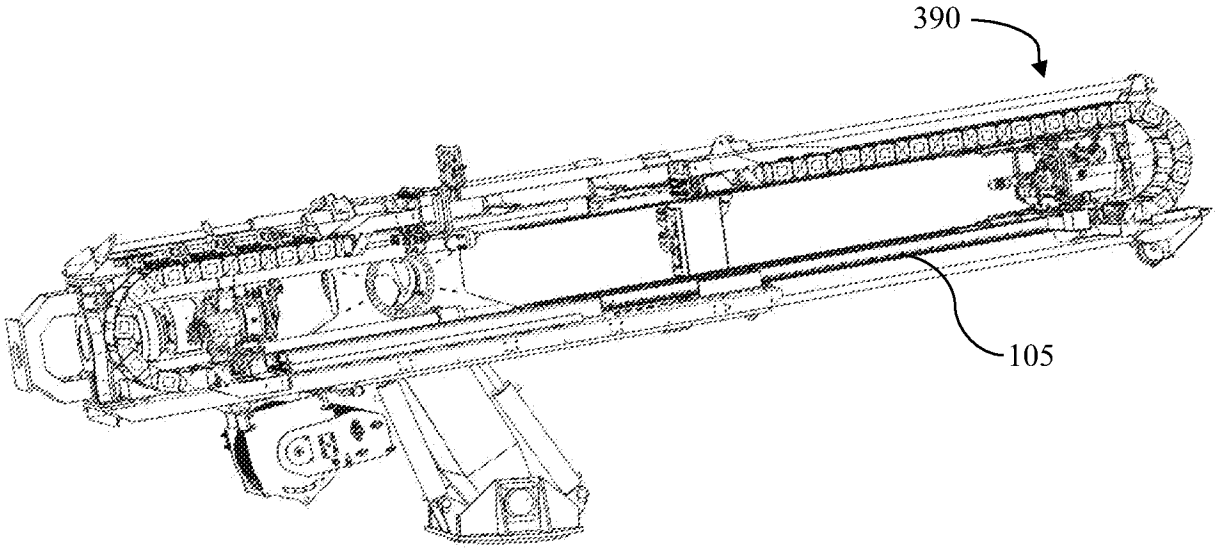
FIG. 12 illustrates a right side perspective view of the drill rig of FIG. 1 with the second head assembly in a rearward-most position.
Figure 48:
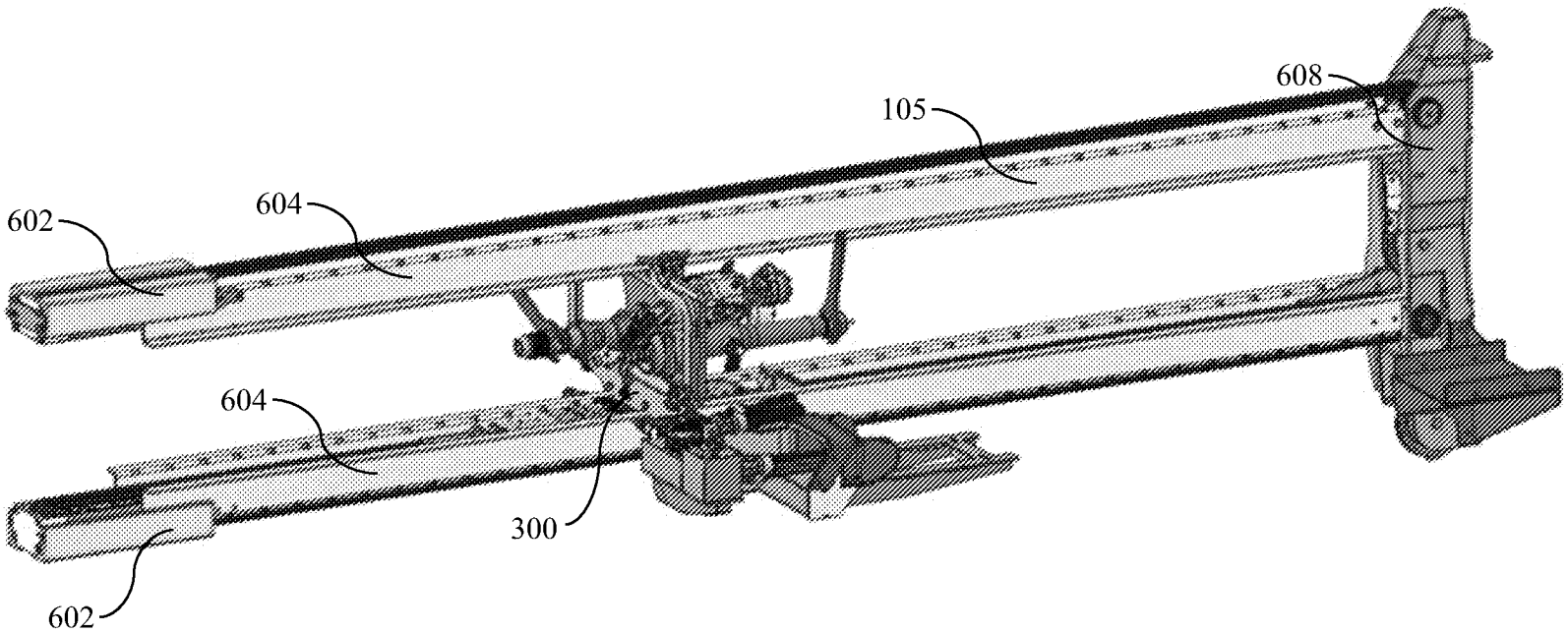
FIG. 48 is a side perspective view of the feedframe with several elements hidden to show detail of certain movable components.
Figure 49:
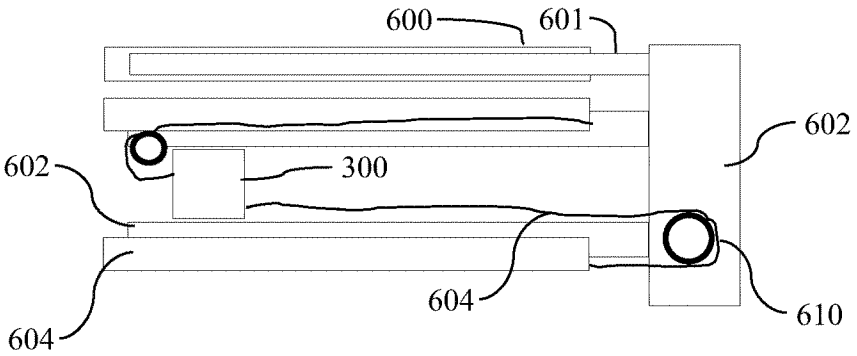
FIG. 49 is a schematic view of the mechanism for moving the second head on the feedframe, wherein the second head is in a first, forward position.
Figure 50:
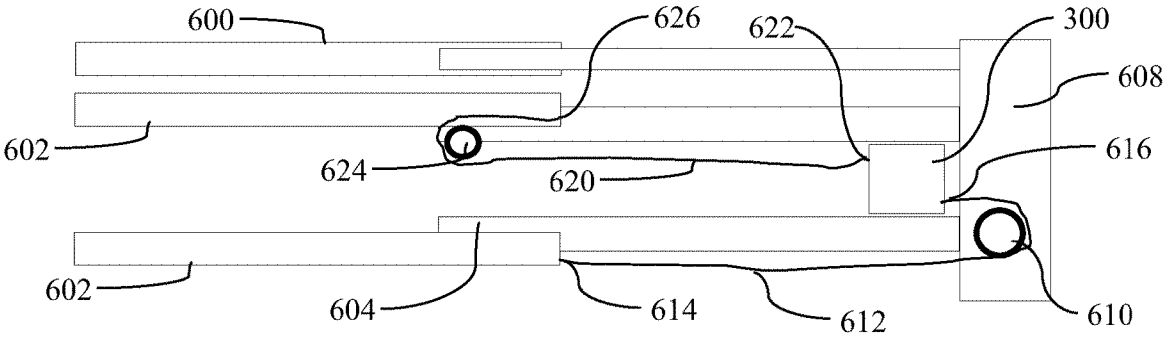
FIG. 50 is a schematic view of the mechanism for moving the second head on the feedframe, wherein the second head is in a second, rearward position.

Referring to FIGS. 1, 10, and 13-17, the drill rig 100 can further comprise a second head assembly 300. The second head assembly 300 can be movable along the feedframe 105 from a first, forwardmost position 390 (FIG. 11) to a second, rearmost position 392 (FIG. 12). The feedframe can move the second head assembly in a similar manner to that of how a forklift raises its forks. Referring to FIGS. 48-50, the feedframe 105 can comprise at least one hydraulic cylinder 600, comprising a piston 601, that can be actuated to selectively extend or retract, thereby elongating or contracting the feedframe. As illustrated, the feedframe 105 can comprise outer channel members 602 that can slide within respective inner channel members 604. The cylinder 600 can couple at a first end to at least one outer channel member and at a second end to a movable end portion 608 of the feedframe 105. The inner channel members 604 can attach to the movable end portion 608 of the feedframe 105. Accordingly, as the cylinder 600 extends, cylinder 600 can cause the inner channel members 604 to slide with respect to the outer channel members 602. A first pulley 610 can couple to the movable end portion 608. A first belt 612 can be anchored at a first end to a fixed belt attachment point 614 on one outer channel member 602, extend around the first pulley 610, and attach at a second end 616 to the second head assembly 300. Accordingly, as the feedframe elongates, the feedframe moves the first pulley 610 longitudinally from the first belt attachment point 614, thereby drawing the second head assembly rearward at twice the rate at which the cylinder extends. The feedframe can retract to move the second head forward in a similar manner. A second belt 620 can attach at a first end 622 to the second head assembly 300. The second belt 620 can extend from the first end 622 around a second pulley 624 that is pivotably attached to an inner channel member 604, and attach to one outer channel member 602 at a second fixed belt attachment point 626. Accordingly, as the cylinder retracts, the second belt 620 can pull the second head forward at twice the rate at which the cylinder contracts. It should be understood that various other systems can be implemented for moving elements, such as second head assembly 300, along the feedframe 105. As used herein, the portion of the drill rig 100 in front of the second head assembly 300 when the second head assembly is in the forwardmost position 390 can generally be understood to be the front portion 182, and the portion of the drill rig behind the front portion 182 can generally be understood to be the rear portion 184. Optionally, it is contemplated that the ratio between the longitudinal length of the rear portion 184 and the longitudinal length of the front portion 182 can range from 1:1 to 5:1.

The second head assembly 300 can be configured to serve at least two primary functions. The first function is coupling successive drill rods 140 in the drill string 150 while providing a swivel coupling to enable a port for drilling fluid to enter through an interior of the drill string. According to some aspects, the second head assembly 300 can comprise a powered water swivel assembly 302 comprising a spindle 304 that can travel along the longitudinal axis 180 of the drill rig 100 and can be biased toward the drill rig's front portion 182 by a spring 306. That is, the spindle 304 can be a floating spindle that can, in some optional embodiments, travel from about 40 millimeters to about 80 millimeters, or more preferably, about 60 millimeters. This travel can allow for engagement of the spindle and the drill rods without exact axial location precision. A front end of the spindle can comprise at least one male thread 308 that is configured to engage at least one female thread of a drill rod so that the spindle sealingly couples to the drill string. The spindle can couple to a water swivel 310 that is configured to provide drilling fluid to an interior bore 312 of the spindle 304. The water swivel 310 can comprise a joint that enables the spindle 304 to rotate while a rear end of the water swivel 310 stays rotationally stationary. In this way, a hose providing a drilling fluid supply can be connected to the water swivel 310 to deliver the drilling fluid through the spindle 304, through the drill string 150, and to the drill bit 160. The drilling fluid can be, for example, water or drilling mud.

A motor 320 can rotate spindle 304 in order to threadingly couple the spindle 304 to and decouple the spindle from each successive drill rod 140. According to some aspects, the motor 320 can be a hydraulic motor. Optionally, the motor 320 can couple to the spindle 304 through a gearbox 322 via a spline interface. The gearbox 322 can be a spur gearbox. The motor 320 can drive the spindle 304 in a first direction to thread the spindle to the drill rod 140. As the respective threads engage, the spindle 304 can float along the longitudinal drilling axis to accommodate the respective axial movement between the components. Similarly, the spindle 304 can rotate in the opposite direction (i.e., opposite from the first direction) to decouple the spindle 304 from the drill rod 140. A clutch 324 can engage and disengage the motor 320 from the gearbox 322. In this way, the motor 320 can be decoupled from the drill string 150 as the first head assembly 110 drives the drill string 150 (FIG. 1) during drilling. The clutch 324 can be a dog clutch that is actuated by a hydraulic actuator. When the hydraulic actuator is not pressurized, an internal spring can disengage the clutch to disengage its input and output shafts.

Although reference is made to the spindle connecting to the drill string via threaded coupling, it should be understood that various other couplings are contemplated. For example, in further embodiments, the front end of the spindle may comprise a chuck that is configured to grip a drill rod.

Figure 10:
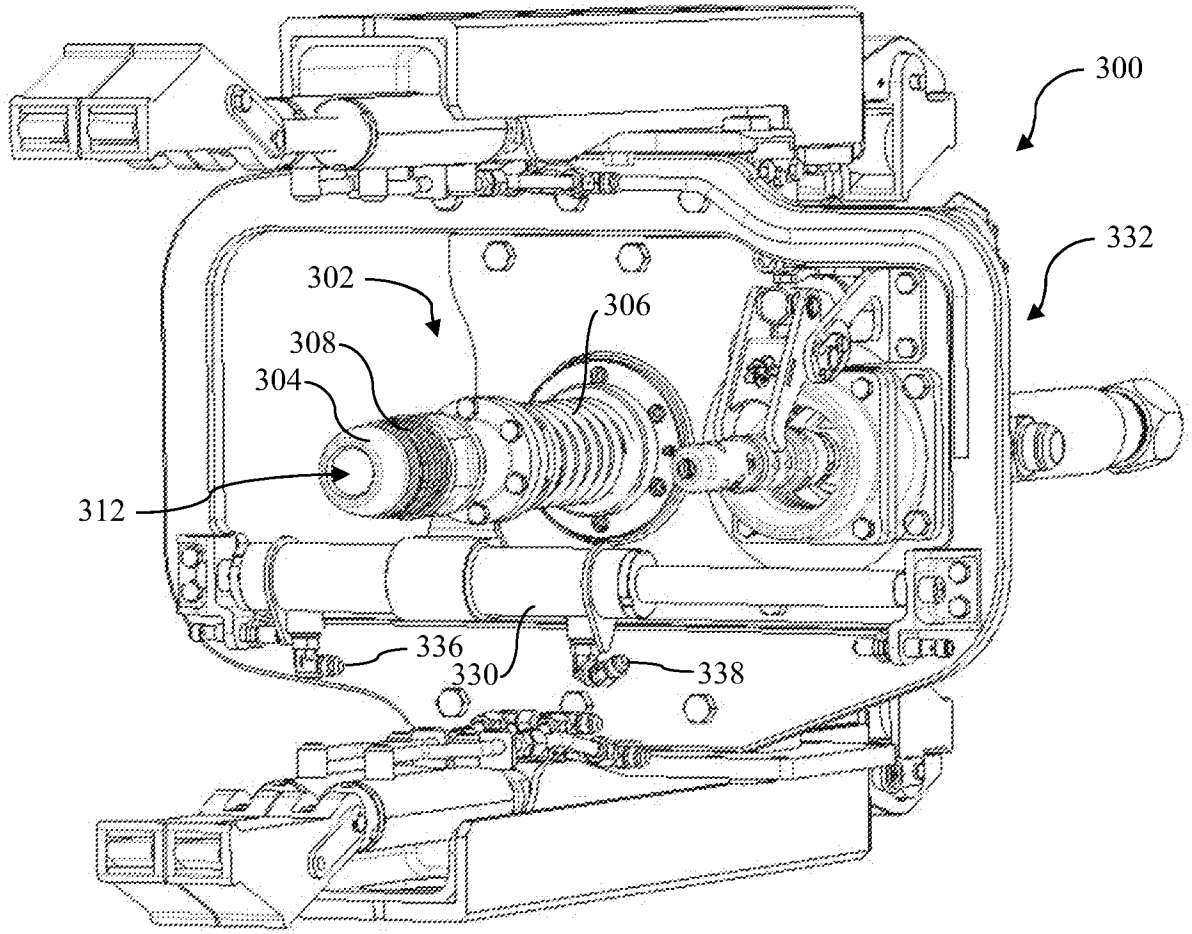
FIG. 10 illustrates an isolated front perspective view of a second head assembly of the drill rig of FIG. 1.
Figure 11:
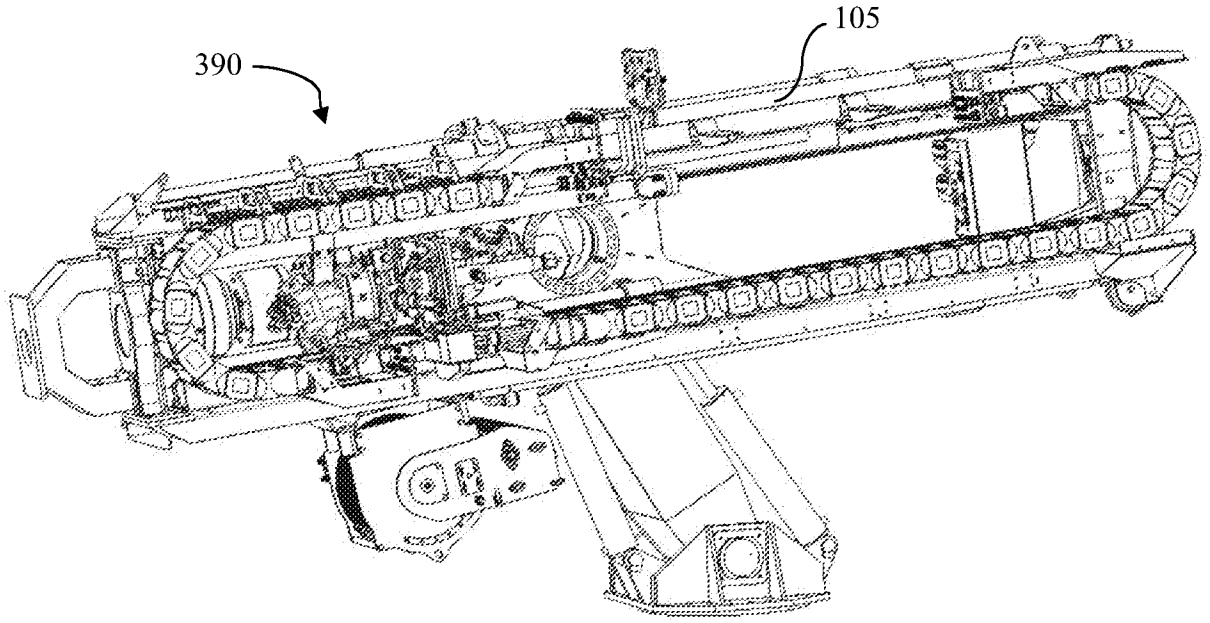
FIG. 11 illustrates a right side perspective view of the drill rig of FIG. 1 with the second head assembly in a forward-most position.
Figure 13:
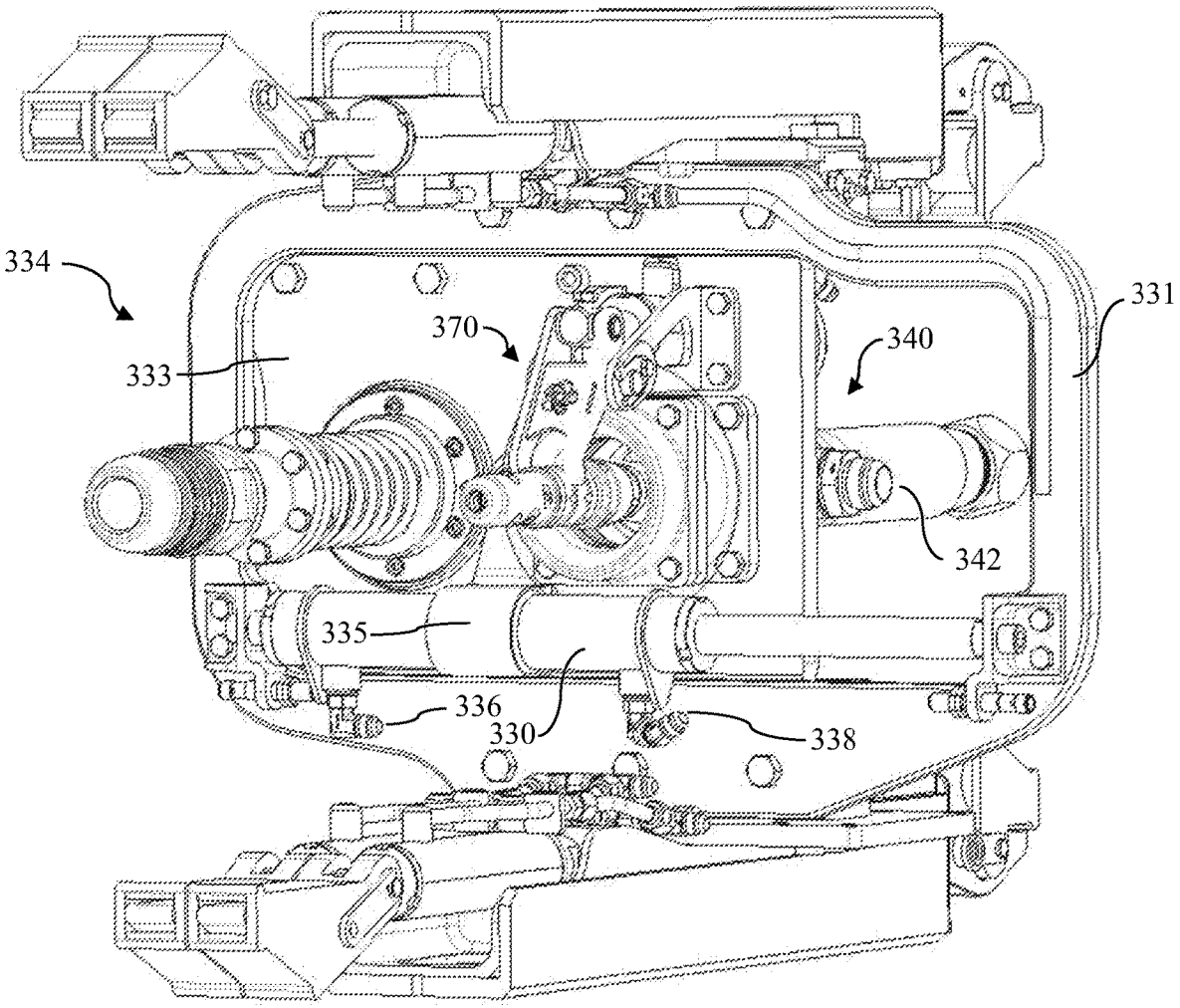
FIG. 13 illustrates a front perspective view of a second head assembly of the drill rig of FIG. 1.
Figure 14:
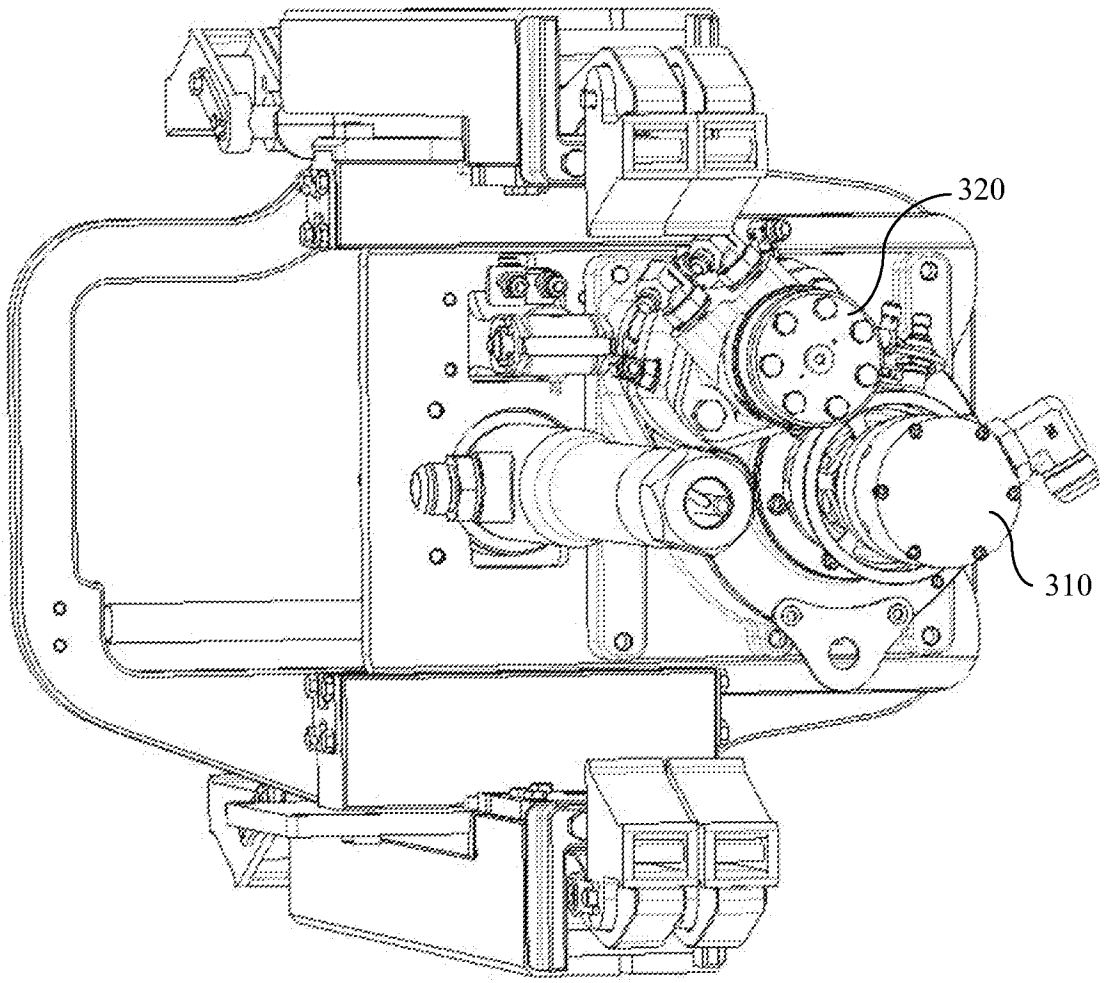
FIG. 14 illustrates a rear perspective view of a second head assembly of the drill rig of FIG. 1.
Figure 15:
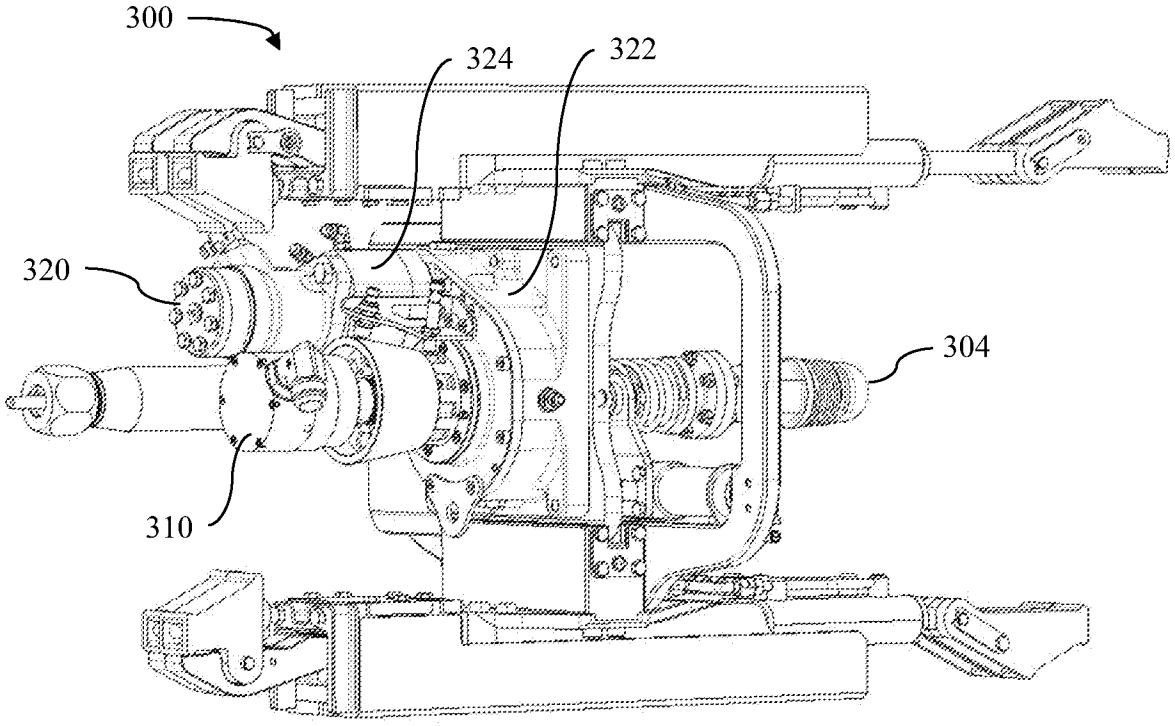
FIG. 15 illustrates a left side perspective view of a second head assembly of the drill rig of FIG. 1.
Figure 16:
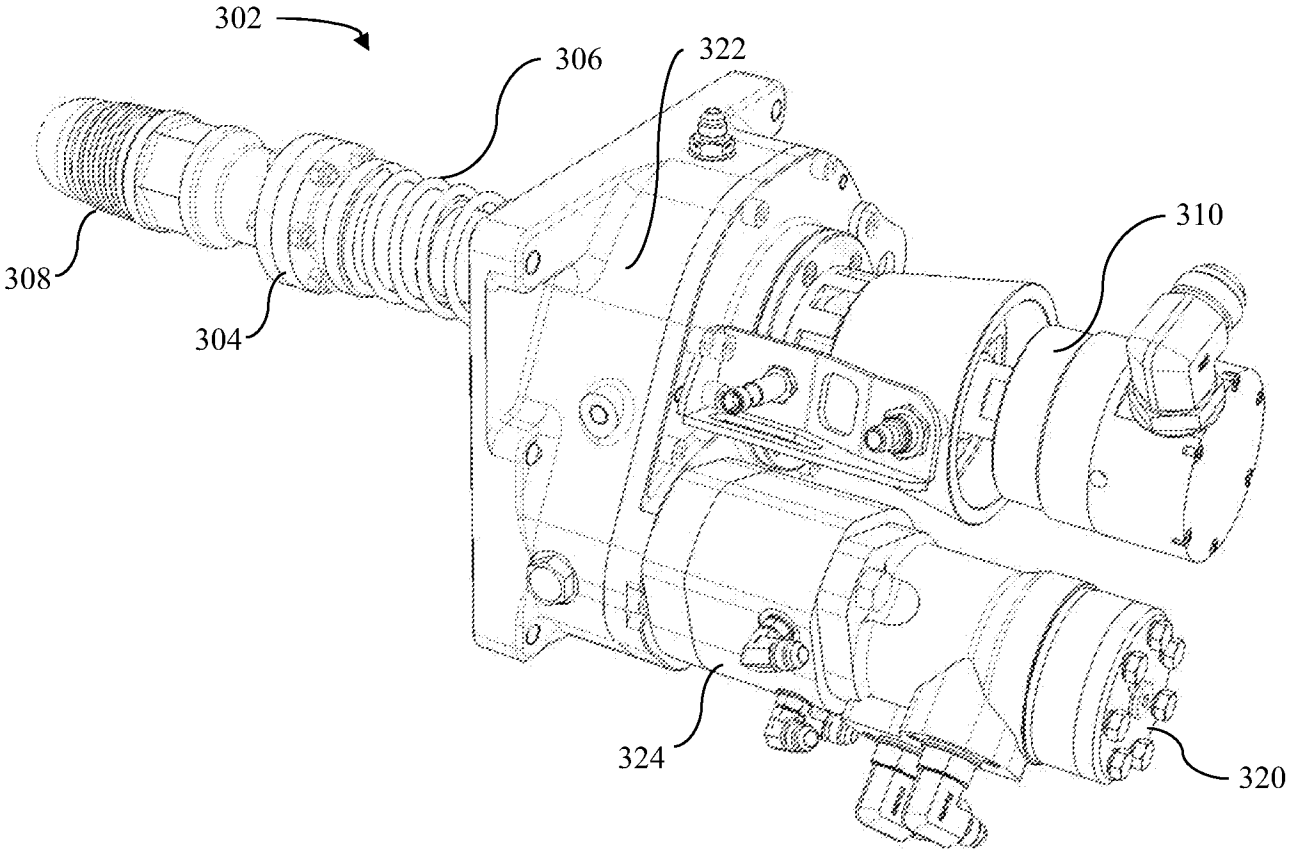
FIG. 16 illustrates an isolated rear perspective view of a water swivel assembly of the second head assembly as in FIG. 10.
Figure 17:
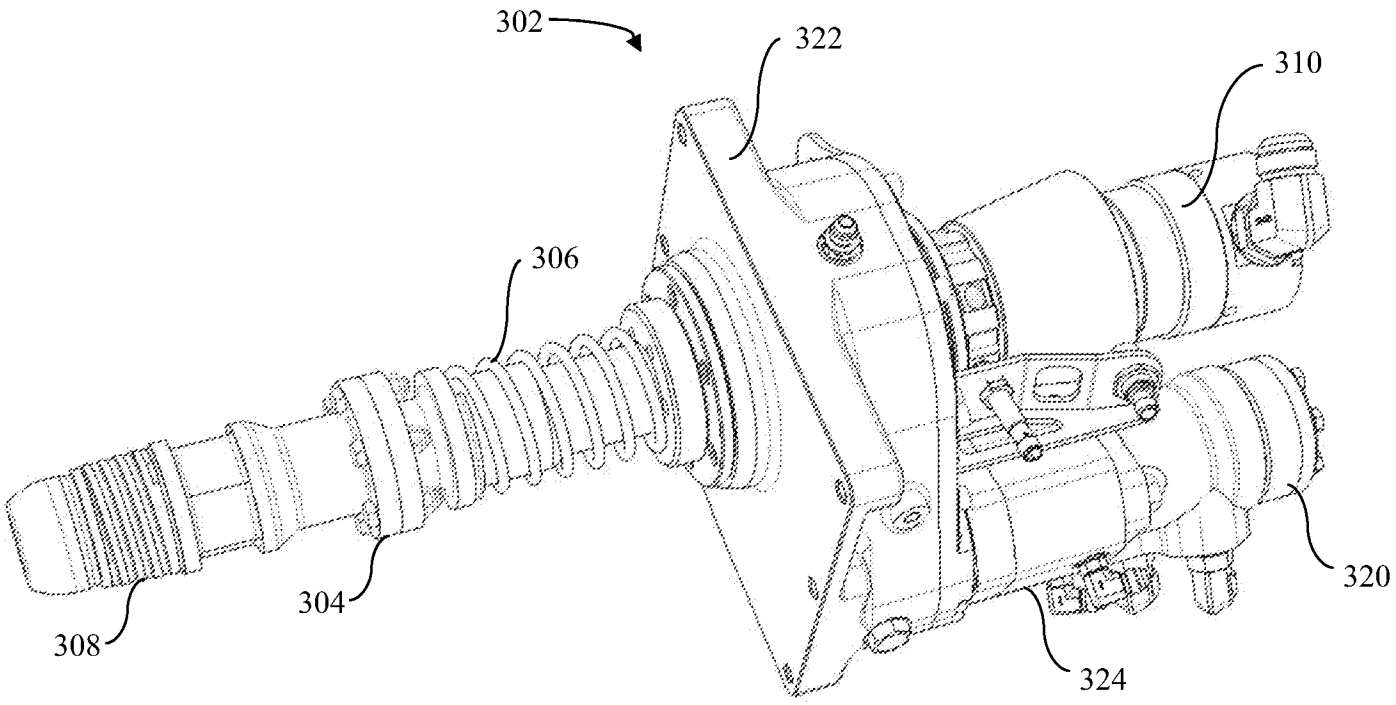
FIG. 17 illustrates an isolated side perspective view of the water swivel assembly as in FIG. 16.
Figure 18:
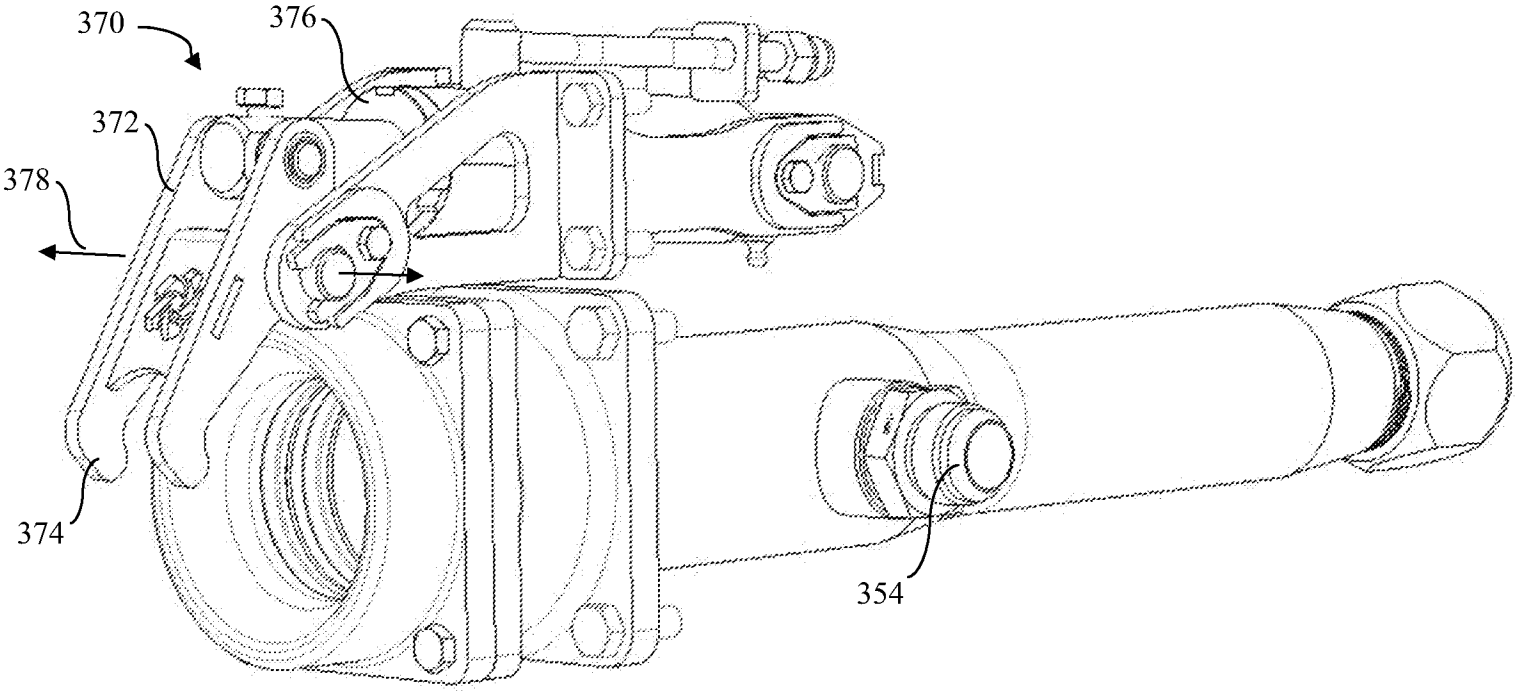
FIG. 18 illustrates an isolated front perspective view of an overshot loading chamber of the second head assembly as in FIG. 10.
Figure 19:
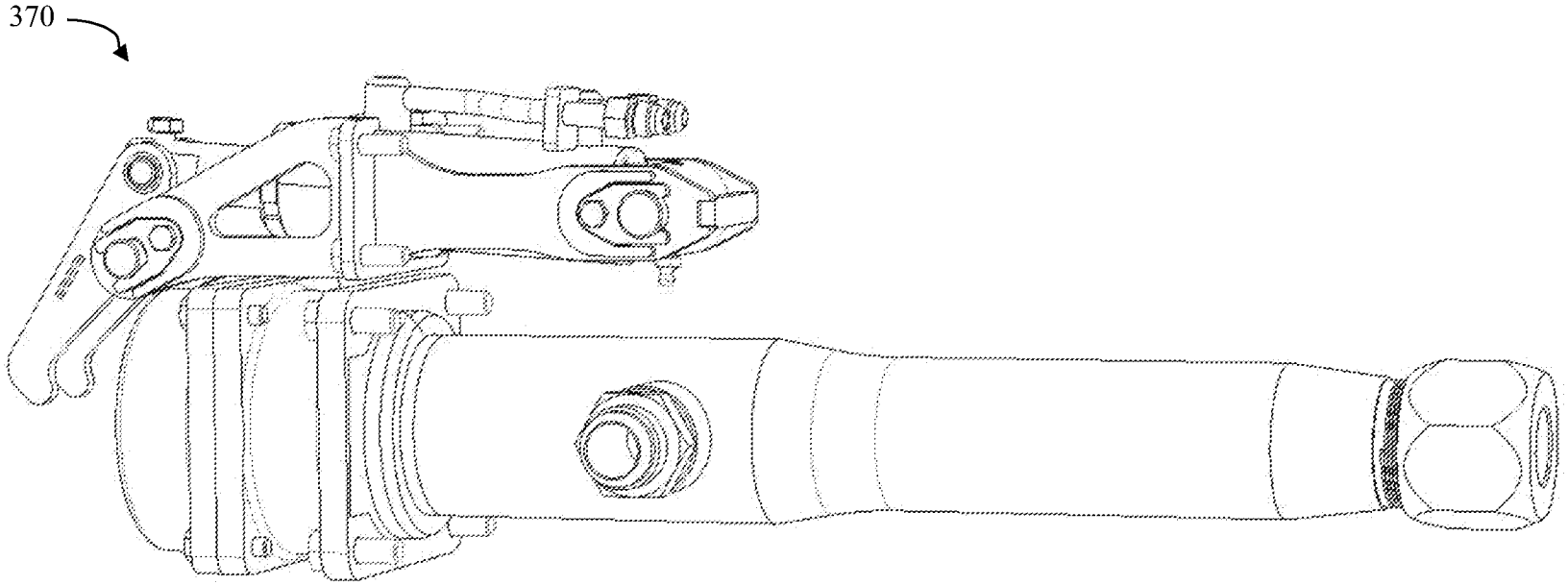
FIG. 19 illustrates a right side perspective view of the overshot loading chamber of FIG. 18.
Figure 20:
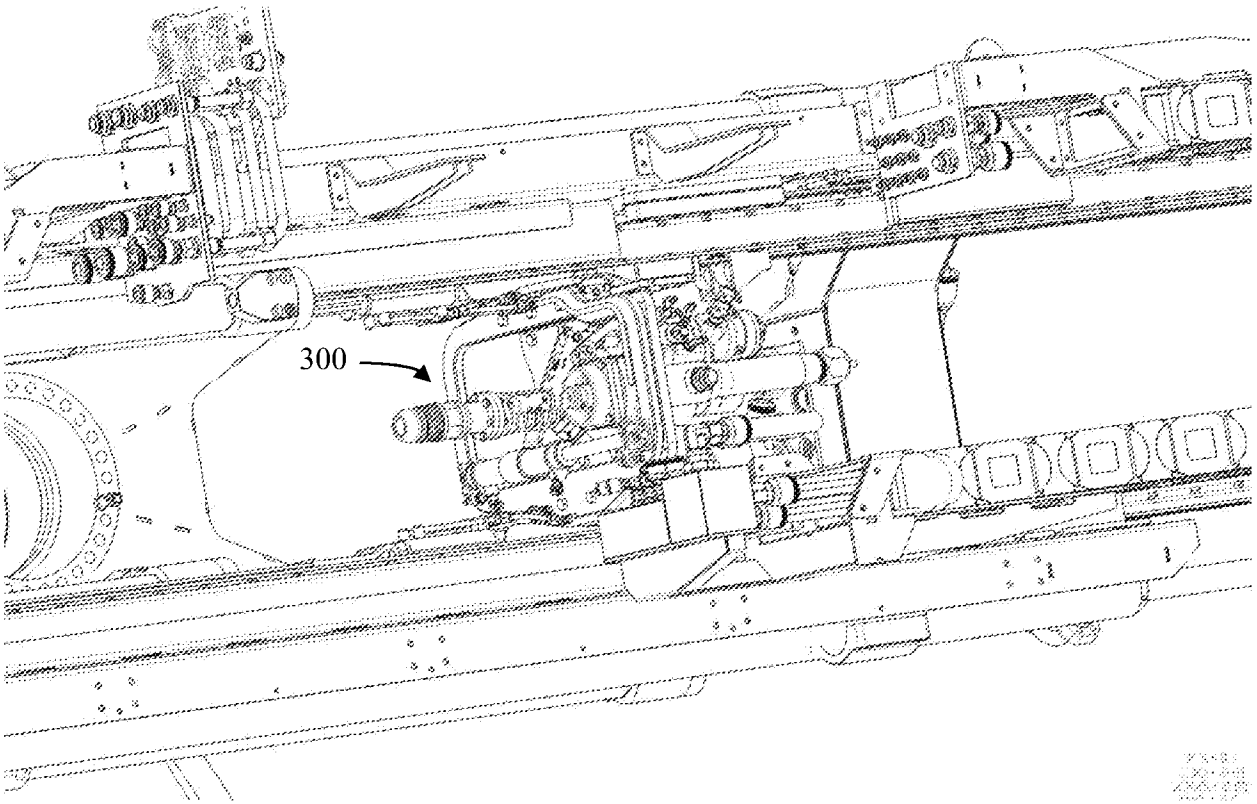
FIG. 20 illustrates a partial side perspective view of the drill rig as in FIG. 1, showing the second head assembly.
Figure 21:
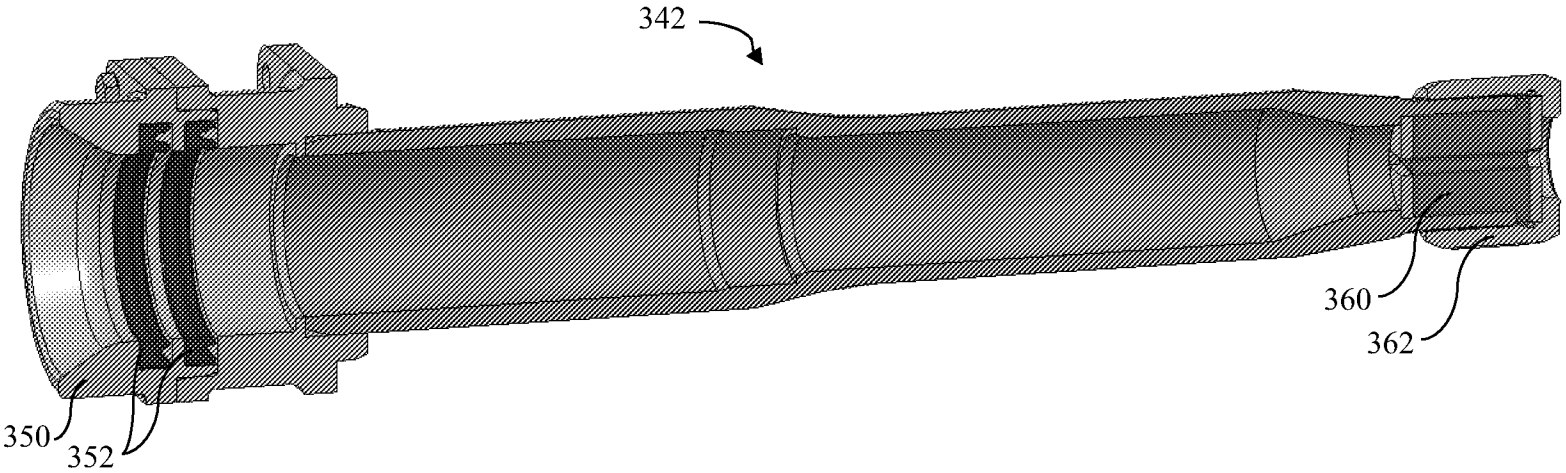
FIG. 21 illustrates a cross sectional view of the overshot loading chamber as in FIG. 18.
Figure 22:
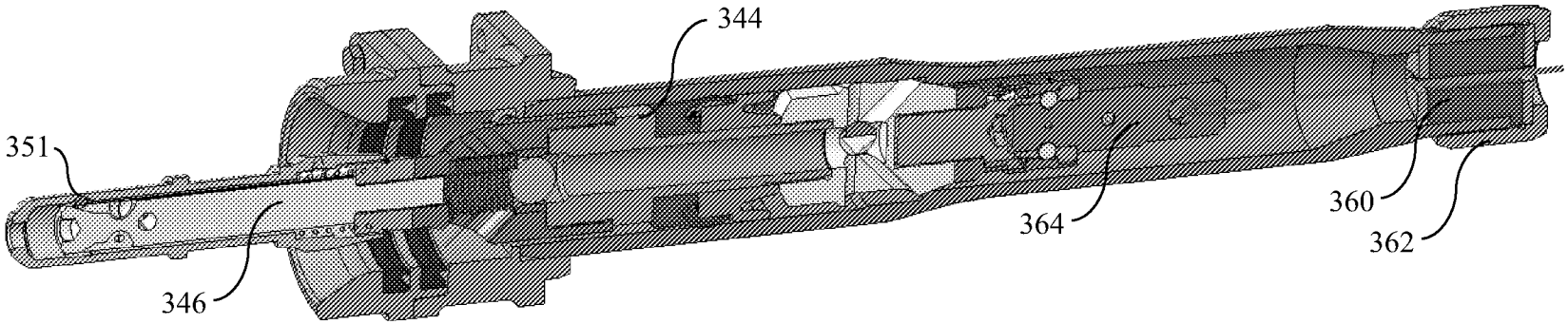
FIG. 22 illustrates a cross sectional view of the overshot loading chamber as in FIG. 21 with an overshot therein.
Figure 23:
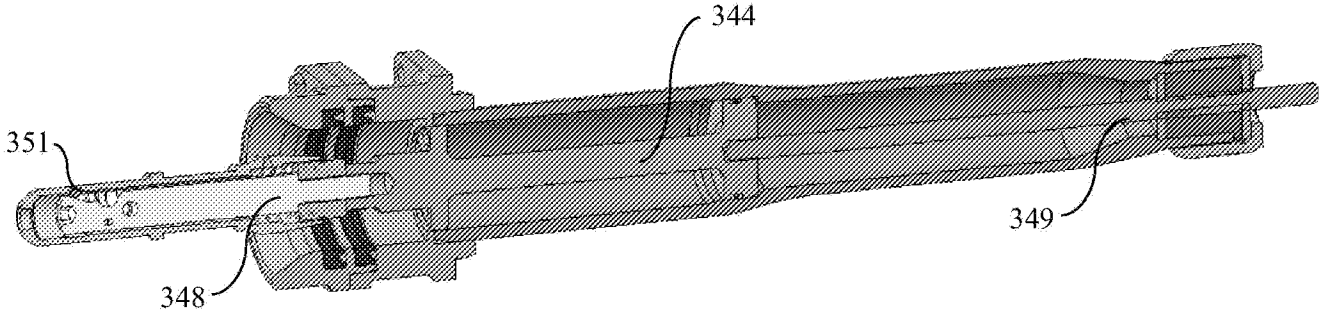
FIG. 23 illustrates a cross sectional view of the overshot loading chamber as in FIG. 21 with a catcher insert therein.

A second function of the second head assembly 300 is to provide wireline tools to the drill string 150. Referring to FIGS. 10 and 13, the second head assembly 300 can comprise an actuator 330 that moves at least a portion of the second head assembly 300 between a first position 332, in which the spindle is axially aligned with the longitudinal drilling axis of the drill rig, and a second position 334, in which an overshot loading assembly 340 is axially aligned with the longitudinal drilling axis of the drill rig. For example, a panel 333 may be slidable within a frame 331 that is stationary with respect to the dimensions transverse to the longitudinal drilling axis. Both the overshot loading assembly 340 and the water swivel assembly 302 can attach to the panel 333 so that as the panel 333 shifts transversely, the overshot loading assembly and water swivel assembly 302 shift therewith. The actuator 330 can comprise a hydraulic piston that moves the portion of the second head assembly 300 to the first position 332 when a hydraulic pressure is applied at a first inlet 336 and to the second position 334 when a hydraulic pressure is applied at a second inlet 338. For example, the actuator can comprise a cylinder having an outer surface that is coupled to the panel 333 via a bracket 335. As the piston extends, the cylinder can slide transversely to the longitudinal drilling axis, thereby shifting, via the bracket 335, the panel 333.

Referring to FIGS. 13 and 18-26, the overshot loading assembly 340 can comprise an overshot loading chamber 342 that can be configured to receive therein at least a portion, or in some embodiments, an entire overshot tool 344, such as, for example, a pump-in wireline overshot 346 (FIG. 22) or a catcher insert 348 (FIG. 23) for engaging a pump-out assembly (e.g., a reverse circulation overshot). As further disclosed herein, it is contemplated that these overshot tool components can be stored within the overshot loading chamber when not in use. According to at least one aspect, the catcher insert 348 can include a threaded retaining bolt 349 at a proximal end and a latching element 351 (e.g., a ball, a roller, a cylinder, a cam, and the like) at distal end that is configured to engage, and latch to, a pumped out core tube assembly that is pumped from a distal end of the drill string to the catcher insert 348. This is in contrast to a pump-in wireline overshot 346 that is pumped to a core tube assembly and coupled to the core tube assembly, and the core tube assembly and wireline overshot are retrieved via wireline as a coupled pair. One embodiment of an exemplary pump-in wireline overshot 346 can include the overshot assembly of the ROLLER LATCH QUICK PUMP-IN head assembly (the overshot itself referred to separately as the QUICK PUMP-IN OVERSHOT) manufactured by BOART LONGYEAR and disclosed in, for example, U.S. Pat. No. 9,328,608, which is hereby incorporated herein by reference in its entirety for all purposes. One embodiment of the catcher insert 348 can comprise features of the catcher insert of the HYDROSHOT reverse circulation overshot manufactured by BOART LONGYEAR. International Application No. PCT/US2018/017949, to Drenth et al., filed Feb. 13, 2018, which is hereby incorporated by reference herein in its entirety for all purposes, discloses a reverse circulation core tube assembly and aspects thereof that can be implemented with embodiments of the drilling system 200 as disclosed herein. For example, it is contemplated that the structure of the disclosed catcher insert can generally correspond to the distal portion of an overshot subassembly as disclosed in International Application No. PCT/US2018/017949.

In one embodiment, the catcher insert can comprise a latch assembly. Optionally, it is contemplated that the latch assembly can comprise at least one latch member (optionally, a plurality of latch members). It is contemplated that each latch member of the at least one latch member can be at least one of a ball, a roller, a cylinder, a cam-shaped element, and the like. In use, the latching assembly can be configured for movement about and between a retracted position and a deployed position. For example, in one aspect, the latch member is a ball detent. A distal portion of the latch assembly can be axially movable and spring-biased in a distal direction with respect to an inner portion. The inner portion of the latch assembly can define a groove that is tapered in a proximal direction so that proximal movement of the distal portion can allow the ball detent to move radially inwardly. Upon contact with the reverse circulation core tube assembly, the distal portion of the latch assembly can be driven proximally so that the ball detent can move radially inwardly. The distal portion of the latch assembly can then be received within the reverse circulation overshot. As the momentum of the reverse circulation overshot is exhausted, the applied force to the distal portion of the latch assembly can decrease so that the spring bias can cause the distal portion of the latch assembly to move distally, thereby moving the ball detent to the deployed position. It is further contemplated that any conventional latch mechanism can be used to effect locking engagement between the catcher insert and the head subassembly.

In one optional embodiment, the overshot assembly can include a main body coupled to pulling dogs for movement between an inner tube assembly coupling position and a release position. The overshot can include an annular seal for forming a fluid seal with the interior of a drill string. An elongated overshot tube can be joined to the main body and valving mechanism resiliently urged to block axial outward flow through the overshot tube. An overshot adaptor can include a valving mechanism to permit fluid to be pumped inwardly through the overshot adaptor and the overshot tube and block fluid flow in the opposite direction. When it is desired to retract an inner tube assembly or other drilling tool, overshot assembly can be pumped distally to engage the spear of the inner tube assembly with the pulling dogs. The overshot can then be retracted via wireline.

A front end of the overshot loading assembly 342 can comprise a seal housing 350 with seals 352 therein. The second head assembly 300 can be driven forward so that the seals 352 engage a proximal end of the drill string 150 to fluidly seal the overshot loading assembly to the drill string. The overshot loading assembly 340 can include a fluid port 354 that can receive a pressurized fluid (e.g., water). When the overshot loading assembly 340 is sealingly engaged with the drill string 150, the pressurized fluid can pump the overshot tool 344 toward the distal end of the drill string.

A rear end of the overshot loading assembly 340 can include a wireline seal 360 attached via a nut 362. The wireline seal 360 and nut 362 can each comprise an axial through-hole that can be sized and otherwise configured to allow a cable of a quick release cable connection 364, as is known in the art, to pass therethrough.

Figure 24:
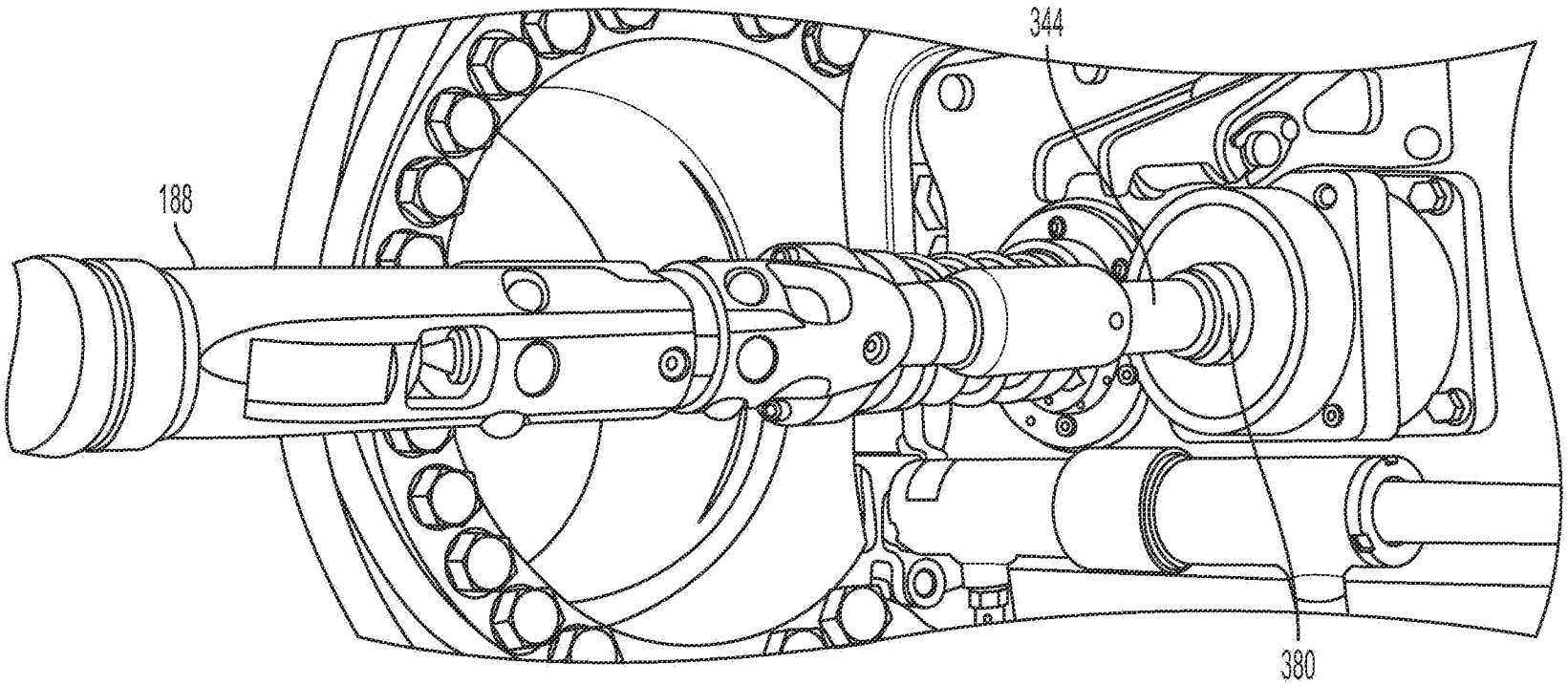
FIG. 24 illustrates a first step of an overshot releaser disengaging the overshot from a core tube assembly.
Figure 25:
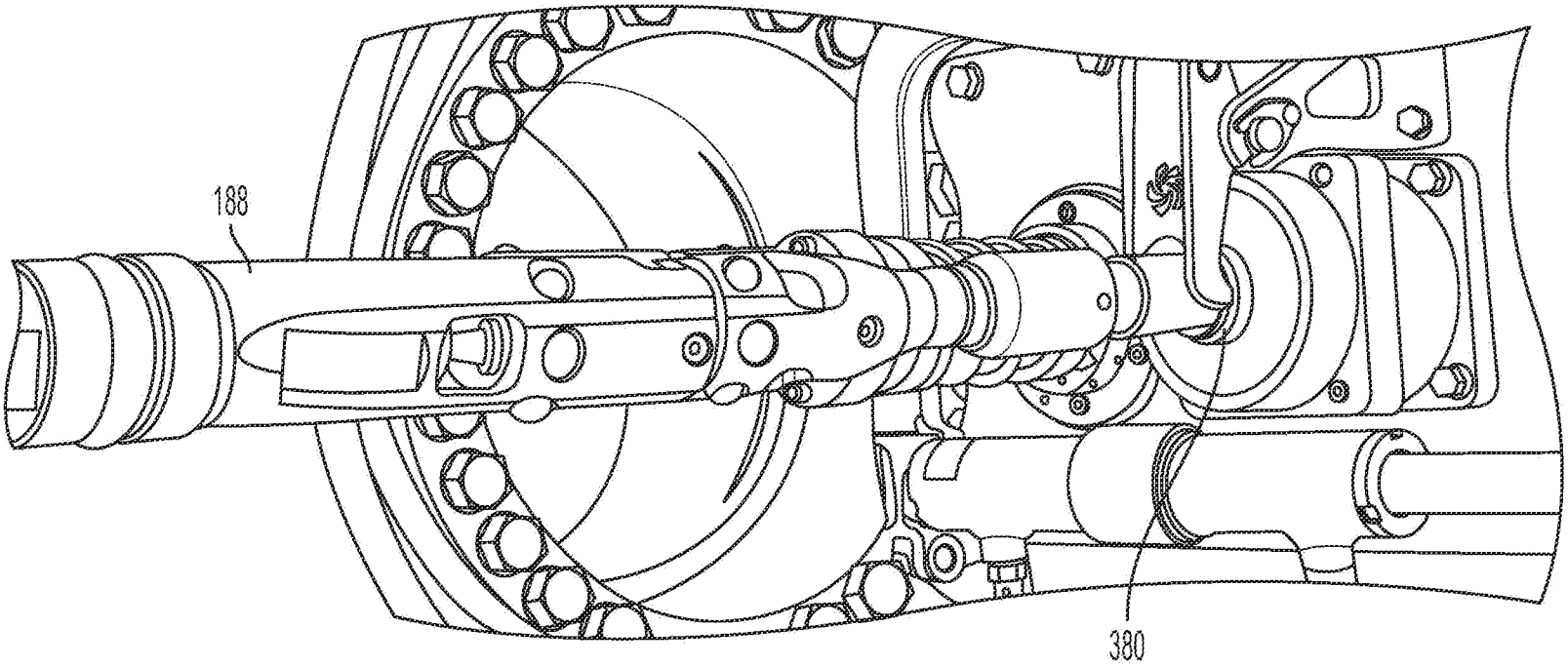
FIG. 25 illustrates a second step of the overshot releaser disengaging the overshot from the core tube assembly.
Figure 26:
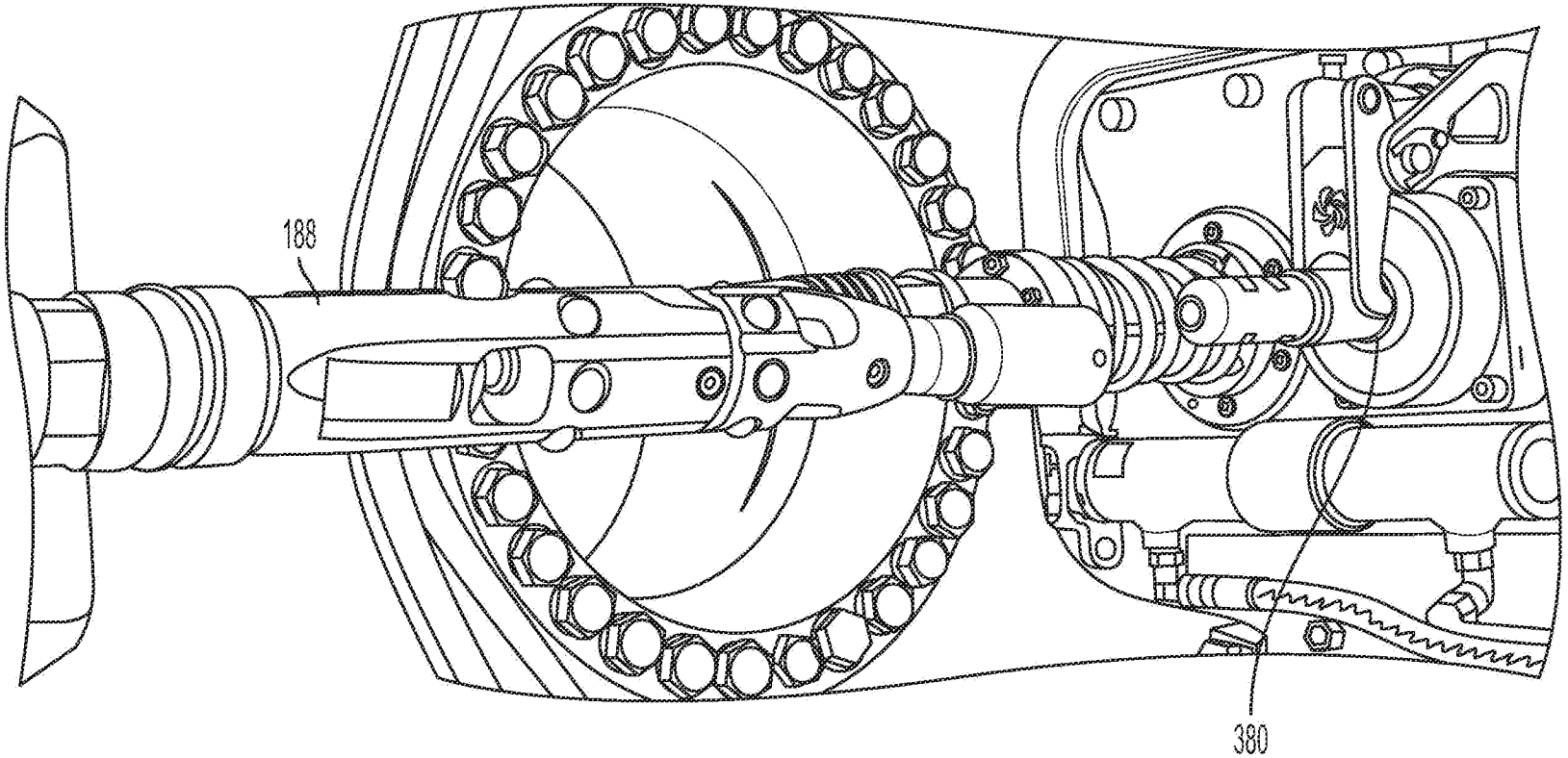
FIG. 26 illustrates a third step of the overshot releaser disengaging the overshot from the core tube assembly.

The overshot loading assembly 340 can further comprise an overshot releaser 370. The overshot releaser 370 can comprise a lever 372 having a forked first end 374 and a hydraulic piston 376 at an opposite second end that actuates to pivot the lever about its pivotal axis 378. The overshot release lever 372 can be used to delatch the wireline overshot 346 or catcher insert 348 from a core tube assembly 188 after it has been retrieved from a distal end of the drill string. The forked first end 374 of the lever 372 can pivot toward the overshot loading assembly's axis and engage an annular ridge 380 of the overshot tool 344. The core tube assembly can then be pulled axially away from the overshot tool 344 to disengage the core tube assembly from the overshot tool 344. FIG. 24 illustrates a first step of the overshot releasing method, in which the overshot releaser 370 is in a configuration prior to engagement with the overshot tool 344. FIG. 25 illustrates a second step of the overshot releasing method, in which the overshot releaser 370 is engaging the overshot tool 344. And FIG. 26 illustrates a third step in the overshot releasing method, in which the core tube assembly 188 has been released from the overshot tool 344.

Systems and Methods for Anchoring an Underground Drill Rig

Figure 36:
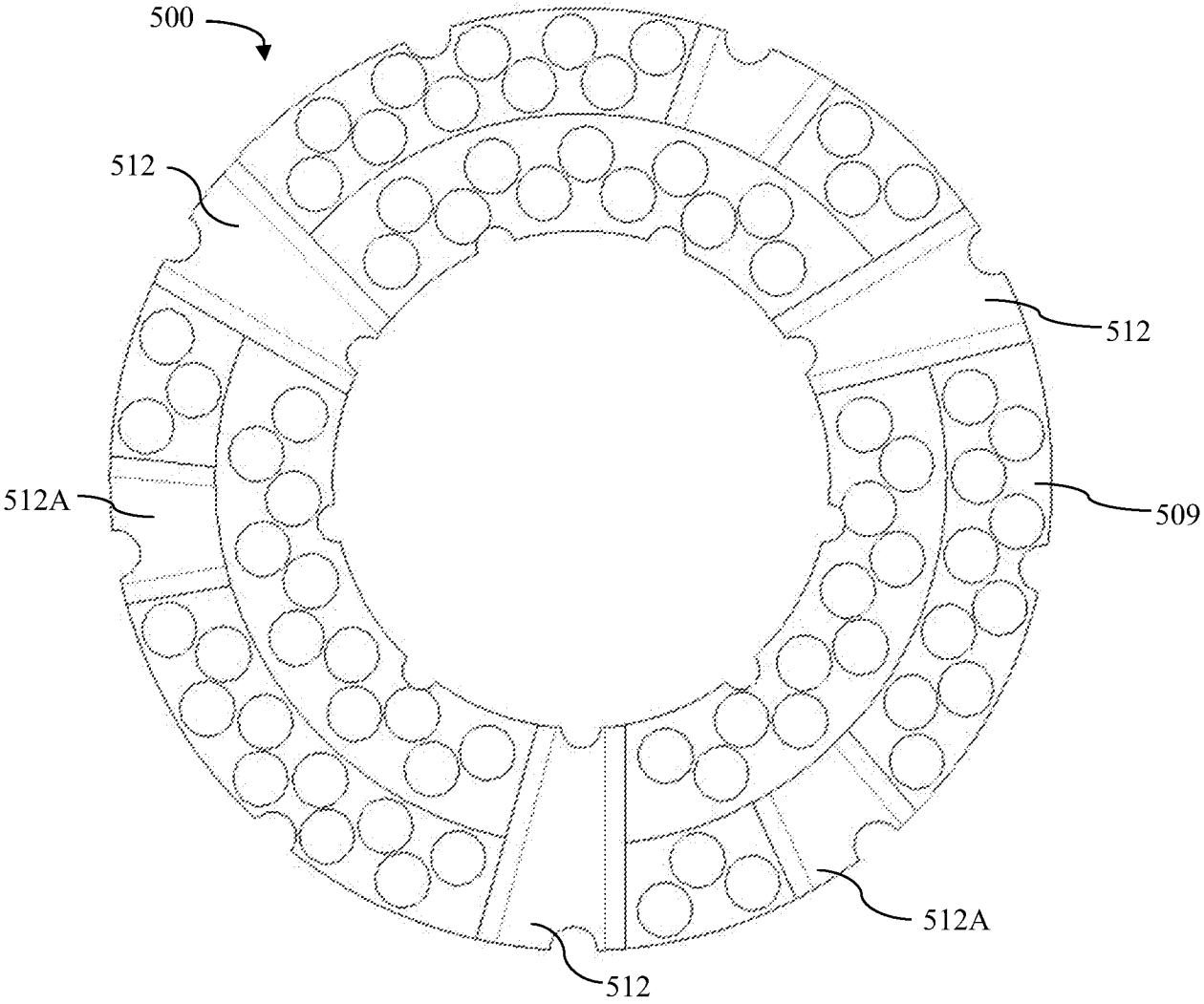
FIG. 36 is a top view of the stepped drill bit of FIG. 35.
Figure 37:
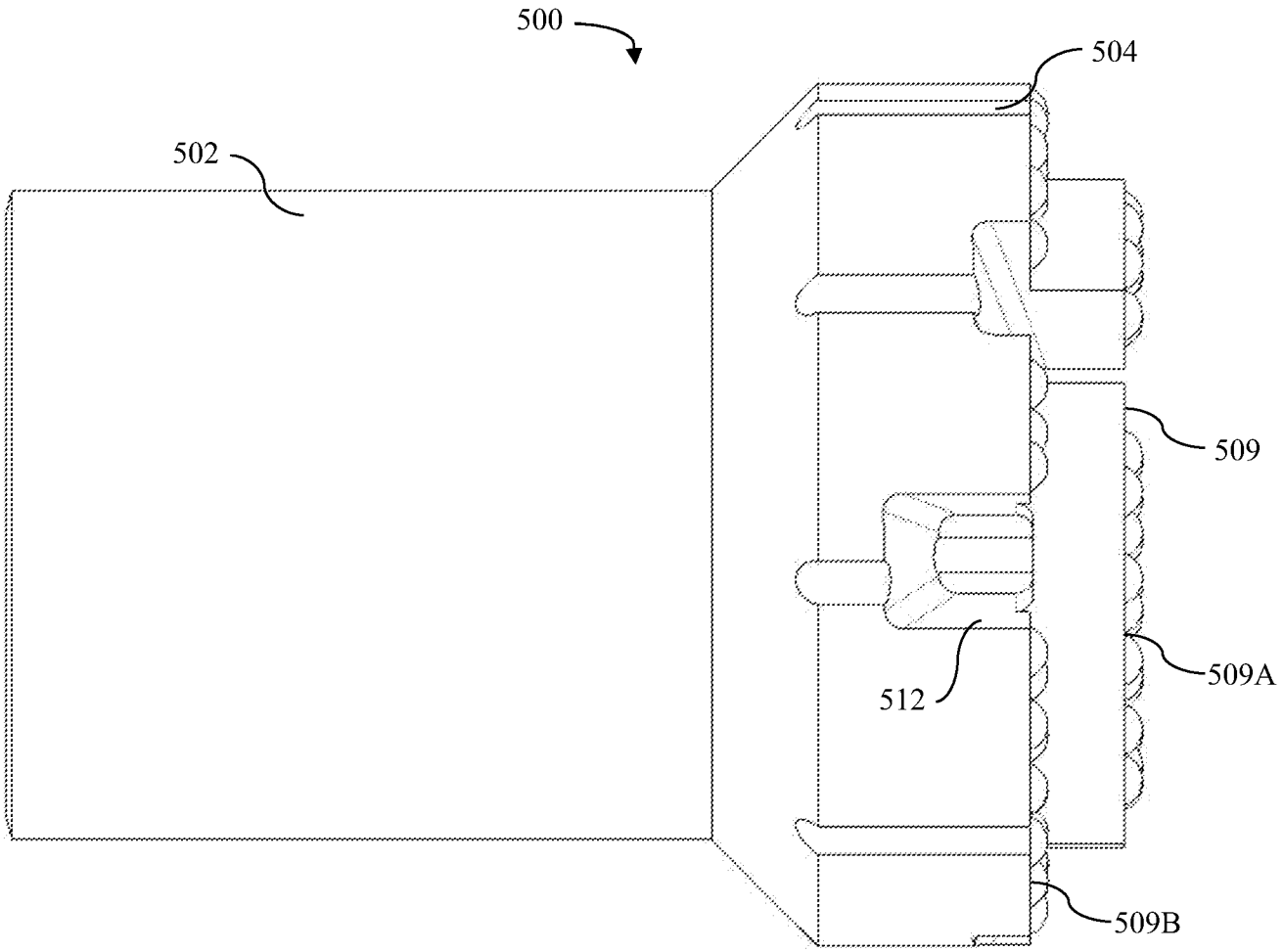
FIG. 37 is a side view of the stepped drill bit as in FIG. 35.

According to at least one embodiment, a casing pipe 400 can be used to anchor the drill rig 100 to the foundation 165. Although disclosed below with reference to drill rig 100, it is contemplated that the disclosed anchoring systems and methods can be used to anchor any known or conventional underground drill rig. Optionally, it is contemplated that the disclosed anchoring systems can be retrofit to an existing rig. A first bore having a first diameter can be drilled into the formation 165. The first diameter can be sufficient to receive the casing pipe 400. In some embodiments, a drill bit 500, as shown in FIGS. 35-39 can be used to drill said first bore. The drill bit 500 can be a core-sampling drill bit with axially-tapered waterways according to an implementation of the present invention. As shown in FIG. 37, the drill bit 500 can include a shank or blank 502, which can be configured to connect the drill bit 500 to a component of the drill string 150 (FIG. 1). The drill bit 500 can also include a cutting portion or crown 504. Optionally, the drill bit 500 can be an impregnated drill bit that includes abrasive cutting elements (e.g., diamond or synthetic diamond) within a matrix that is configured to wear away to continually expose the cutting elements during the life of the bit.

As shown in FIGS. 35, 36, 38, and 39, the drill bit 500 can define an interior space about its central axis 506 for receiving a core sample. Thus, both the shank 502 and crown 504 can have a generally annular shape defined by an inner surface 507 and outer surface 508. Accordingly, pieces of the material being drilled (e.g., core) can pass through the interior space of the drill bit 500 and up through an attached drill string. The drill bit 500 may be any size, and therefore, may be used to collect core samples of any size. While the drill bit 500 may have any diameter and may be used to remove and collect core samples with any desired diameter, the diameter of the drill bit 500 can range in some implementations from about 1 inch to about 12 inches. As well, while the kerf of the drill bit 500 (i.e., the radius of the outer surface minus the radius of the inner surface) may be any width, according to some implementations the kerf can range from about ¼ inches to about 6 inches.

The crown 504 can be configured to cut or drill the desired materials during the drilling process. In particular, the crown 504 of the drill bit 500 can include a cutting face 509. As illustrated in the Figures, the drill bit 500 can be a stepped drill bit, having a first cutting face 509A between the drill bit's central axis 506 and a first radius 530 and a second cutting face 509B outside of the first radius 530. The first cutting face 509A can be spaced from the second cutting face in a distal direction. The cutting face 509 can be configured to drill or cut material as the drill bit 500 is rotated and advanced into a formation. The cutting face 509 can comprise a plurality of projections 520. Optionally, the projections 520 can comprise the same material that forms the cutting face 509. For example, the projections 520 and the cutting face 509 can both comprise the same matrix material, which optionally includes impregnated abrasive cutting media. Exemplary configurations and characteristics of the projections 520 are further disclosed in U.S. Pat. No. 9,637,980, which is incorporated herein by reference in its entirety.

Figure 38:
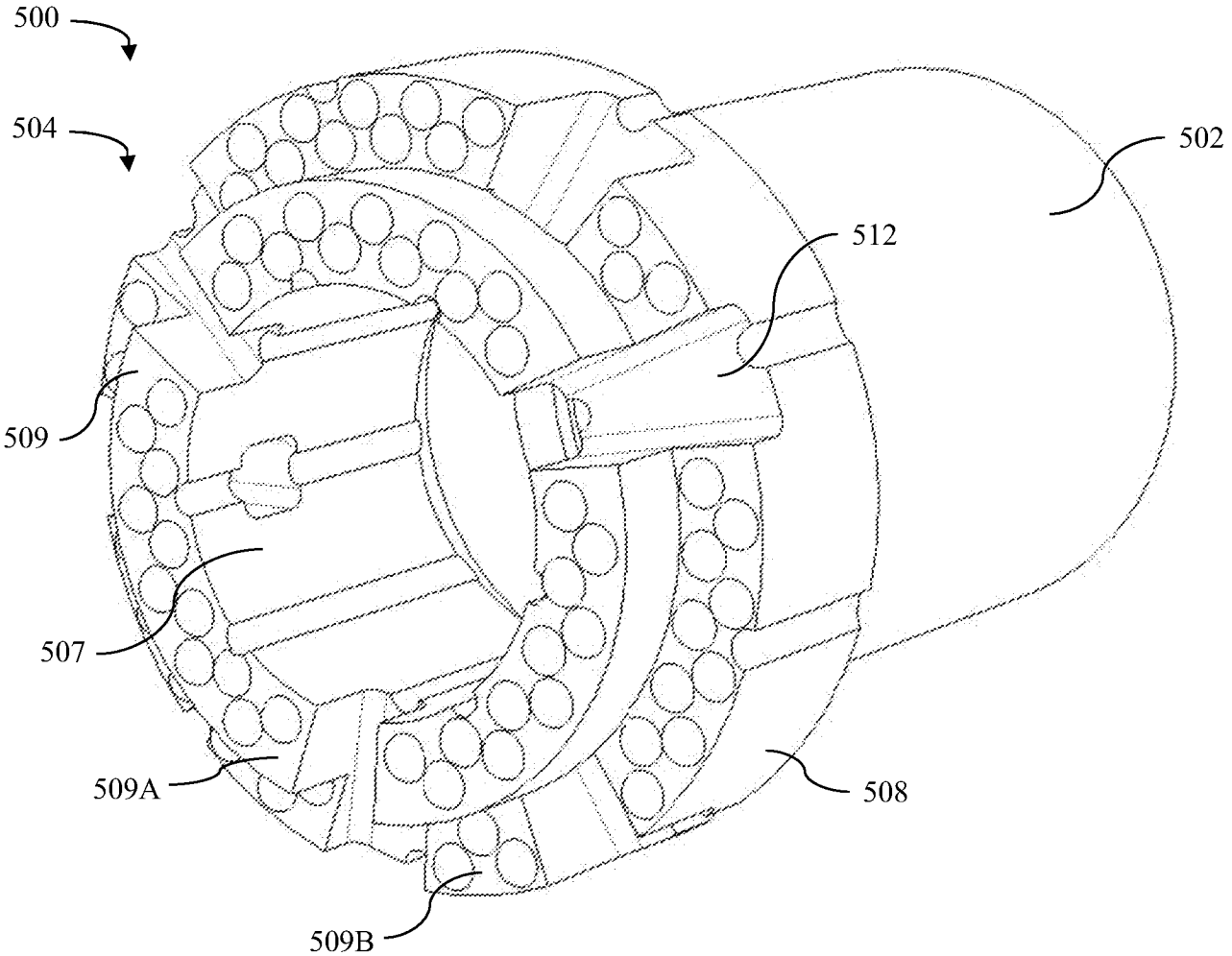
FIG. 38 is a top perspective view of the stepped drill bit of FIG. 35.
Figure 39:
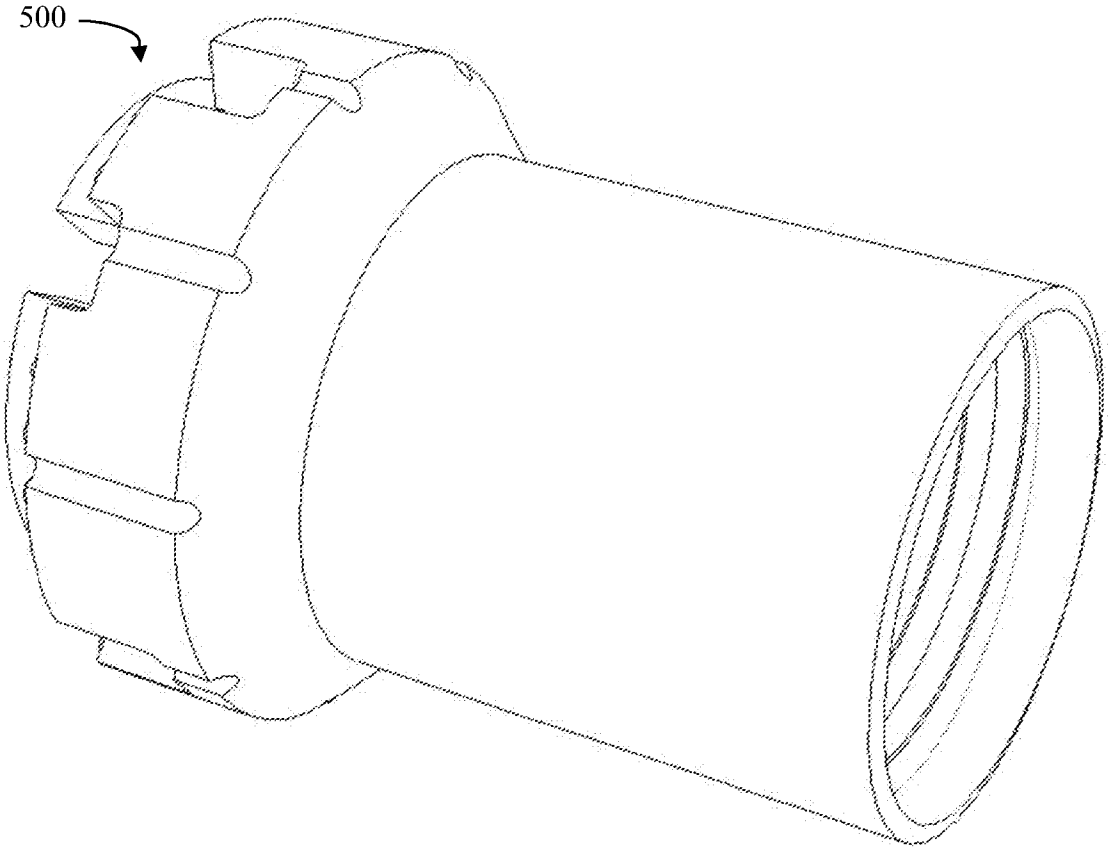
FIG. 39 is a bottom perspective view of the stepped drill bit of FIG. 35.

The cutting face 509 can also include waterways that may allow drilling fluid or other lubricants to flow across the cutting face 509 to help provide cooling during drilling. For example, FIG. 38 illustrates that the crown 504 can include a plurality of notches 512 that extend from the cutting face 509 in a generally axial direction into the crown 504 of the drill bit 500. Additionally, some notches 512 can extend from the inner surface 507 of the crown 504 to the outer surface 508 of the crown 504. In these aspects, the notches 512 can extend through the radial thickness of both the first and second cutting faces 509A, 509B. As waterways, the notches 512 can allow drilling fluid to flow from the inner surface 507 of the crown 504 to the outer surface 508 of the crown 504. Thus, the notches 512 can allow drilling fluid to flush cuttings and debris from the inner surface 507 to the outer surface 508 of the drill bit 500, and also provide cooling to the cutting face 509. Optionally, the drill bit can further comprise notches 512A that only extend through the radial thickness of the second cutting face 509B. It is contemplated that these notches 512A can be circumferentially offset from the notches 512 that extend through both the first and second cutting faces 509A, 509B.

The crown 504 may have any number of notches that provides the desired amount of fluid/debris flow and also allows the crown 504 to maintain the structural integrity needed. For example, FIGS. 36 and 38 illustrate that the drill bit 500 includes six notches 512. One will appreciate in light of the disclosure herein that the present invention is not so limited. In additional implementations, the drill bit 500 can include as few as one notch or as many 20 or more notches, depending on the desired configuration and the formation to be drilled. Additionally, the notches 512 may be evenly or unevenly spaced around the circumference of the crown 504. For example, FIG. 38 depicts six notches 512, wherein three notches extend to the first face 509A, and three notches are axially spaced from the first cutting face 509A. The notches of each triplet of notches are evenly spaced from each other about the circumference of the crown 504, and the triplets of notches are rotationally offset from each other. In alternative implementations, however, the notches 512 can be staggered or otherwise not evenly spaced. Each of the notches 512 can be axially and radially tapered. For example, the notches 512 can have an increasing cross sectional width and height in from the inner surface 507 to the outer surface 508. U.S. Pat. No. 8,459,381 to Pearce et al., filed Dec. 15, 2009, which is hereby incorporated by reference herein for all purposes, discloses various additional features of drill bits that can be incorporated into the drill bit 500.

Figure 27:
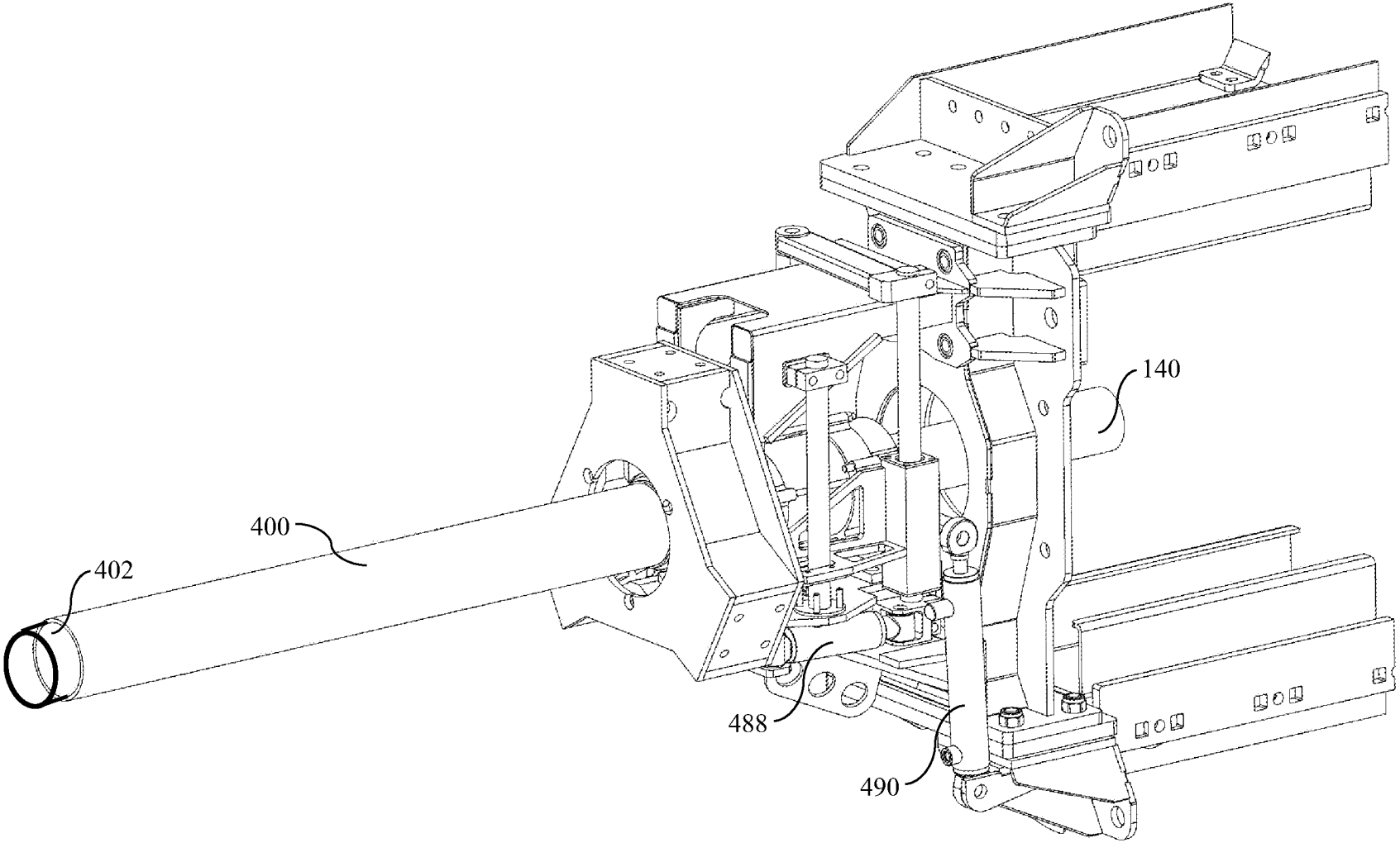
FIG. 27 illustrates a front, right perspective view of an anchoring system for the drill rig of FIG. 1.

Referring to FIGS. 1 and 27, the first bore hole can be drilled while the drill rig 100 is not anchored. Accordingly, the first bore can be drilled using a relatively low axial pressure of the drill bit against the formation 165. For example, the axial pressure can be low enough that the frictional force between the drilling system 200 and the ground holds the drill rig in place when drilling the first bore. The drill rig 100 can then insert the casing pipe 400 into the first bore. For example, the first head assembly 110 can have jaws that have sufficient radial travel to grip the outer diameter of the casing pipe 400. The rod holder 172 can similarly have jaws with sufficient radial travel to grip the outer diameter of the casing pipe 400. The casing pipe 400 can have a binder 402 in a capsule at the front of the casing pipe or on an exterior surface. The binder 400 can be, for example, a plurality of resin sticks. Once the casing pipe 400 is inserted into the first bore, the binder can set to grip the wall of the first bore. According to some aspects, it is contemplated that the method of anchoring the drill rig 100 can require a step of waiting for the binder 402 to set before proceeding.

Figure 73:
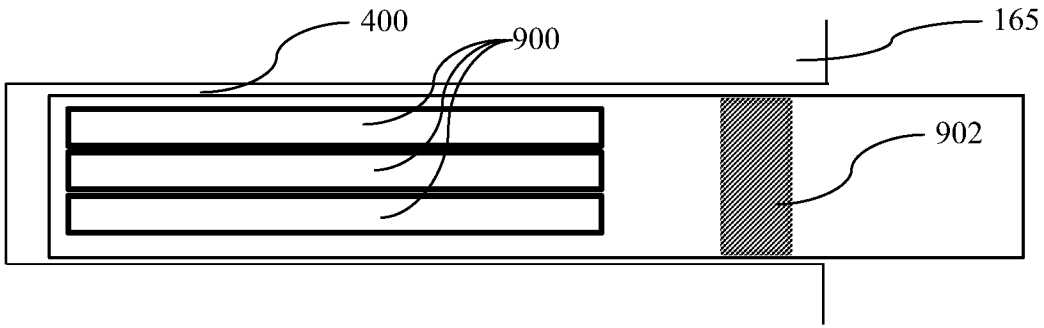
FIG. 73 is a schematic view of a configuration for adhering the casing to the borehole.

In further aspects, and with reference to FIG. 73, adhesive tubes 900 can be inserted into the casing pipe 400 (e.g., during setup of the drill rig). A plug 902 can be disposed proximally of the adhesive tubes 900 within the casing pipe 400. The first casing pipe can be inserted into the drilled bore hole. Then, the second head 300 can couple to the casing pipe 400 and apply water pressure to the casing pipe 400 to force the plug 902 distally, thereby forcing the adhesive in the adhesive tubes into the annulus between the casing pipe 400 and the bore hole wall. After waiting for the adhesive to cure, the drill rig can then be anchored to the casing pipe.

Referring to FIGS. 1 and 27-33, the casing pipe 400 can comprise a generally cylindrical tubular member having a central axis 404. The casing pipe 400 can be secured to an anchoring nut 412. The anchoring nut 412 can comprise a gripping feature 414. According to some aspects, the anchoring nut 412 can be welded to the casing pipe 400. In further aspects, a single monolithic, unitary body can comprise the casing pipe 400 and the anchoring nut 412. For example, the casing pipe and anchoring nut can be cast as a single component. In at least one embodiment, the casing pipe 400 and anchoring nut 412 can be collectively embodied as a cylindrical tube having a gripping feature 414 thereon.

The gripping feature 414 can comprise a pair of spaced annular ribs 416 that extend radially from the anchoring nut 412. The spaced annular ribs can have opposing faces 418 that slope toward each other from a farthest radial edge toward the central axis 404 of the casing pipe. In this way, the gripping feature can comprise an annulus that is tapered in a radially inward direction. In some embodiments, the taper can be at a selected angle from a radial axis that extends perpendicularly from the anchoring nut. In these embodiments, it is contemplated that the selected angle can range from about 10 degrees to about 45 degrees or from about 15 degrees to about 40 degrees. In one exemplary embodiment, the selected angle can be about 30 degrees.

As shown in FIGS. 29-33, a clamp 420 can engage the gripping feature 414 of the anchoring nut 412. According to some aspects, the clamp 420 can be configured to attach to the drill rig 100 via a bracket 410. In further embodiments, the clamp 420 can be integral to the drill rig 100. The clamp 420 can have a plurality of jaws 422 (e.g., three jaws, as shown) that are configured to move axially from a central axis 424. According to some aspects, the jaws 422 can be hydraulically actuated. Each jaw 422 can comprise a complementary shape to be received within the gripping feature 414. For example, each jaw 422 can comprise, in cross section in a longitudinal plane including the central axis 424 of the clamp 420, a complementary shape to that of a cross section of the gripping feature 414 in the same plane. Similarly, in a plane transverse to the clamp's central axis 424, the clamp jaws can have an inner radius that is equal to the outer radius of the gripping feature in the same transverse plane. Accordingly, when the casing pipe 400 is engaged with the first bore, and the clamp 420 is engaged with the gripping feature 414, the drill rig 100 can be anchored so that it can be fixed with respect to the bore. In other words, rotational and axial drilling forces can be transferred through the clamp 420, to the casing pipe 400, and to the first bore in the formation. Once anchored, the drill rig 100 can drill a second bore 196 (FIG. 1) through the casing pipe, wherein the first bore and the second bore share a common longitudinal axis.

Figure 52:
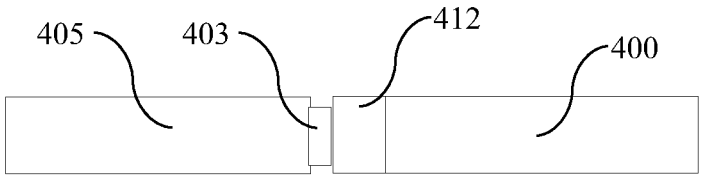
FIG. 52 is a schematic of an assembly comprising a drive rod, an anchor nut, and the casing pipe.
Figure 57:
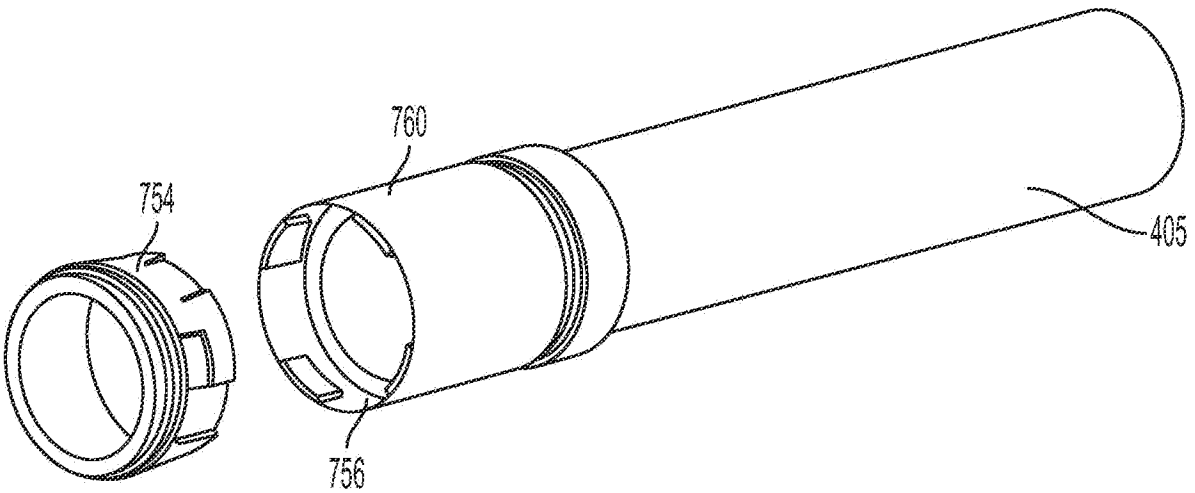
FIG. 57 is an extension rod for inserting the casing into the borehole.
Figure 58:
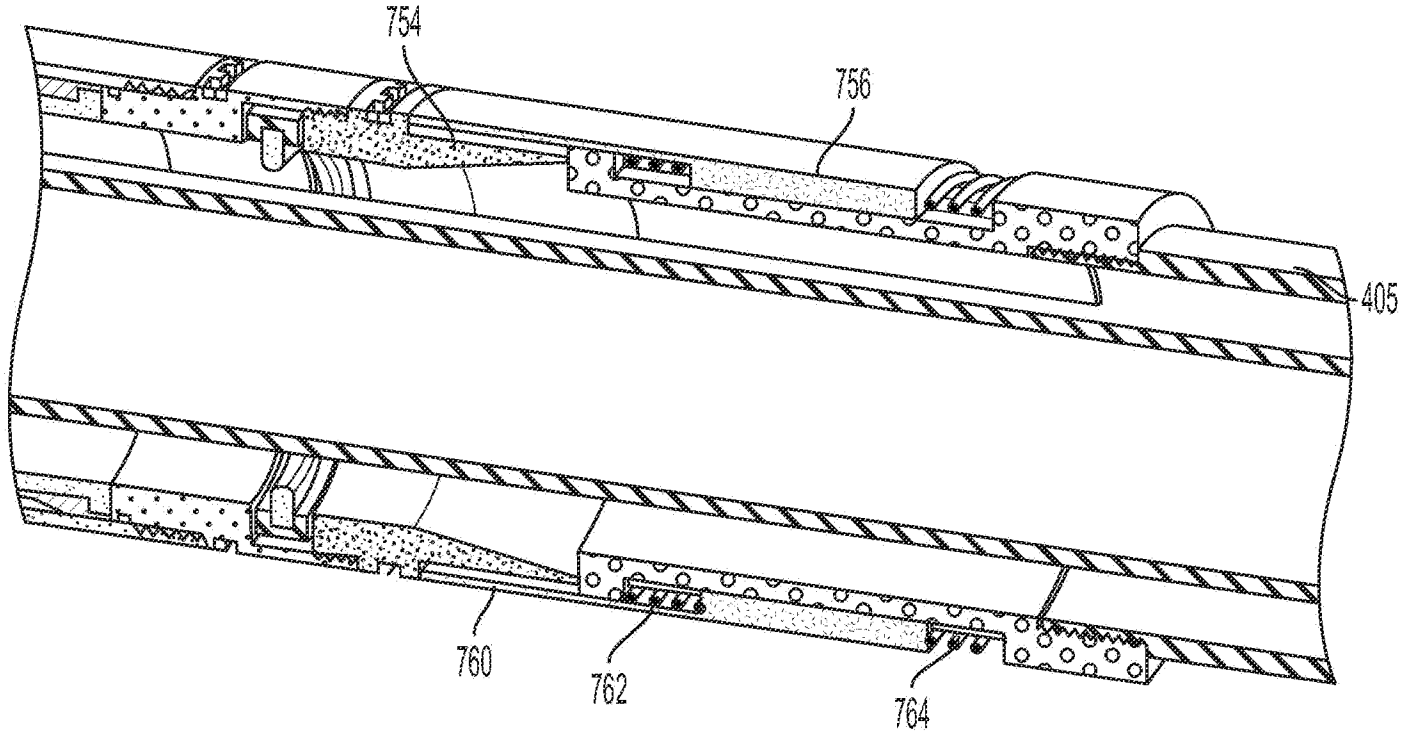
FIG. 58 is a partial sectional view of the extension rod of FIG. 57.

Referring to FIGS. 52, 57, and 58, it is contemplated that an end of the anchoring nut 412 opposite the casing pipe 400 can comprise one or more female threads to receive male threads 403 of a drive rod 405. The drive rod 405 can be used to push the casing into the first bore. In some aspects, the drive rod can couple to the anchoring nut via a bayonet coupling. For example, the drive rod 405 (or extension rod) can comprise a female bayonet head that is configured to engage a male bayonet head of the anchoring nut. In further aspects, the male and female components can be reversed so that the drive rod comprises the male bayonet head, and the anchoring nut can comprise a female bayonet head. In this way, the drive rod 405 can releasably couple to the casing pipe.

In some situations, a pump-out core tube can be used to retrieve a core sample from a distal end of the drill string. To retrieve the pump-out core tube, high pressure water (or other fluid) can be pumped down an annulus between the bore and the drill string, thereby forcing the core tube down the central bore of the drill string toward the drill string's proximal end. Accordingly, a seal can be made between the casing and the drill string in order to direct pumped-in water down the bore (i.e. away from the drill rig). A seal casing gland 450 can attach to the anchoring nut 412 at an end of the anchoring nut 412 opposite the casing pipe 400. The seal casing gland 450 can be configured to create a seal between the casing pipe 400 and an outer surface of the drill string 150. The seal casing gland can comprise a front end 452 that is configured to seal against the anchoring nut 412. The seal casing gland 450 can define an annular lip 454 against which the anchoring nut can abut. An annular groove 456 can receive a seal therein for sealing against an exterior circumferential surface of the anchoring nut.

Figure 34A:
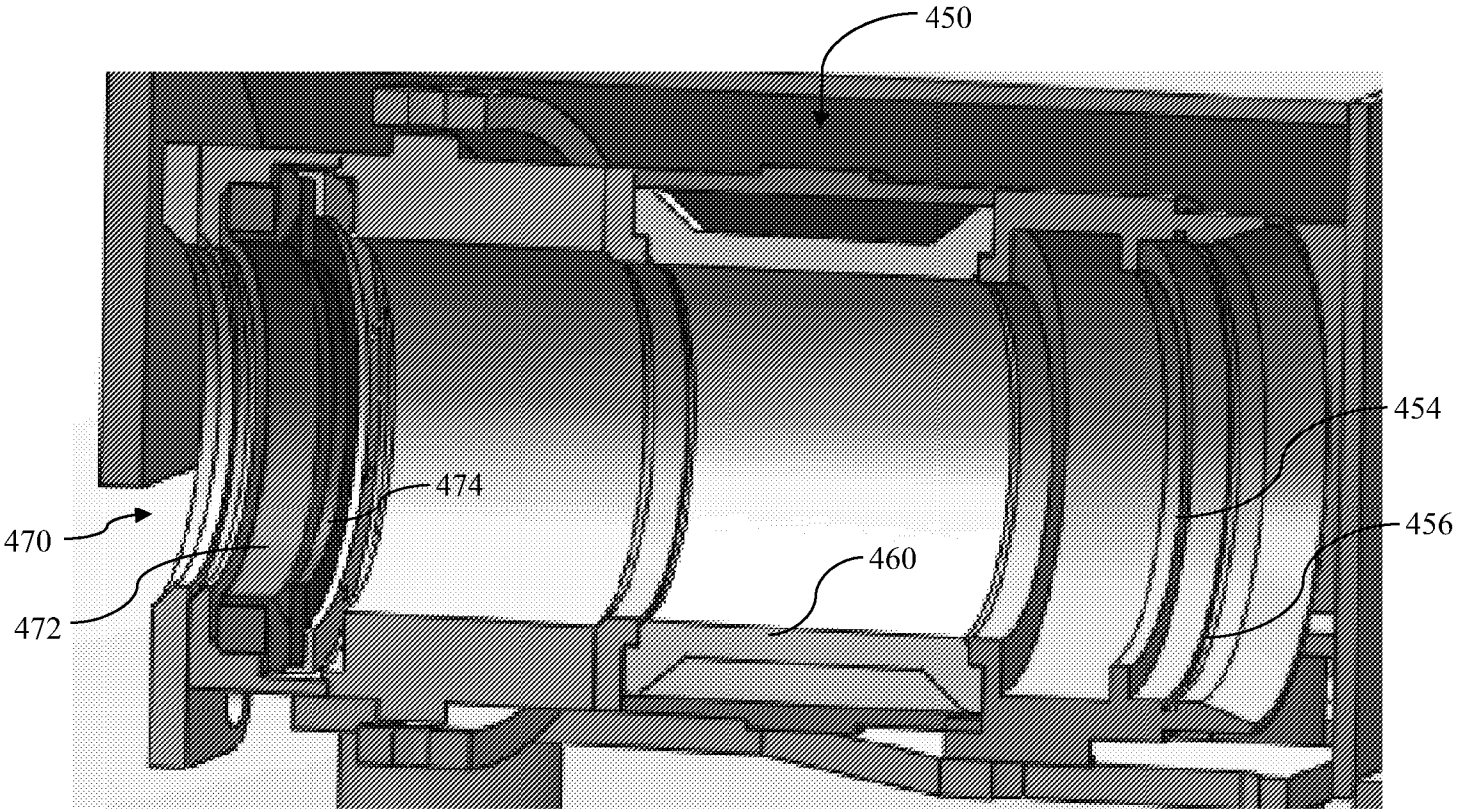
FIG. 34A is section view of a seal casing gland of the anchoring system of FIG. 27.
Figure 34B:
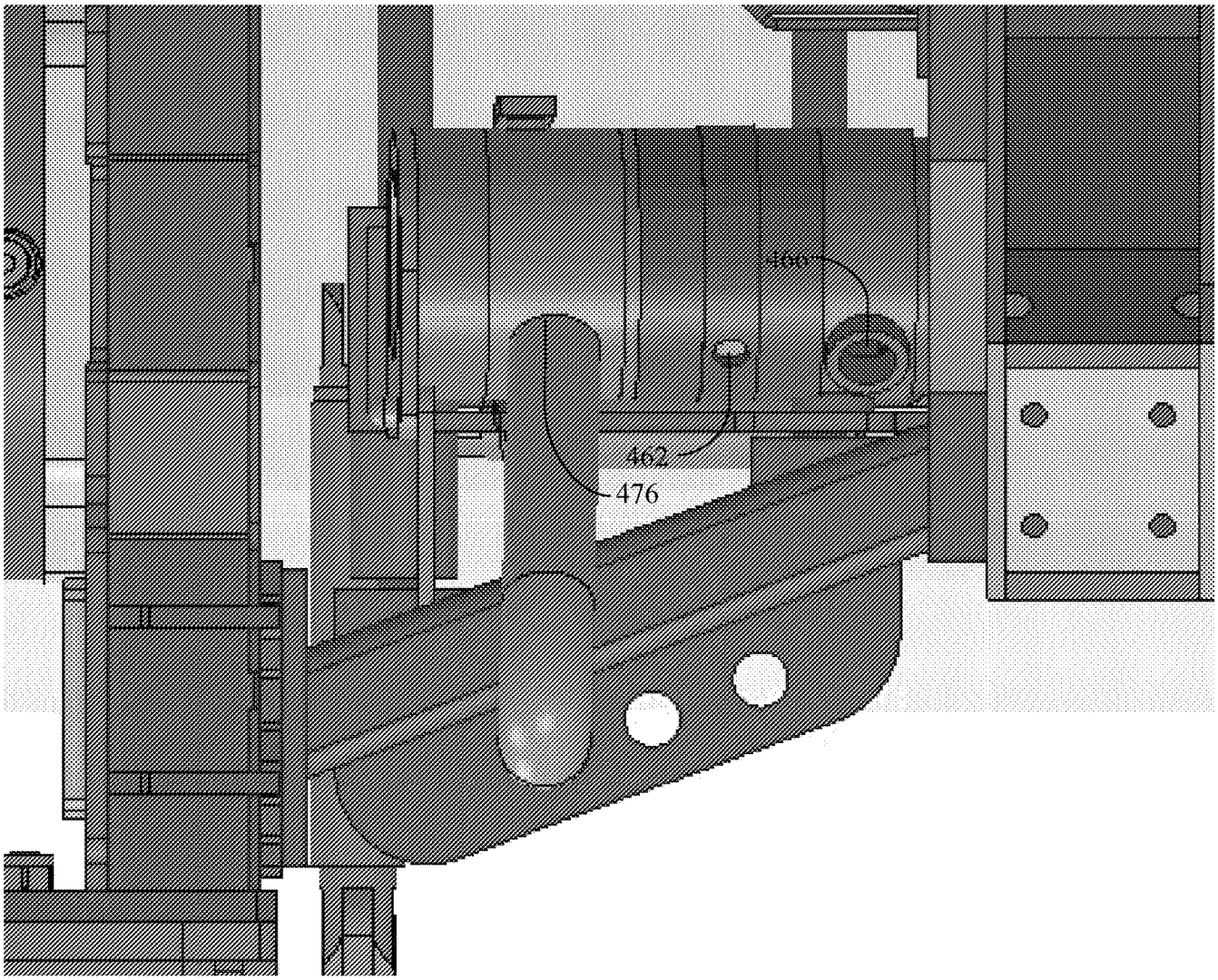
FIG. 34B is a side view of the seal casing gland of FIG. 34A.
Figure 35:
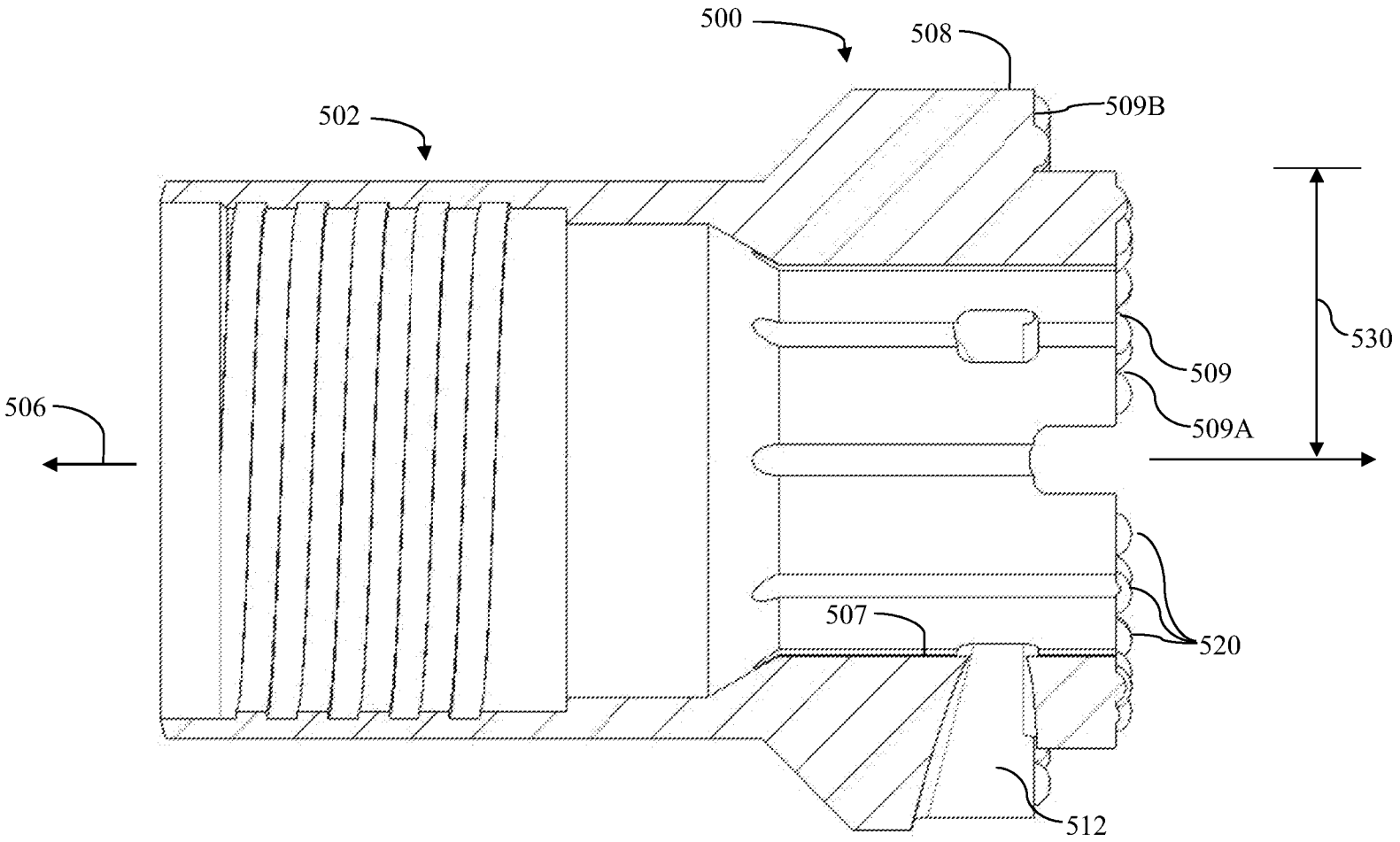
FIG. 35 is cross-sectional view of a stepped drill bit for drilling a bore for inserting a casing pipe of the anchoring system of FIG. 27.

Referring to FIGS. 34A and 34B, the seal casing gland 450 can comprise an annular bladder 460 comprising rubber or another flexible material. The annular bladder 460 can receive water (or other fluid) therein from a first hose connection 462. Upon receiving water in the annular bladder 460, the bladder can inflate to seal against an exterior surface of the drill string 150. Water can then be pumped into the seal casing gland through a second water connection 466. Because of the seal between the seal casing gland and the drill string, the water pumped in through the second hose connection 466 is directed down the bore and ultimately applying fluid pressure against the pump-out core tube that pumps the core tube through the drill string to its proximal end, where the catcher insert 348 (FIG. 23) can engage the core tube.

A rear end 470 of the seal casing gland 450 can include a bearing 472 that can engage an outer surface of the drill rod 140, thereby acting as a rod guide. A seal 474 can mount to the bearing to seal in drilling fluid that returns through the annulus between the drill string and the bore. A third hose connection 476 can be in communication with the annulus between the drill string 150 and the seal casing gland and provide an outlet for returning drilling fluid.

Figure 28:
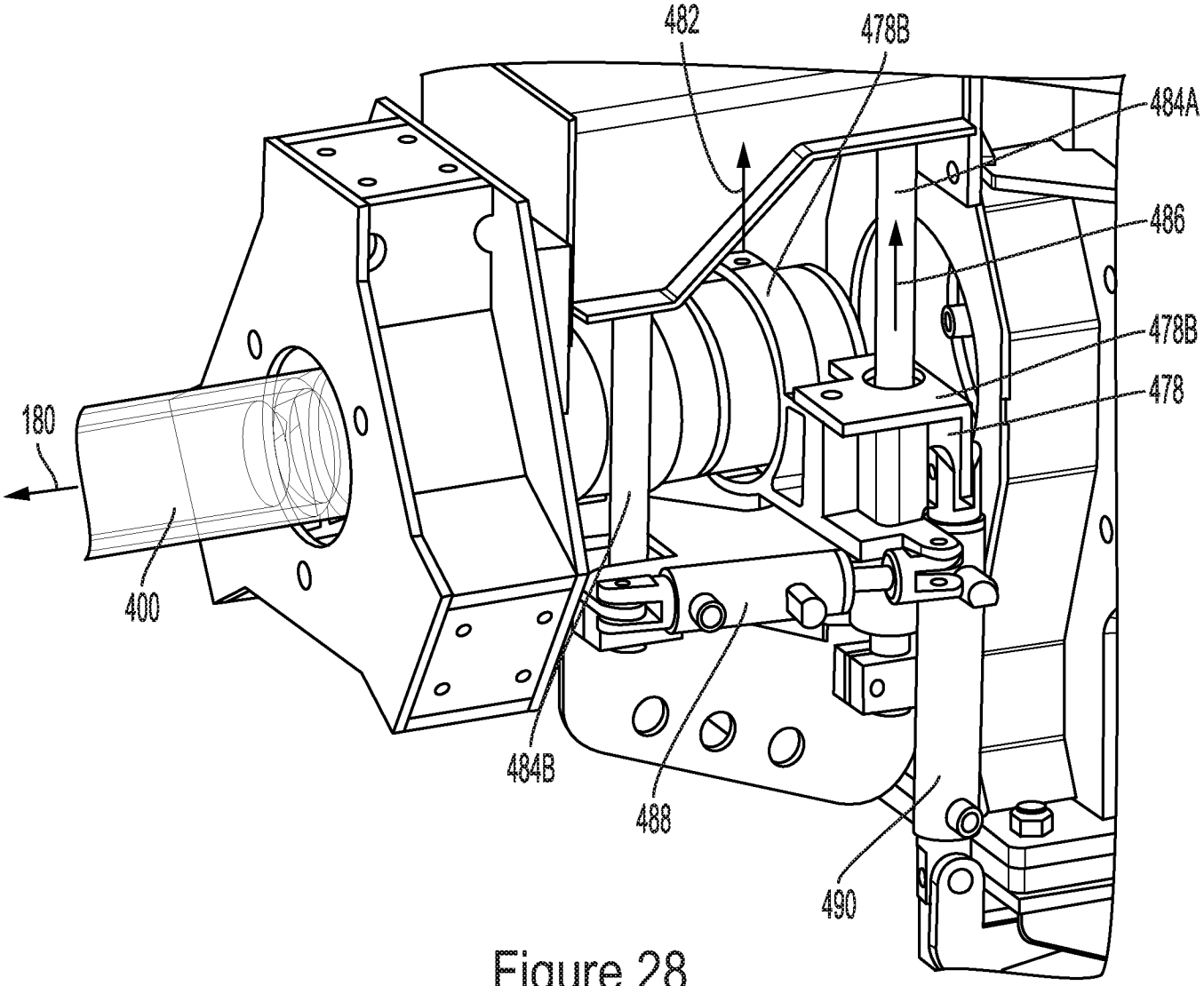
FIG. 28 a close-up perspective view of the anchoring system of FIG. 27.
Figure 29:
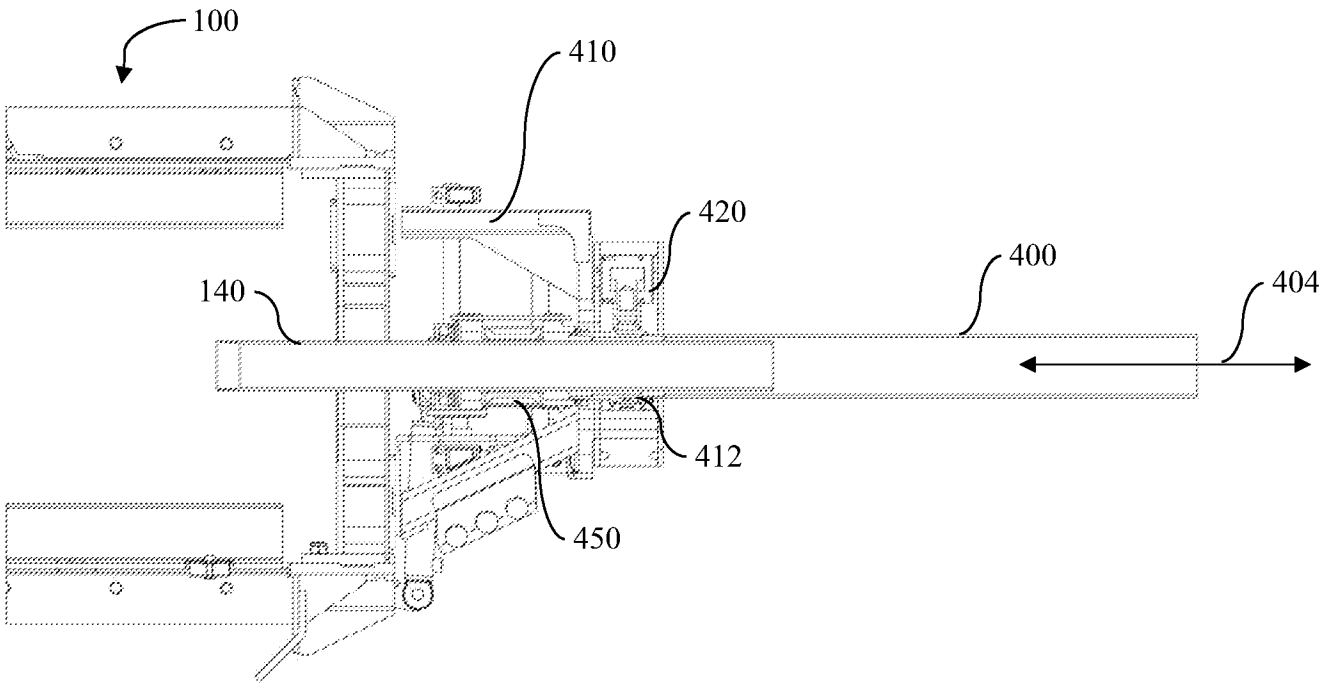
FIG. 29 is a side cross sectional view of the anchoring system of FIG. 27.
Figure 30:
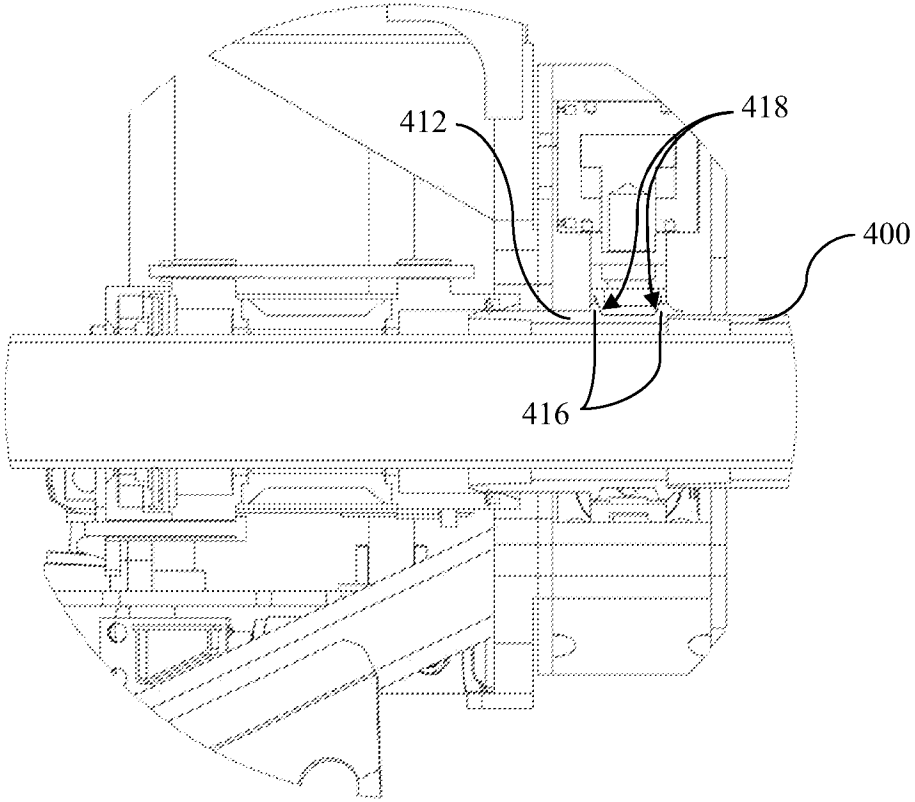
FIG. 30 is a close-up cross sectional view of the anchoring system of FIG. 27.
Figure 31:
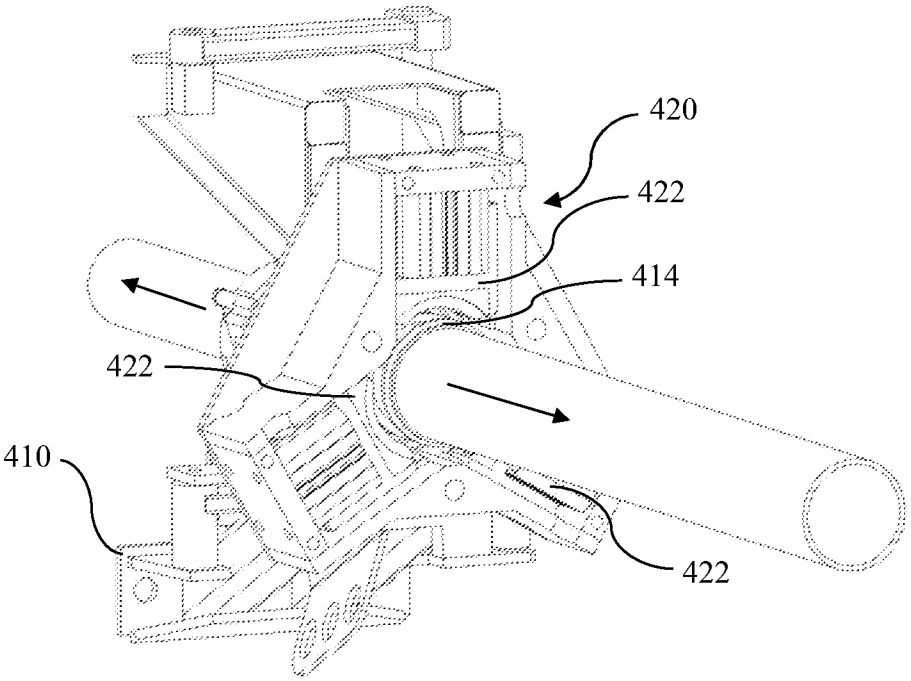
FIG. 31 is a front perspective view of the anchoring system of FIG. 27.
Figure 32:
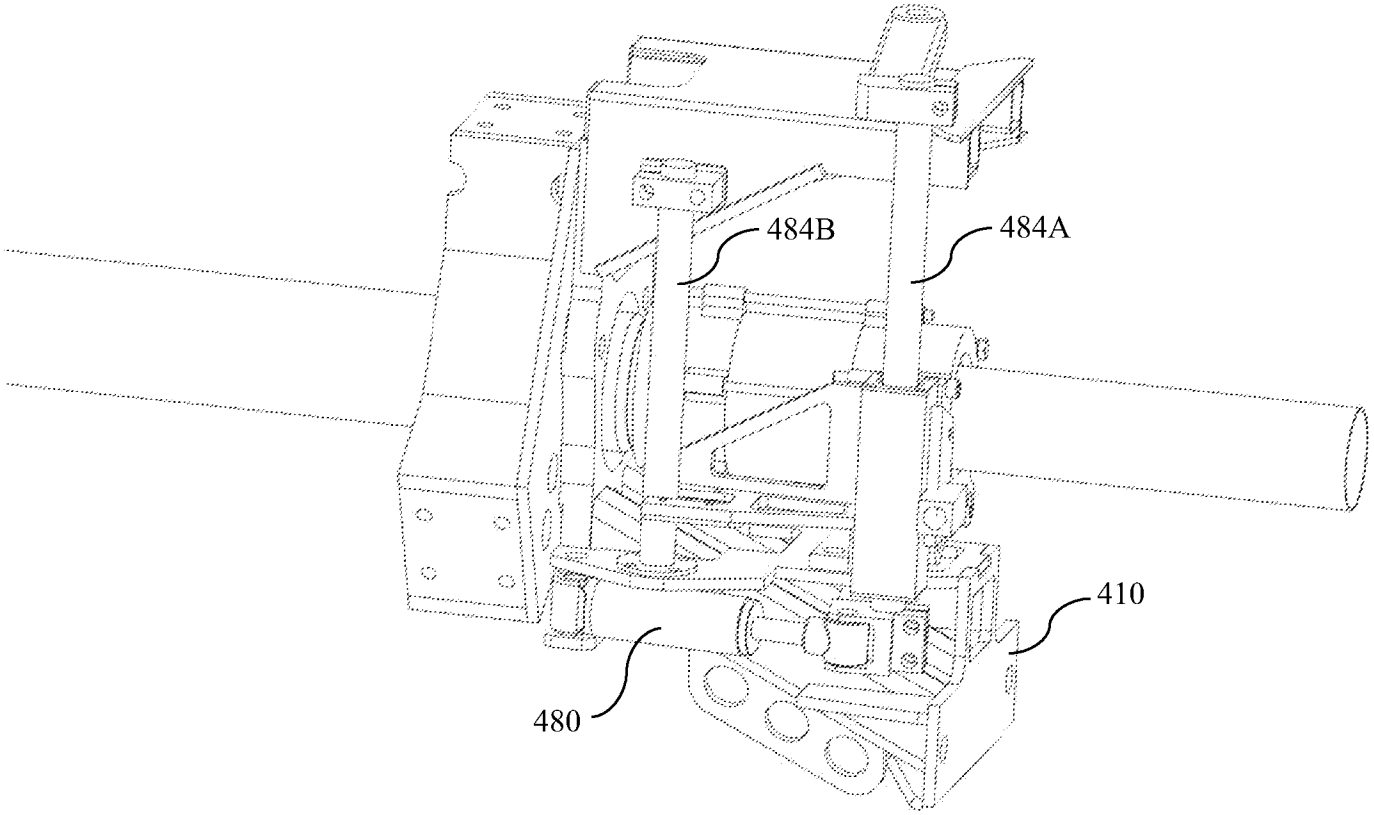
FIG. 32 is a rear, right perspective view of the anchoring system of FIG. 27.
Figure 33:
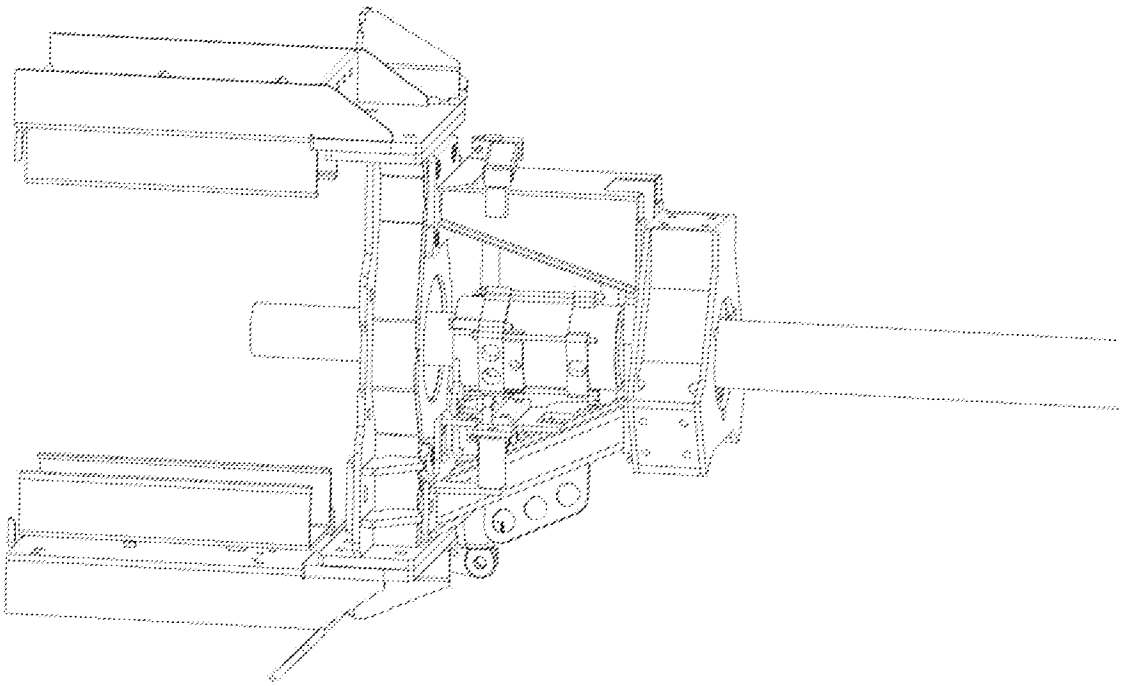
FIG. 33 is a left side perspective view of the anchoring system of FIG. 27.

Referring to FIG. 28, the seal casing gland 450 can optionally have an inner diameter that is less than the outer diameter of the casing pipe 400. Therefore, the seal casing gland 450 can be moved from the drilling axis of the rig prior to and during insertion of the casing pipe 400. For example, the seal casing gland 450 can be pivoted away from the longitudinal drilling axis 180 as the first bore is being drilled and casing pipe is being positioned in the first bore. Once the casing pipe 400 is anchored to the formation, the seal casing gland 450 can be engaged with the anchoring nut. In at least one aspect, the seal casing gland 450 can be pivotable with respect to the clamp to move the seal casing gland 450 from a stowed position that is away from the drilling axis to an engaged positon in which the seal casing gland 450 is engaged with the anchoring nut and aligned with the longitudinal drilling axis. As shown in the illustrated embodiment in FIGS. 27-33, the seal casing gland 450 can pivotably attach to a bracket 478. FIGS. 27 and 29-33 illustrate a first embodiment, and FIG. 28 illustrates a second, alternative embodiment of a seal casing gland movement assembly. The bracket can comprise a first portion 478A that attaches to the casing gland 450 and a second portion 478B that is pivotably coupled to the first portion 278A. The bracket 478 can be slidable along a pair of rails 484A, 484B. The first portion 478A of the bracket 478 can pivotably attach to the rail 484A about an axis 486. Accordingly, the bracket's first portion 478A can be pivotable with respect to the bracket's second portion 478B. A first actuator 488, which, in some embodiments, can be a hydraulic cylinder, can be actuated from a retracted position, in which the seal casing gland 450 is in an intermediate position that is spaced from the anchoring nut 412, to an extended position, in which the seal casing gland 450 is in the engaged position and is engaged with the anchoring nut 412. When the first actuator 488 is in the retracted position so that the seal casing gland is disengaged and spaced from the anchoring nut (to the right in FIG. 28), second actuator 490 (e.g., a hydraulic cylinder) can move from a retracted position to an extended position, thereby sliding the bracket 478 vertically (upward in the Figures) along the rails. In this way, the seal casing gland 450 can be moved to a stowed position that is sufficiently spaced from the drill rig's longitudinal drilling axis 180 so that the seal casing gland 450 does not interfere with drilling and placement of the casing pipe 400.

Once the casing pipe 400 is anchored to the formation 165, the second actuator 490 can retract, thereby sliding the bracket 478 downward so that the seal casing gland 450 is in the intermediate position. The first actuator 488 can then extend to cause the seal casing gland 480 to engage the anchoring nut 412. Moreover, it should be understood that the seal casing gland 450 is pivotably connected to the bracket 478 about an axis 482 (as in the alternative embodiment of FIG. 28) or otherwise loosely connected to the bracket 478 to allow slight pivotal movement (as in the first embodiment) so that while the bracket's first portion 478A continues to pivot as the seal casing gland moves from the intermediate position to the engaged position, the seal casing gland can stay axially aligned with the anchoring nut.

Figure 59:
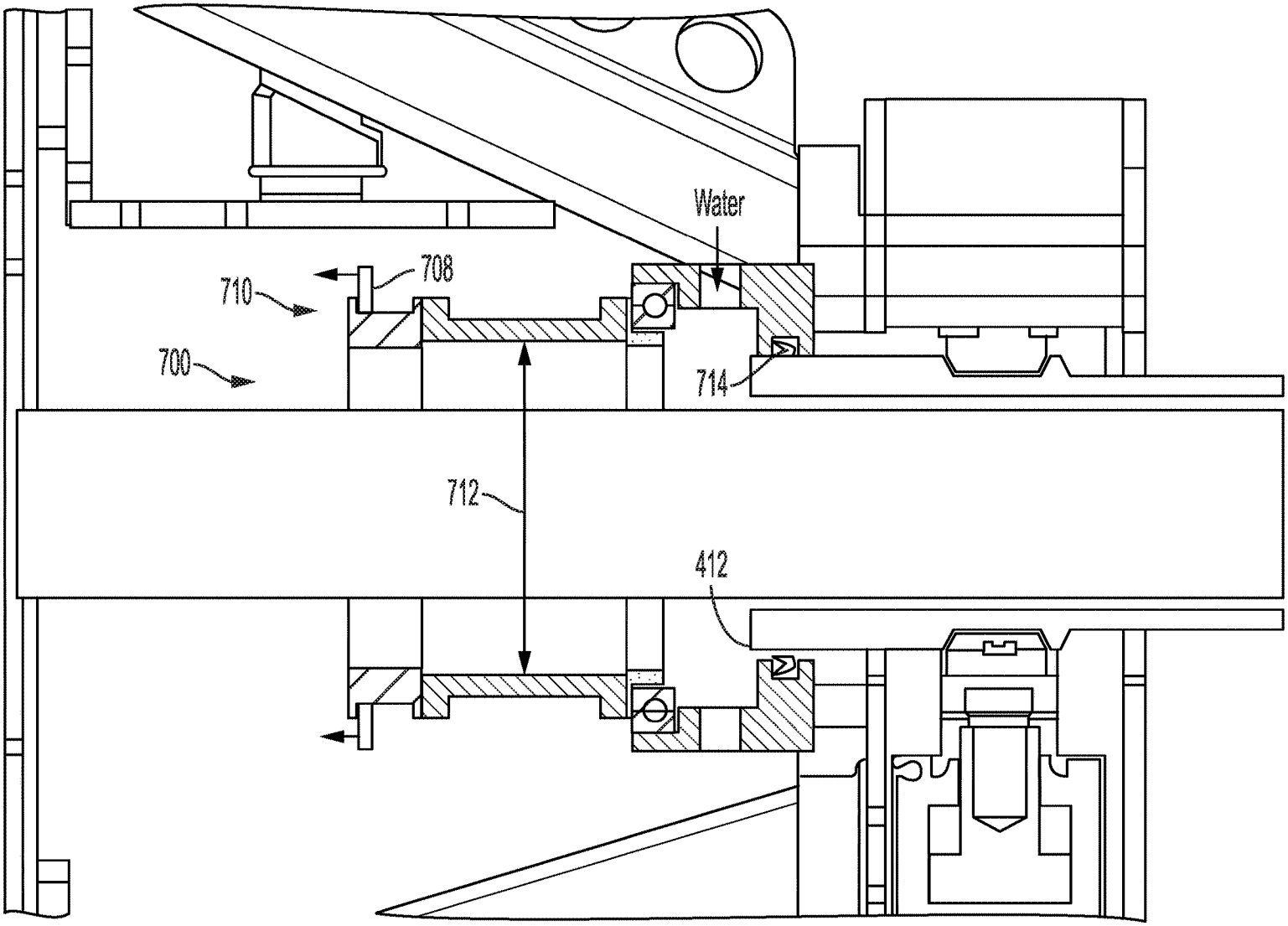
FIG. 59 is a cross section view of the front of the drill rig and a second embodiment of a seal casing gland in a first position.
Figure 60:
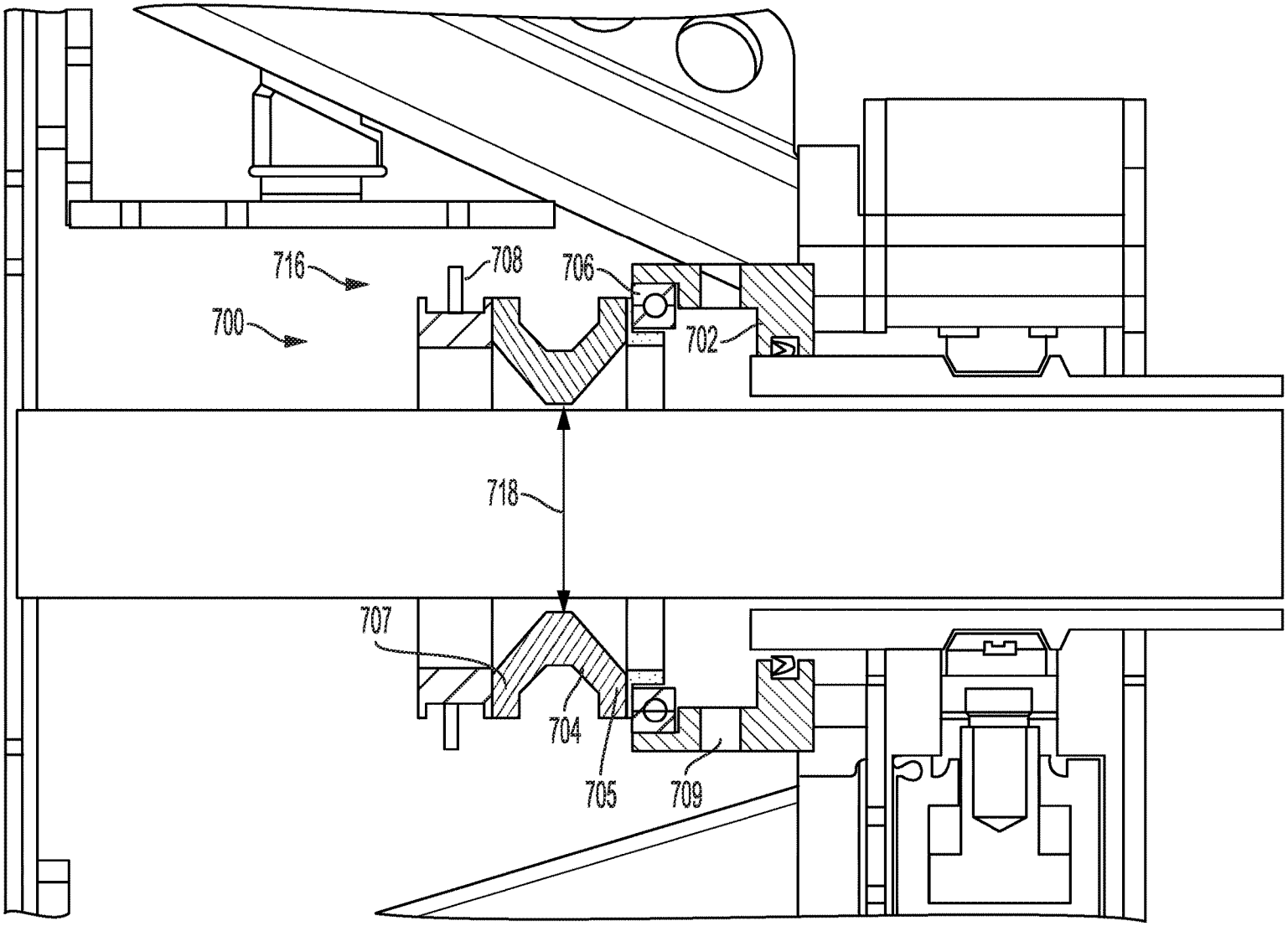
FIG. 60 is a cross section of the front of the drill rig and the seal casing gland of FIG. 59 in a second position.
Figure 61:
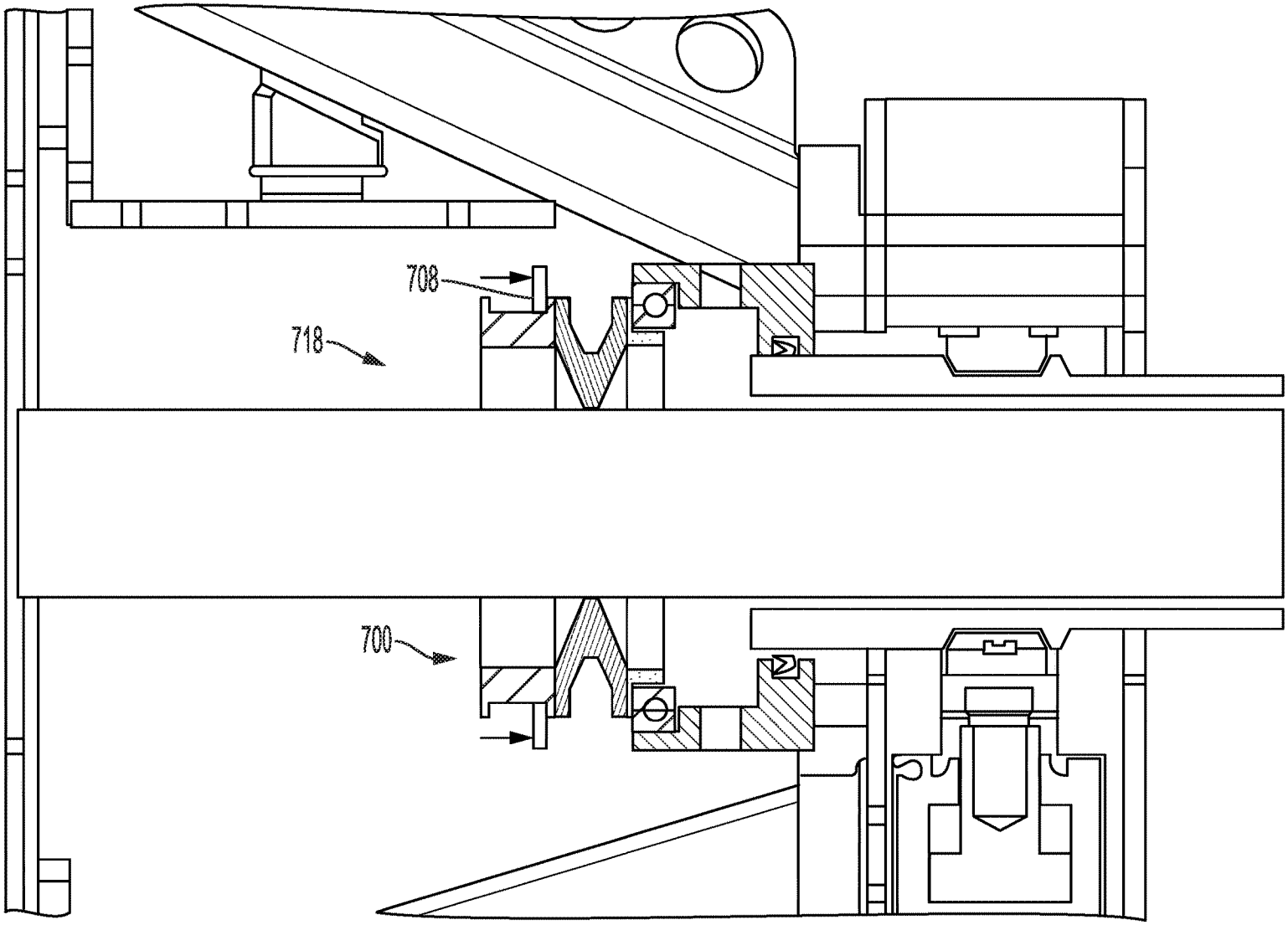
FIG. 61 is a cross section of the front of the drill rig and the seal casing gland of FIG. 59 in a third position.

Referring to FIGS. 59-61, in further aspects, an alternative embodiment of a gland 700 can be configured to have a sufficient diameter for the casing 400 and the anchor nut 412 to pass therethrough. For example, the gland 700 can attach to the frame (e.g., to the bracket 410 in FIG. 29) via a bracket 702. The gland can comprise an annular seal 704 that is rotatably coupled at a first end 705 to the bracket 702 via a thrust bearing 706 so that the annular seal 704 can rotate with the drill string. A second end 707 of the annular seal 704 can be movable relative to the first end 705. For example, the distal end 707 of the annular seal 704 can couple to an actuator 708 (e.g., a clutch fork driven via a hydraulic cylinder (not shown)) along the drilling axis. As further described below, the actuator 708 can be selectively moved relative to the bracket about and between a plurality of positions to permit modification of the position of the first end 705 of the annular seal (and, thus, the operative length and the corresponding operative diameter of the annular seal). The gland can further comprise a port 709 that is forward of (closer to the distal end of the drill string than) the annular seal 704 and can provide fluid communication to the interior of the gland.

Movement of the distal end relative to the proximal end can change an interior diameter through the annular seal 704. For example, when the actuator 708 is in a first position 710 (see, for example, FIG. 59, with the actuator moved away from the bracket to maximize the operative length of the seal), annular seal 704 and the entire gland 700 can define a first inner diameter 712 through which the casing 400 and anchoring nut 412 can pass therethrough. The bracket 702 can house a seal 714 for engaging the anchoring nut 412. When the actuator 708 is in a second position 716 (see, for example, FIG. 60, with the actuator in an intermediate position to provide a smaller operative length of the seal than the maximum operative length), the annular seal 704 can define a second inner diameter 718 that gently engages the drill rod. In this way, fluid can be pumped into the drill rod and the returning slurry can return through the annulus between the drill string and the casing and exit the port 709. When the actuator 708 is in a third position 718 (see, for example, FIG. 61, with the actuator moved toward the bracket to minimize the operative length of the seal and maximize sealing engagement), the annular seal 704 can apply a sufficient pressure against the drill string to cause fluid pumped into port 709 to travel distally down the annulus between the casing and the drill string in order to pump a reverse-circulation overshot (e.g., a HYDROSHOT reverse-circulation overshot) proximally within the drill string (and, eventually, out of the drill string).

In some optional aspects, when the actuator 708 is in the first position 710, the actuator can bias against a distal lip of the gland; when the actuator is in the third position 718, the actuator can bias against a proximal lip of the gland; and when the actuator is in the second position 716, the actuator can bias against neither the proximal nor distal lip. In these aspects, it is contemplated that the annular seal 704 can naturally (without compression or tension) bias against the drill string.

Figure 62:
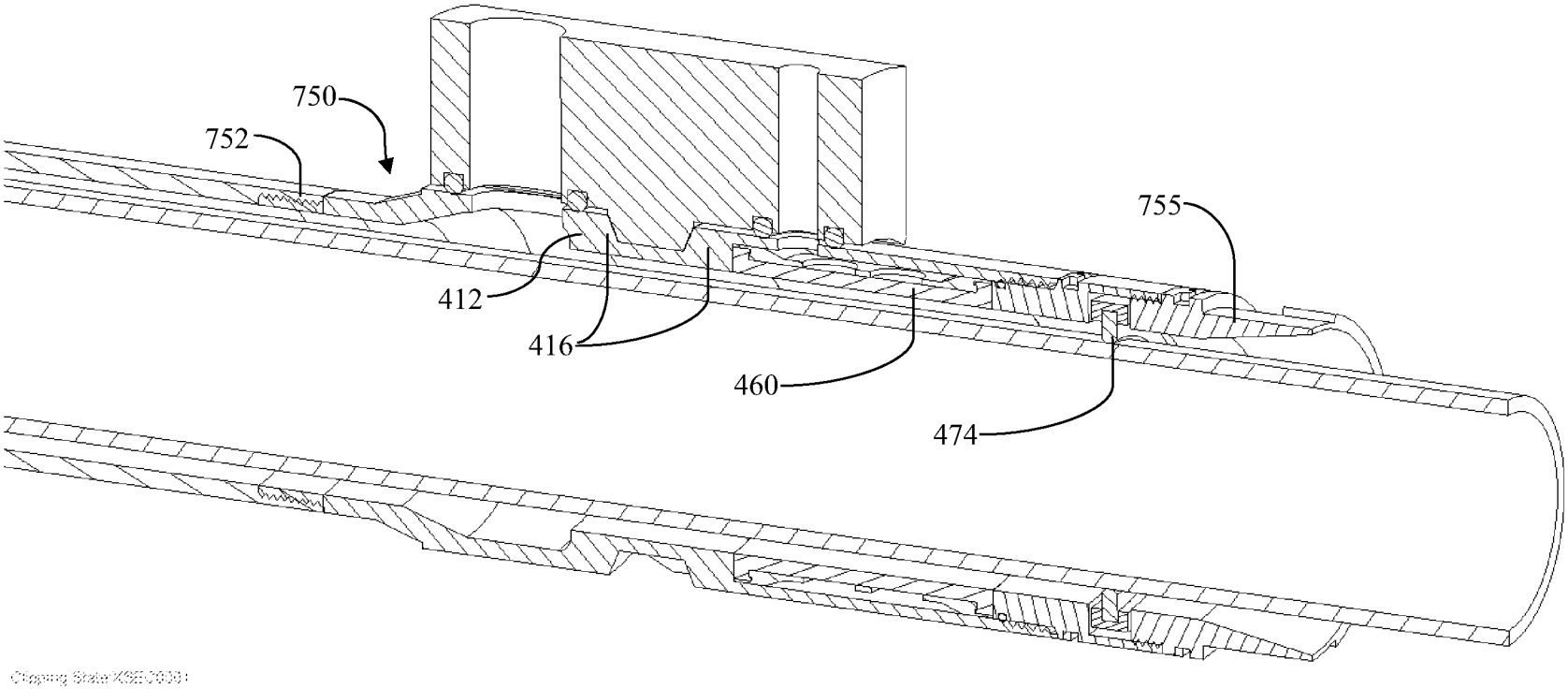
FIG. 62 is a sectional view of a third embodiment of a seal casing gland.
Figure 63:
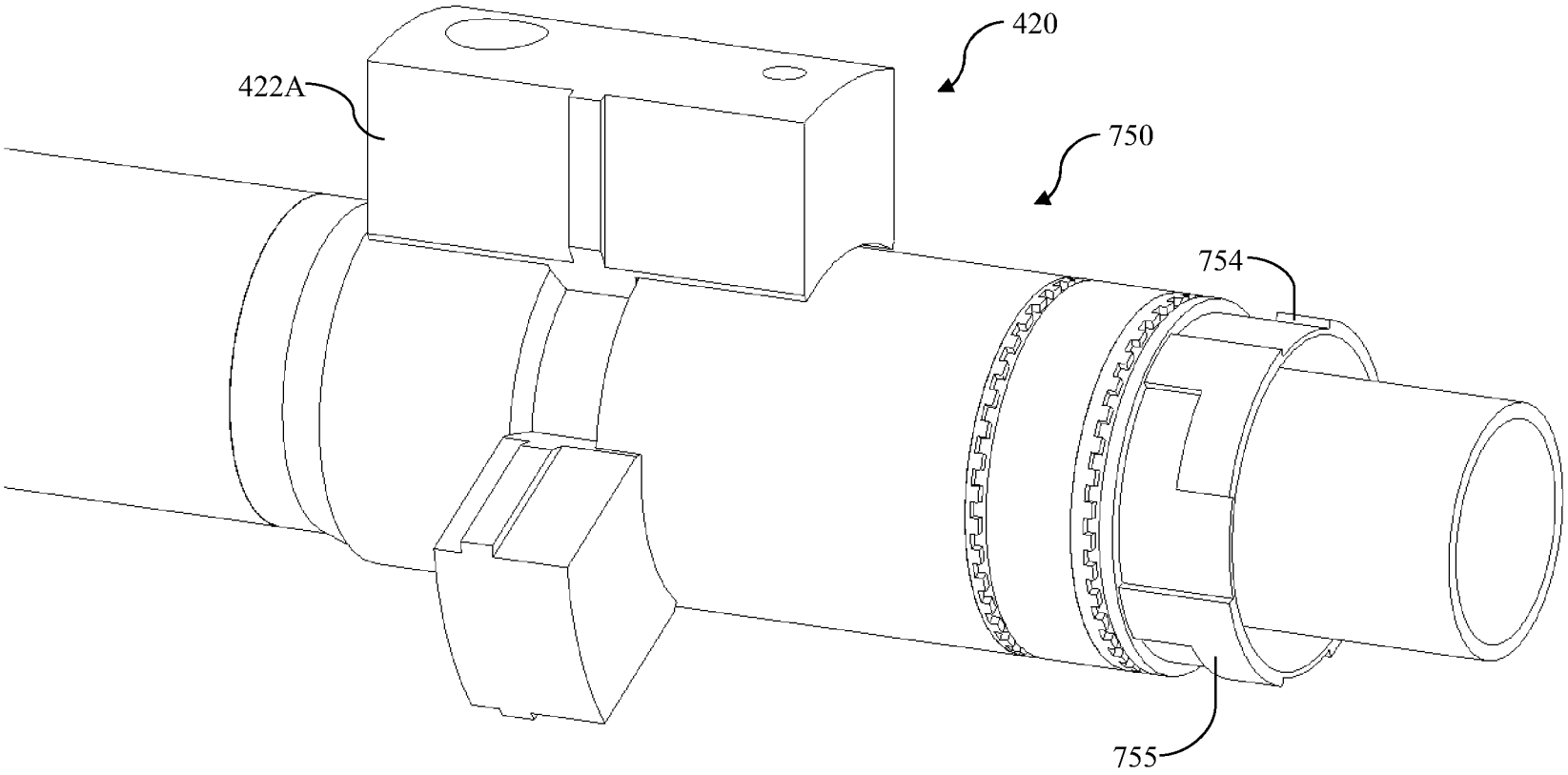
FIG. 63 is a perspective view of the third embodiment of the seal casing gland as in FIG. 62.
Figure 64:
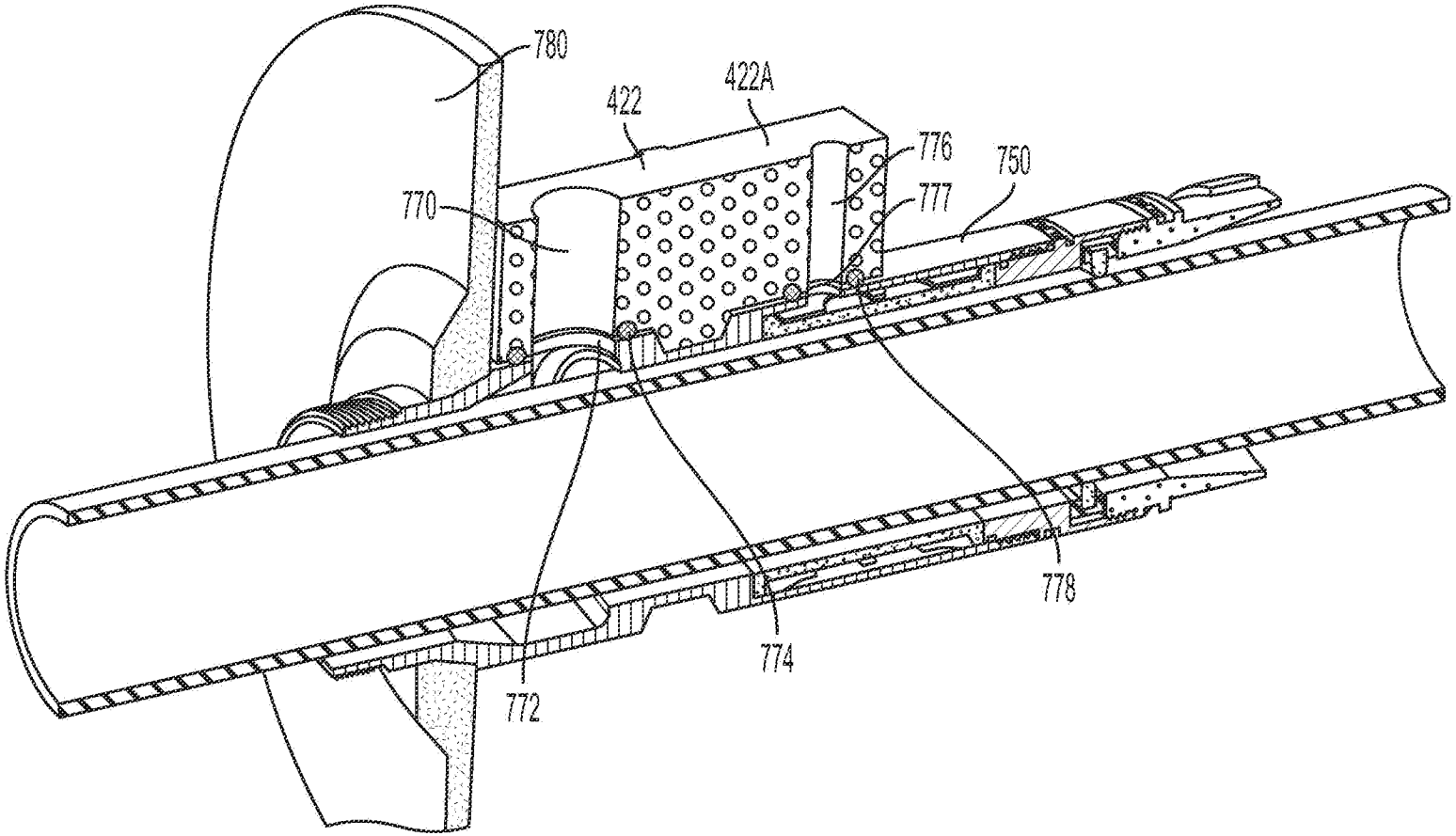
FIG. 64 is a sectional view of the third embodiment of the seal casing gland coupled to jaws of the clamp.
Figure 66:
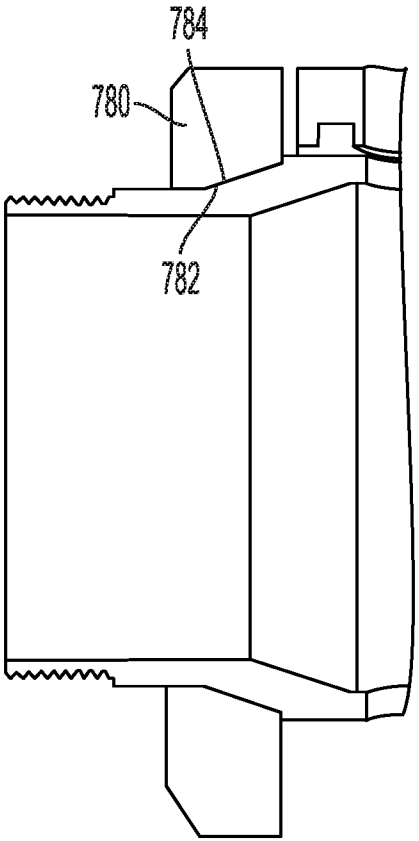
FIG. 66 is a side cross sectional view of the third embodiment of the seal casing gland and an axial alignment plate.
Figure 65:
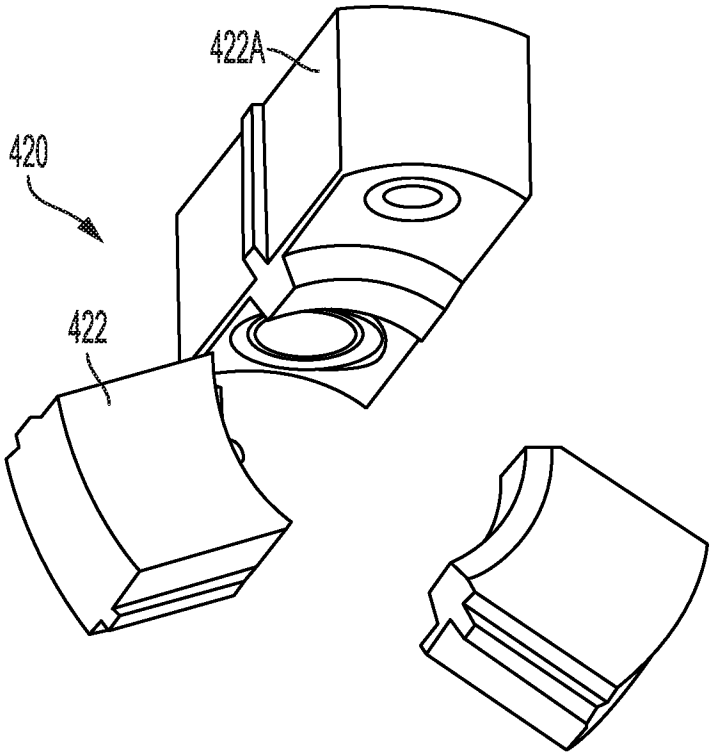
FIG. 65 is a perspective view of the jaws with bores for fluid communication therethrough.
Figure 68:
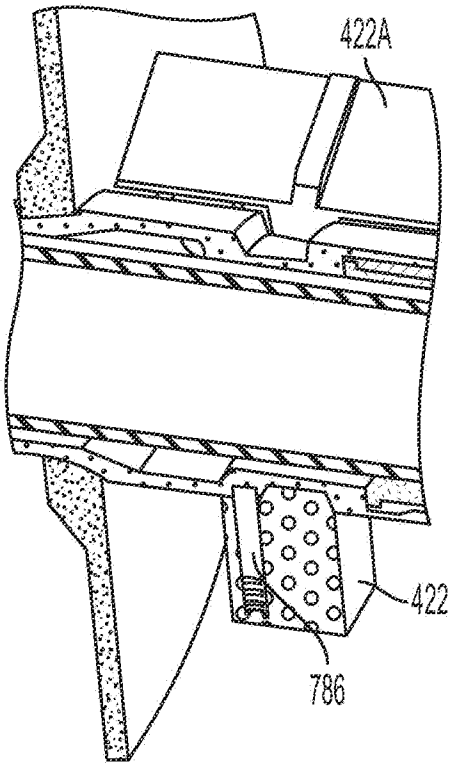
FIG. 68 is a side sectional view of the third embodiment of the seal casing gland coupled to jaws of the clamp.
Figure 67:
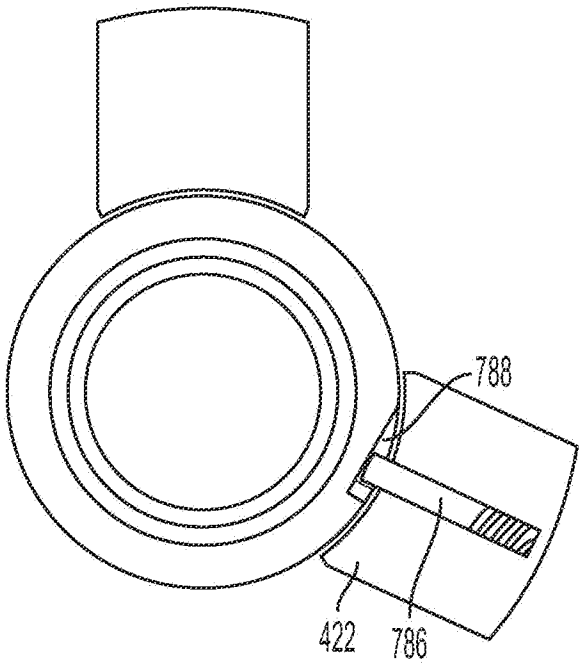
FIG. 67 is a front sectional view of the third embodiment of the seal casing gland coupled to jaws of the clamp.
Figure 69:
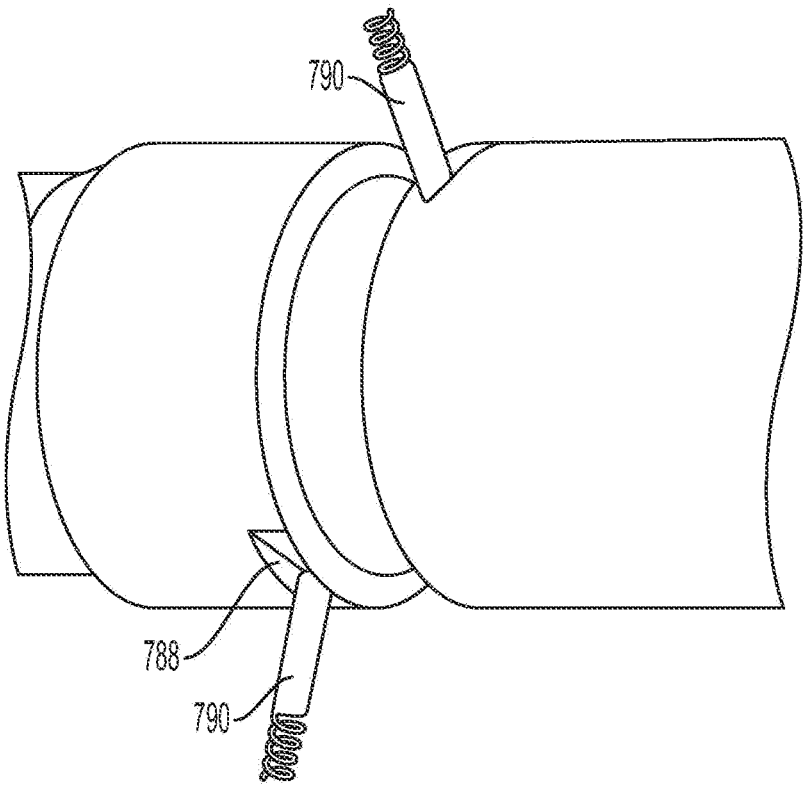
FIG. 69 is a side perspective view of the third embodiment of the seal casing gland and rotational alignment pins.

Referring also to FIGS. 62-63, in another alternative embodiment, the anchoring nut 412 can be integrally formed with, or otherwise coupled to, a gland 750. Thus, the gland 750 can define the pair of spaced annular ribs 416 that extend radially from the gland 750. The gland 750 can couple to the proximal casing (e.g., via a threaded coupling 752). This can contrast with the gland 450 that is coupled to the rig 100 and shifts and pivots in and out of engagement with the casing. In some aspects, the gland 750 can be coupled to a proximal-most casing pipe prior to coupling the proximal-most casing pipe to casing pipe string. Alternatively, in further aspects, the gland 750 can be coupled to the proximal-most casing pipe after it has been coupled to the string of casing pipes. The gland 750 can comprise an annular bladder 460 that can be inflated to bias against the drill string as disclosed herein with reference to the gland 450. The gland 750 can further comprise one or more seals 474 that are rotatably attached to the gland 750 for engaging and rotating with the drill string.

The gland 750 can define a male bayonet coupling 754. In further aspects, the gland 750 can couple to a collar fitting 755 that defines the male bayonet coupling 754). The male bayonet coupling 754 can couple to the female bayonet coupling 756 of the extension rod (FIG. 57). Optionally, the female bayonet coupling can be on a bayonet head 760 that is axially movable with respect to a main body 762 of the extension rod 405. Optionally, the bayonet head 760 can be biased in a first longitudinal direction with a first spring 762 and a second, opposite longitudinal direction 764 via a second spring 764 in order to assist with axial alignment and prevent damage to engaging components during coupling and decoupling.

Fluid Connection

As further described herein, fluid can be provided to pump a reverse-circulation overshot proximally in a drill string. Further, when providing drilling fluid during drilling, it can be desirable to direct the drilling fluid that is returning through the annulus between the drill string and the bore to an outlet (e.g., an outlet in the gland) so that the returning drilling fluid and formation pieces can be. According to a first alternative embodiment, and with reference to FIGS. 63-69, at least one of the jaws 422 of the clamp 420 (e.g., jaw 422A) can define a first fluid port 770, and a corresponding first fluid port 772 of the gland 750 can be angularly and axially aligned with the first fluid port 770 to define fluid communication between the first fluid port 770 of the jaw 422 and the first fluid port 772 of the gland 750. The fluid port 770 can provide an outlet for lubricant fluid during drilling and an inlet for fluid for pumping out a reverse-circulation drilling assembly. A first ring seal 774 (e.g., an O-ring) can seal the fluid communication between the jaw 422 and the gland 750. A second fluid port 776 of the jaw 422 can align with a second fluid port 777 in the gland 750 for providing fluid communication to inflate and deflate the annular seal for respective engagement and disengagement from the drill string. A second ring seal 778 can seal the fluid communication between the second fluid port 776 in the jaw 422 422 and the second fluid port 777 in the gland 750.

In order to axially align the fluid ports of the jaw 422 and the fluid ports of the gland 750, a front ring plate 780 can define a front stop that inhibits further axial movement in the distal direction. For example, the front ring plate 780 can define a taper 782 that mates with a front-end taper 784 of the gland 750.

In order to rotationally align the fluid ports of the jaw 422 with the fluid ports of the gland, at least one of the jaws 422 can comprise one or more spring pins 786 that are spring-biased radially outward. The spring pins 786 can be received within respective grooves 788 that define stops 790 at select angular positions so that engagement between the spring pins 786 engage the stops 790 corresponds to angular alignment between the fluid ports of the jaw 422 and the fluid ports of the gland 450. The grooves 788 can have a decreasing depth in an angular direction so that rotation of the gland 750 in said angular direction can enable the spring pins 786 to be released from the grooves 788.

Figure 70:
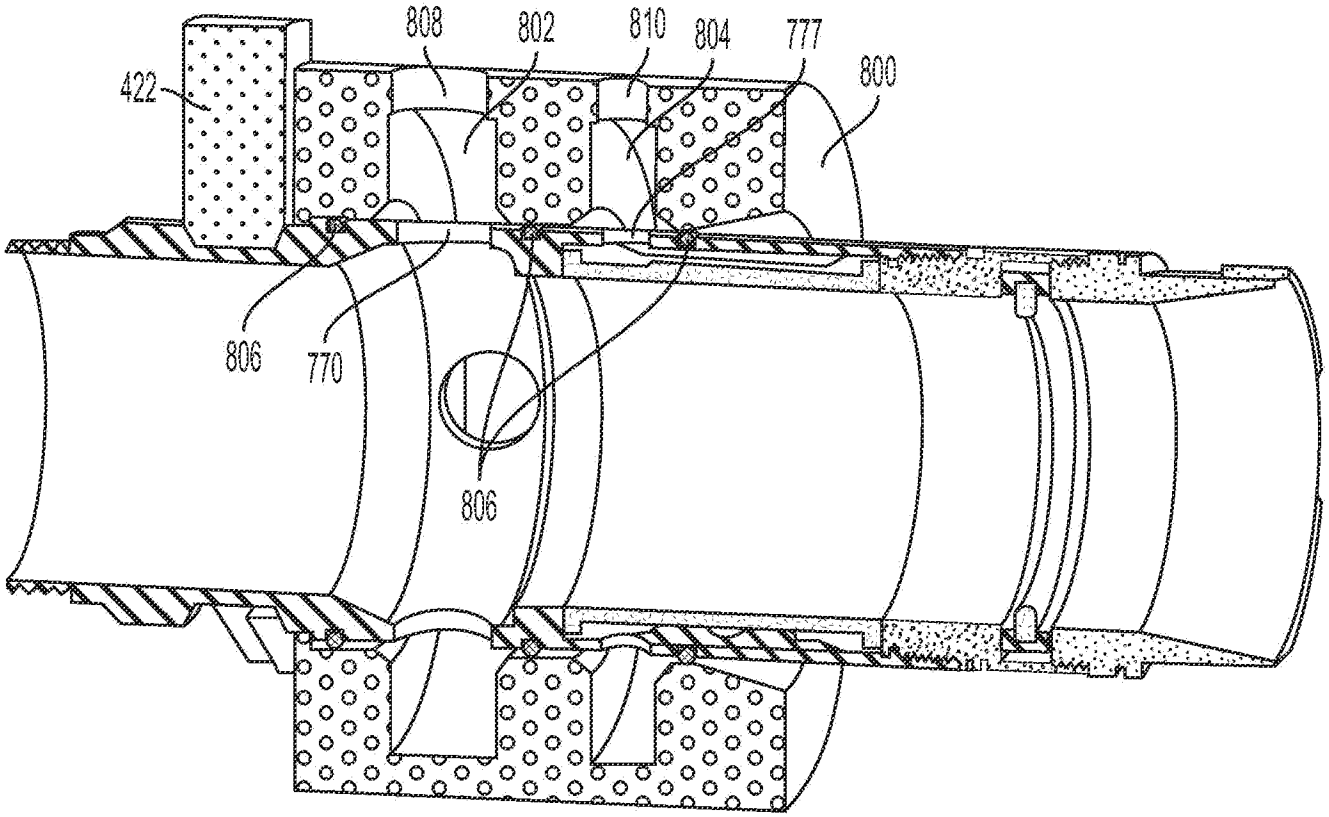
FIG. 70 is a sectional side view of an alternative embodiment for supplying fluid to the third embodiment of the seal casing gland.
Figure 71:
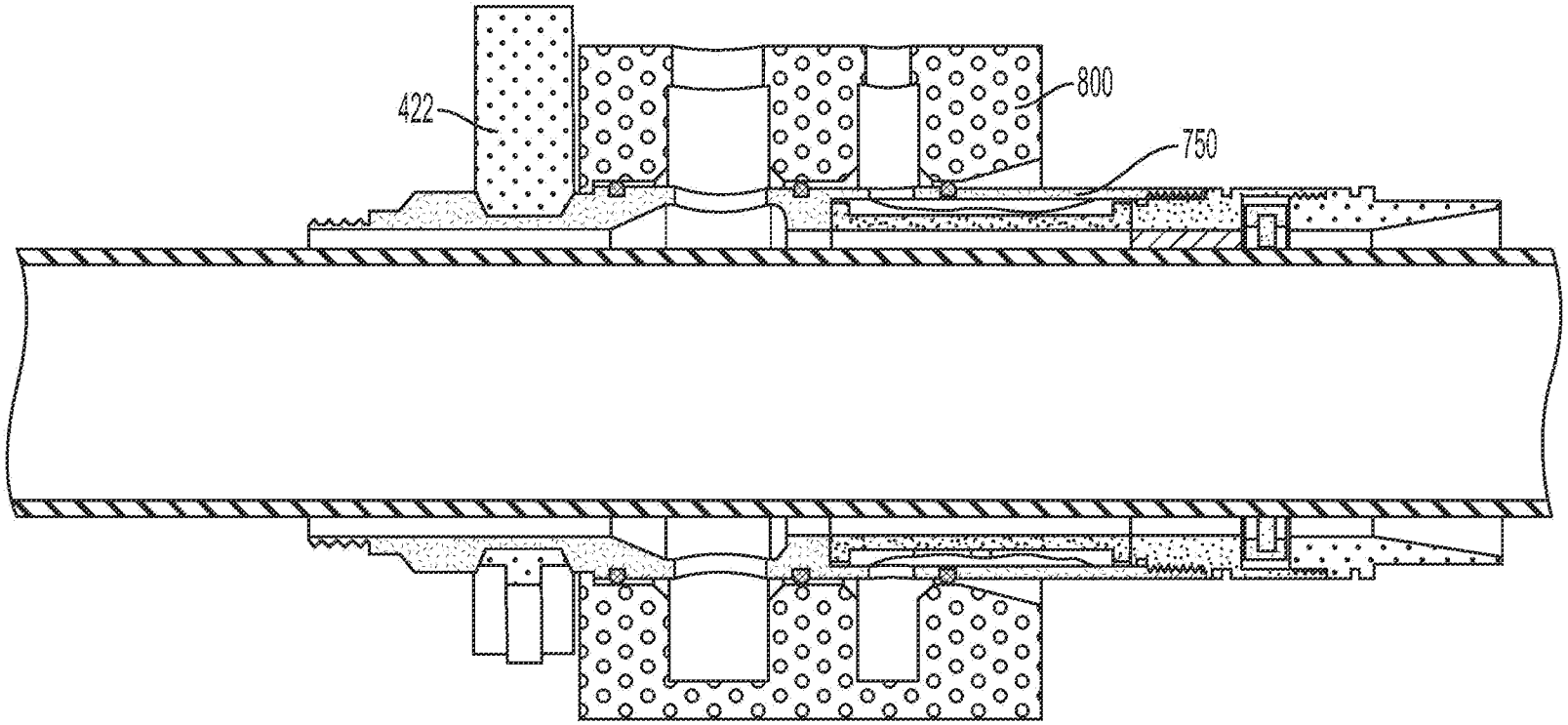
FIG. 71 is another sectional side view of the alternative embodiment for supplying fluid to the third embodiment of the seal casing gland as in FIG. 70.
Figure 72:
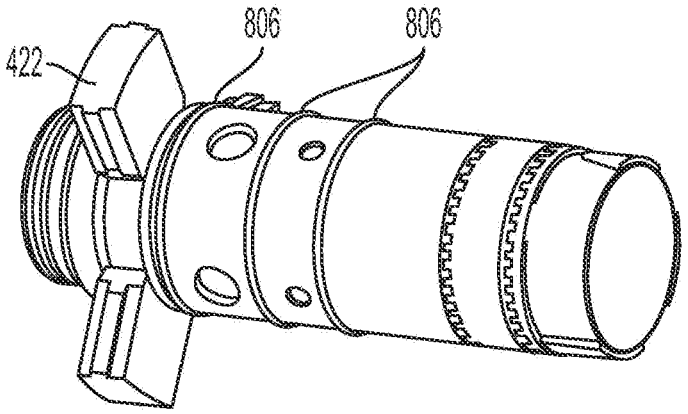
FIG. 72 is the third embodiment of the seal casing gland configured for communication with the alternative embodiment for supplying fluid of FIG. 70.

Referring to FIGS. 70-72, according to a second alternative embodiment, a port hub 800 can provide fluid communication to the first fluid port 770 and second fluid port 777 in the gland 750. The port hub 800 can define a first annulus 802 for axial alignment with the first fluid port 770 and a second annulus 804 that axially aligns with the second fluid port 777. In this way, the fluid coupling can be independent of angular orientation. The gland 750 can comprise three seals 806 for sealing against the port hub 800 (e.g., with a first seal and a second seal positioned on opposite sides of the first annulus 802, and the second seal and a third seal positioned on opposite sides of the second annulus 804). A first inlet/outlet 808 can provide fluid communication into the first annulus 802, and a second inlet/outlet 810 can provide fluid communication to the second annulus 804.

Applications of the Drilling System

The drilling system 200 can be configured to perform some or all drilling aspects without physical interaction between the drilling system 200 and a human operator (i.e., in a hands-free manner). That is, an operator need not touch the mechanical components of the drilling system 200 as the first (anchoring) bore is being drilled, as the drill rig is being anchored to the foundation 165, during subsequent drilling, or during core retrieval. It should be understood that an operator may still remotely control aspects of the drilling process. In various embodiments, control of the drilling system can be partially or wholly controlled by a computing device, as further disclosed herein.

With reference to the Figures, in one embodiment, a first method can include fitting a core barrel with the drill bit 500 that is sized to create the first bore (i.e. of a sufficient diameter to receive the casing pipe 400). The drilling system 200 can use the drill bit 500 to drill the first bore. The drilling system 200 can then remove the drill bit 500 and core barrel from the first bore (e.g., using the drill string component removal methods as described herein). The casing pipe and anchoring nut can be loaded onto the drill rig 100, and, according to some aspects, gripped by the rod holder 172. For example, the rod handler 210 can position the casing pipe so that the first head assembly 110 can grip the casing pipe, and the first head assembly 110 can then position the casing pipe in the rod holder 172. A drive rod can be loaded onto the drill rig 100 and screwed into the thread(s) of the anchoring nut. For example, as described herein, the second head can be screwed into the back of the drive rod. The second head can then thread the drive rod into the casing pipe 400 while the rod holder 172 grips the casing pipe. As another example, the first head assembly 110 can thread the drive rod into the casing pipe 400 as the rod holder 172 holds the casing pipe. The first head assembly 110 can grip the drive rod and insert the casing pipe into the first bore. In some embodiments, the first method can include a step of waiting for the binder 402 on the casing pipe 400 to cure. The drive rod can then be unscrewed (or otherwise decoupled, for example, by decoupling the bayonet coupling) from the casing pipe 400 via the first head assembly 110 and removed from the drill rig 100. The clamp 420 can anchor to the anchoring nut 412.

According to some aspects, the entirety of the first method can be performed without physical interaction of a human operator. Moreover, the first method can further comprise the steps of: before using the drill bit 500 to drill the first bore, moving the seal casing gland 450 to the stowed position; and after anchoring the clamp 420 to the anchoring nut 412, moving the seal casing gland 450 to the engaged position.

In a second method, the drilling system 200 can be used to add drill rods (or other drill string components) to the drill string 150. In the second method, the second head assembly can be retracted toward the rear portion of the drill rig 100 and away from the drill string 150 to permit receipt of the first drill string component. The drill rig 100 can then receive the first drill string component from the rod handler 210. The drill rig 100 can move the second head assembly 300 forward until the male thread(s) of the spindle 304 engage the female thread(s) of the first drill string component 140. In some embodiments, the second head may continue to move past the point of engagement between the male thread(s) of the spindle 304 and the female thread(s) of the first drill string component to compress spring 306 by a distance so that as the first drill string component 140 and spindle 304 are threadedly coupled, the spindle 304 can float to take up the axial movement of threading. Optionally, the second method can be performed in conjunction with the first method (such as, for example, after completion of the first method).

In some embodiments, a range detector or load sensor can be used to detect engagement between respective components, such as the drill rod 140 and the drill string 150. In further embodiments, to determine positions between respective components, the drill rig 100 can use one or more of the following: a displacement of the spindle float relative to the second head; the movement of the second head assembly with respect to the feedframe; a hydraulic pressure driving the motor 320, and the amount of rotation of the spindle 304 and/or first head 110. As the drill rod 140 is threadedly coupled to the drill string 150, the computing device can determine the number of turns made and the axial distance moved to determine if the threading is completed. If the number of rotations and/or axial distance moved is sufficient, when the hydraulic pressure rises beyond a threshold, the computing device can determine that the threaded coupling is tight and correctly threaded. If the hydraulic pressure rises before the expected number of turns and/or before the distance moved is sufficient, the computing device can determine that the threaded coupling is jammed. If the hydraulic pressure does not rise when expected, the computing device can determine that the respective threads are not engaged.

In one embodiment, after the spindle engages the drill rod 140 and the spindle is displaced to float a sufficient amount, the motor can rotate the spindle backwards (in a decoupling direction) until the spindle moves forward one thread pitch, thereby indicating a rotational position at which the respective threads are rotationally aligned. The computing device can store this rotational position as a starting position when determining the number of rotations for threading respective components. The motor 320 can then rotate the spindle 304 to threadedly couple the spindle to the first drill string component 140.

The second head assembly 300 can then move forward via the feedframe until the male thread(s) of the drill string component engage the female thread(s) of the drill string. Similarly, the second head can move past mere contact and compress the spring 306 as the spindle 304 floats to enable travel as the drill string and drill string component are threadedly engaged. Similarly to when coupling the spindle to the drill rod 140, the motor can rotate the spindle backwards (in a decoupling direction) until the spindle moves forward one thread pitch, thereby indicating a position at which the respective threads are rotationally aligned. The motor 320 can then rotate the spindle 304 forwards, thereby rotating the drill string component to thread the drill string component's male thread(s) in to the drill string's female thread(s). According to some aspects, the hydraulic clutch can then decouple the motor 320 from the spindle 304. The first head assembly can then rotate the drill string comprising the first drill string component at a drilling speed. The spindle 304 can stay connected and thus be used to provide drilling fluid from the water swivel to the interior bore of the drill string 150. According to further aspects, the second head assembly 300 can be used to push the drill string into the bore.

According to a third method, the drilling system 200 can be used to the remove a drill string component from a drill string. The feedframe 105 can move the second head assembly 300 toward the front portion of the drill rig until the male thread(s) of the spindle engages the female thread(s) of the drill string. The motor 320 can rotate the spindle to threadedly couple the spindle to a first drill rod of the drill string that is at a proximal end of the drill string. The second head assembly can move toward the rear portion of the drill rig to draw the drill string rearward until a second drill string component that is distal of the first drill string component is received with in the rod holder. The rod holder can grip the second drill string component, and the first head assembly can then rotate the first drill string component to unscrew the first drill string component from the rest of the drill string. The rod handler can then grab the first drill string component and hold it stationary while the motor 320 rotates the spindle to decouple the spindle from the first drill string component. The rod handler can then remove the first drill string component from the drill rig. Optionally, the third method can be used in conjunction with the first and/or second methods (such as, for example, after completion of the first and/or second methods).

According to a fourth method, the drilling system 200 can be used to retrieve a core tube assembly using wireline. The rod holder can grip the proximal drill string component of the drill string. The motor 320 can rotate the spindle 304 to decouple the spindle from the drill string.

The actuator 330 can move a portion of the second head assembly 300 to align the overshot loading assembly 340 with the longitudinal drilling axis 180 of the drill rig 100. A water pump can then pump the overshot 346 from the overshot loading chamber until it engages the core tube assembly 188. Once the overshot 346 engages (i.e., attaches to) the core tube assembly 188, the wireline winch 190 can retract the core tube assembly 188 until the overshot 346 is received in the overshot loading assembly. The feedframe 105 can then move the second head assembly 300 toward the rear portion 184 of the drill rig 100 until the core tube assembly 188 is removed entirely from the drill string 150. The rod handler 210 can then grip the core tube assembly 188. The overshot releaser 370 can then decouple the overshot 346 from the core tube assembly 188. The rod handler 210 can then remove the core tube assembly 188 from the drill rig 100. Optionally, the fourth method can be used in conjunction with one or more of the first, second, and third methods (such as, for example and without limitation, after completion of the first and/or second methods).

According to a fifth method, the drilling system 200 can use the rod handler 210 to insert an empty core tube assembly 188 into the drill string 150. In some embodiments, the rod handler 210 can insert the empty core tube about one meter deep into the drill string 150. The feedframe 105 can move the second head assembly toward the front portion 182 of the drill rig 100 until the overshot engages the empty core tube assembly. The rod handler 210 can then disengage from the empty core tube assembly 188. The feedframe 105 can move the second head assembly 300 toward the front portion of the drill rig to further insert the empty core tube assembly 188 into the drill string 150. The overshot releaser 370 can then disengage the overshot from the empty core tube assembly 188. The feedframe 105 can then move the second head assembly 300 toward the rear portion of the drill rig until the second head portion has sufficient room to shift. The actuator 330 can the shift the second head assembly 300 so that the spindle 304 is aligned with the longitudinal drilling axis 180 of the drill rig 100. The motor 320 can rotate the spindle so that the spindle 304 threadedly engages the end of the drill string 150. The clutch can disengage the motor 320 from the spindle. A pump can pump the empty core tube assembly 188 to the distal end of the drill string. The first head assembly 110 can then grip the drill string 150 to commence drilling. Optionally, the fifth method can be used in conjunction with one or more of the first, second, third, and fourth methods (such as, for example and without limitation, after completion of the first, second, third, or fourth method).

When drilling, the second head assembly 300 can be configured to float freely (i.e., slide axially along the feedframe) with the drill string as the first head 110 drives the drill string along the longitudinal drilling axis. For example, a hydraulic valve can be energized to allow hydraulic fluid to flow in and out of the hydraulic cylinders of the feedframe that move the second head.

According to a sixth method, the drill rig can use both the first head assembly 110 and the second head assembly 300 to pull on the drill string, for example to dislodge a stuck drill string 150. The first head assembly 110 can engage the drill string. The motor 320 can rotate the spindle to threadedly couple the spindle 304 of the second head assembly 300 to the drill string 150. With both the first head assembly 110 and the second head assembly 300 engaged with the drill string, the feedframe 105 can simultaneously drive the first head assembly 110 and the second head assembly 300 toward the rear portion 184 of the drill rig 100. Optionally, the sixth method can be used in conjunction with one or more of the first, second, third, fourth, and fifth methods (such as, for example and without limitation, after completion of the first, second, third, fourth, or fifth method).

According to a seventh method, the drill rig can insert an empty core tube assembly in an alternative way. The second head assembly 300 can be sufficiently retracted. The rod handler can position the core tube assembly in line with the longitudinal drilling axis. The first head assembly can be moved so that the centralizer 111 can engage the second head assembly, and the centralizer can grip a front end of the core tube assembly. The second head assembly can be moved forward until the overshot engages a socket at the rear of the core tube assembly. The rod handler can then disengage from the core tube assembly. The second head assembly can move forward to insert the core tube assembly into the drill string. Optionally, the seventh method can be used in conjunction with one or more of the first, second, third, fourth, and sixth methods (such as, for example and without limitation, after completion of the first, second, third, fourth, or sixth method).

Figure 40:
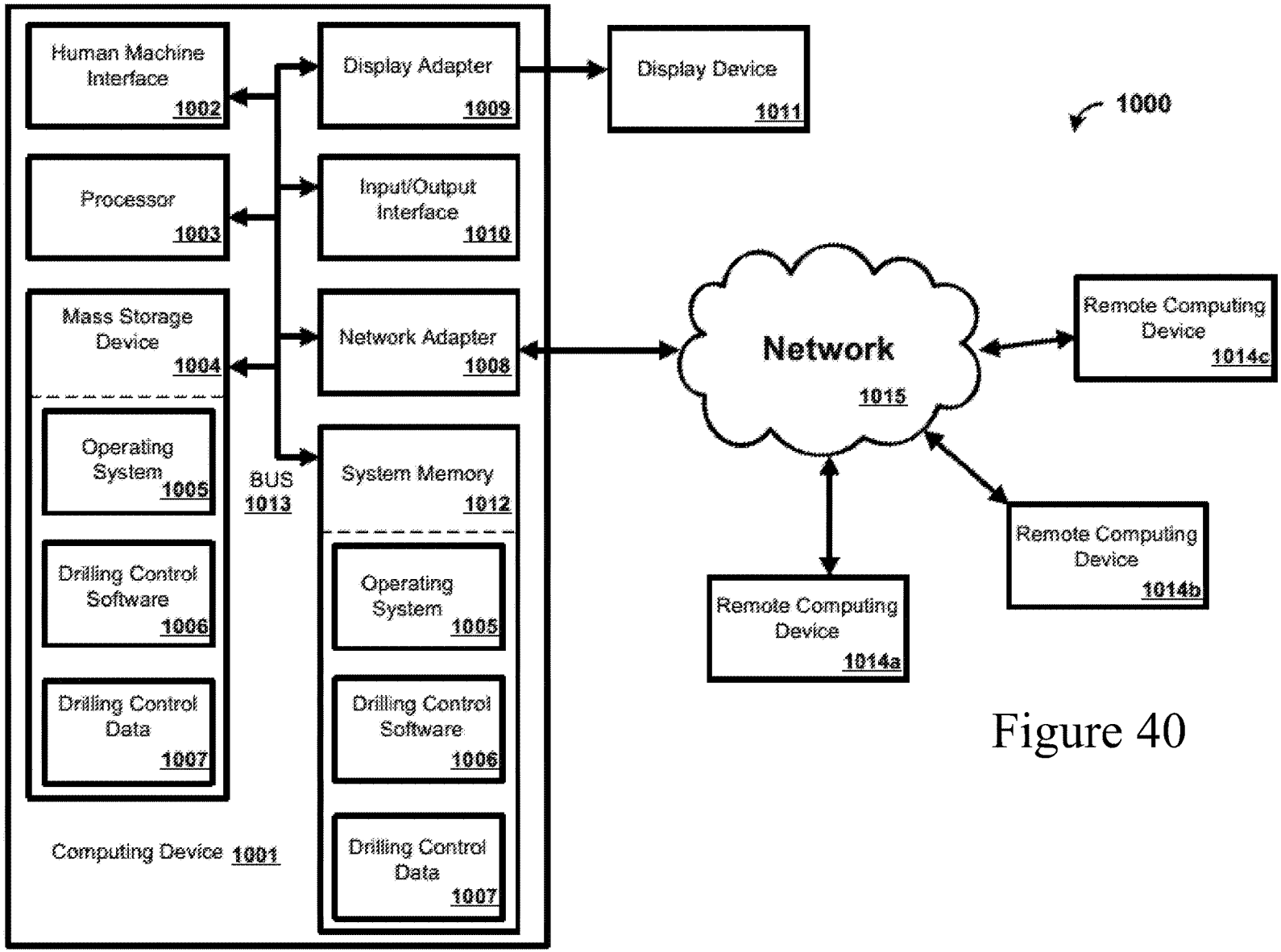
FIG. 40 is an exemplary computing system for controlling aspects of the drill rig as in FIG. 1.
Figure 41:
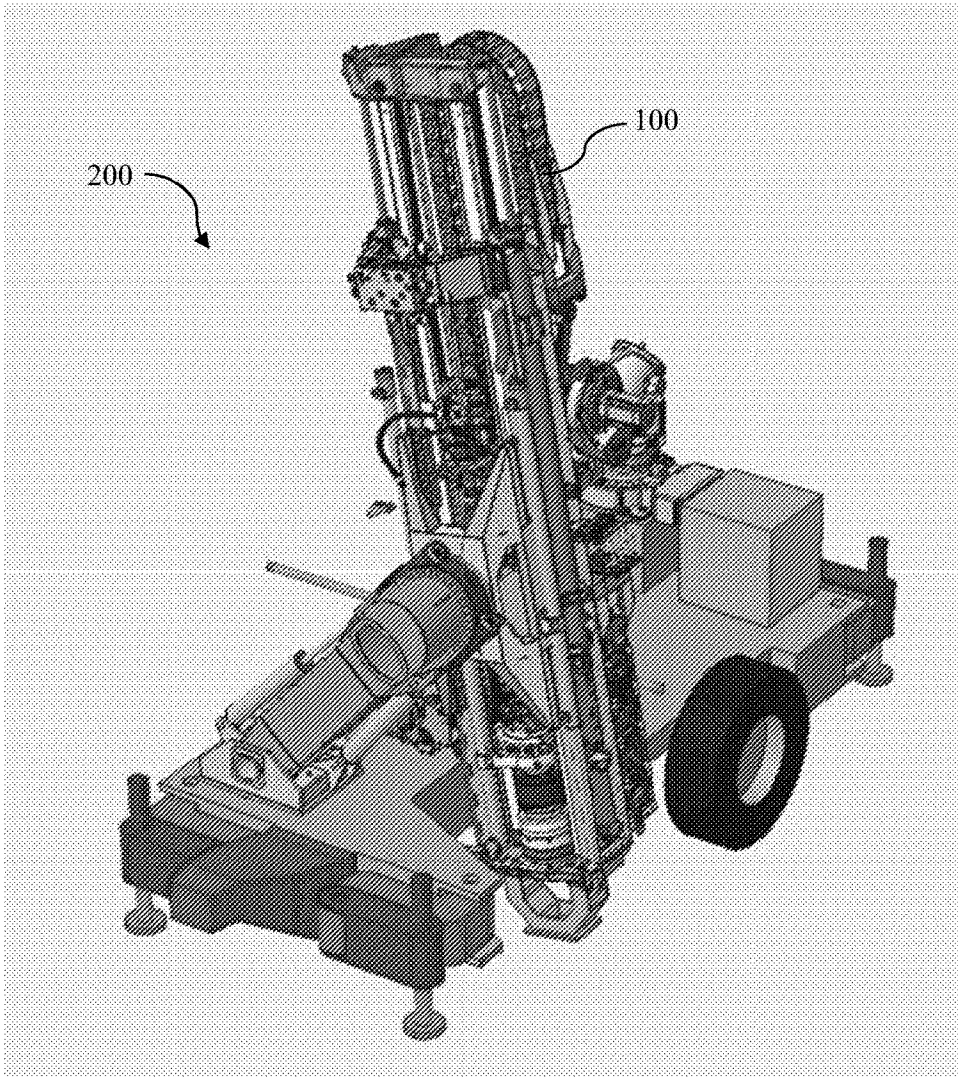
FIG. 41 is a perspective view of the drilling system of FIG. 2 with the drill rig in a first downward-facing position.
Figure 42:
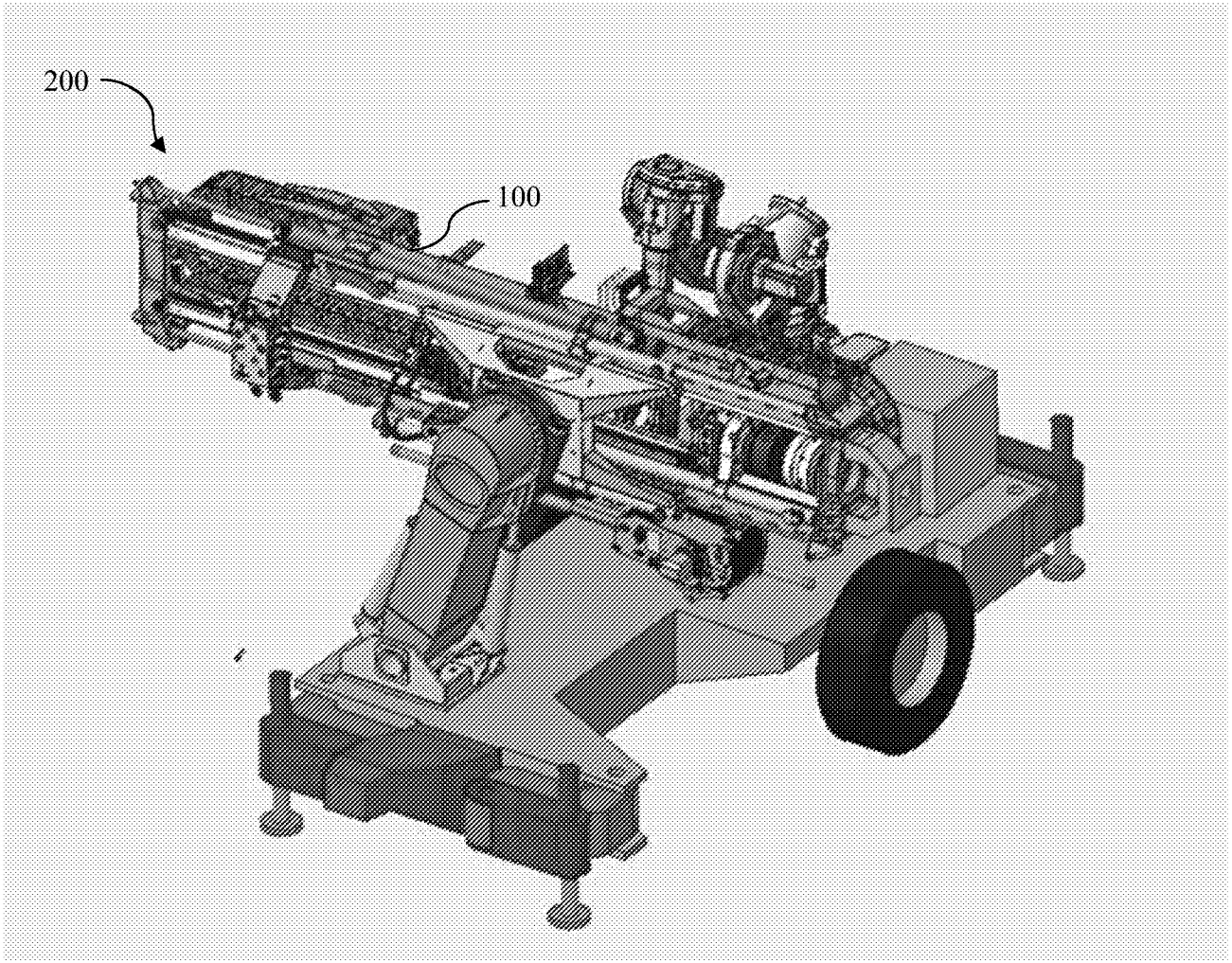
FIG. 42 is a perspective view of the drilling system of FIG. 2 with the drill rig in a generally horizontal position.
Figure 43:
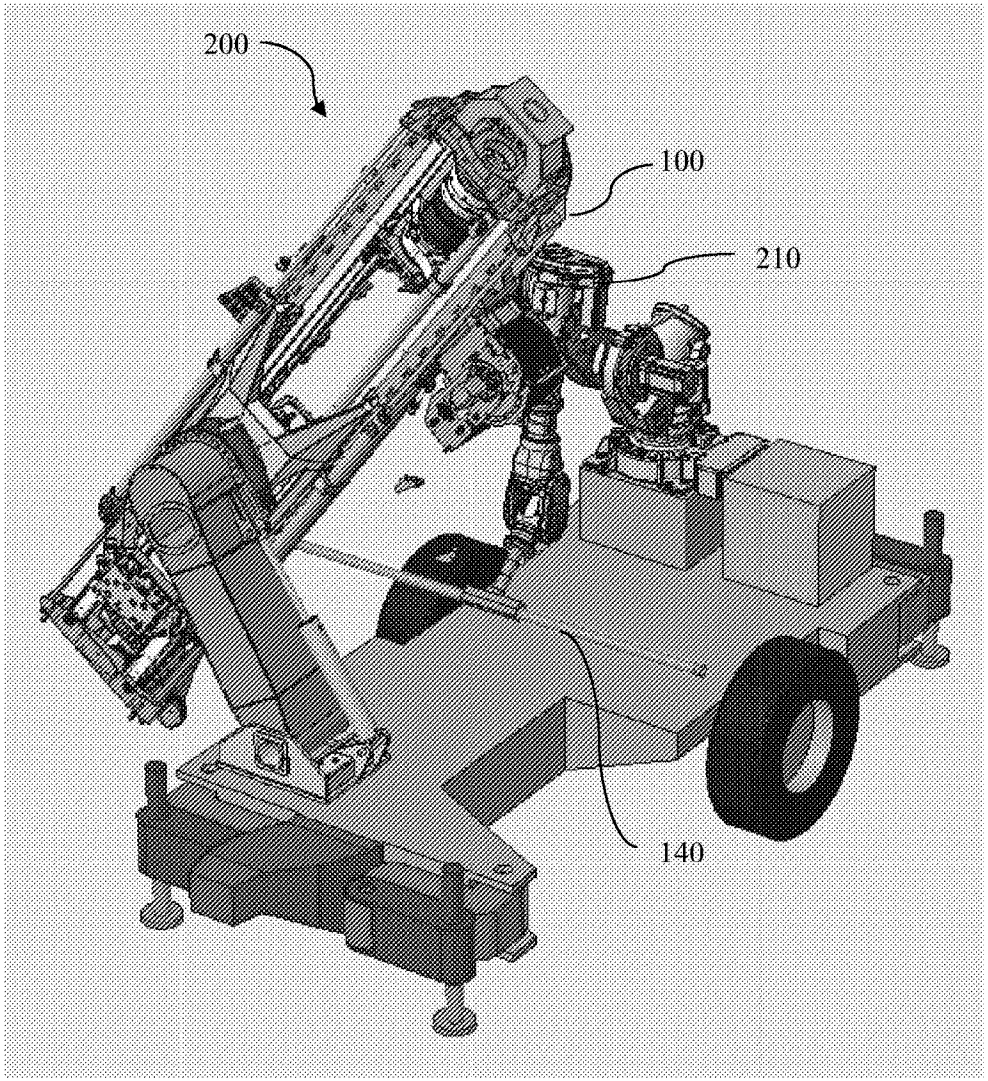
FIG. 43 is a perspective view of the drilling system of FIG. 2 with the drill rig in a first diagonally upward position.
Figure 44:
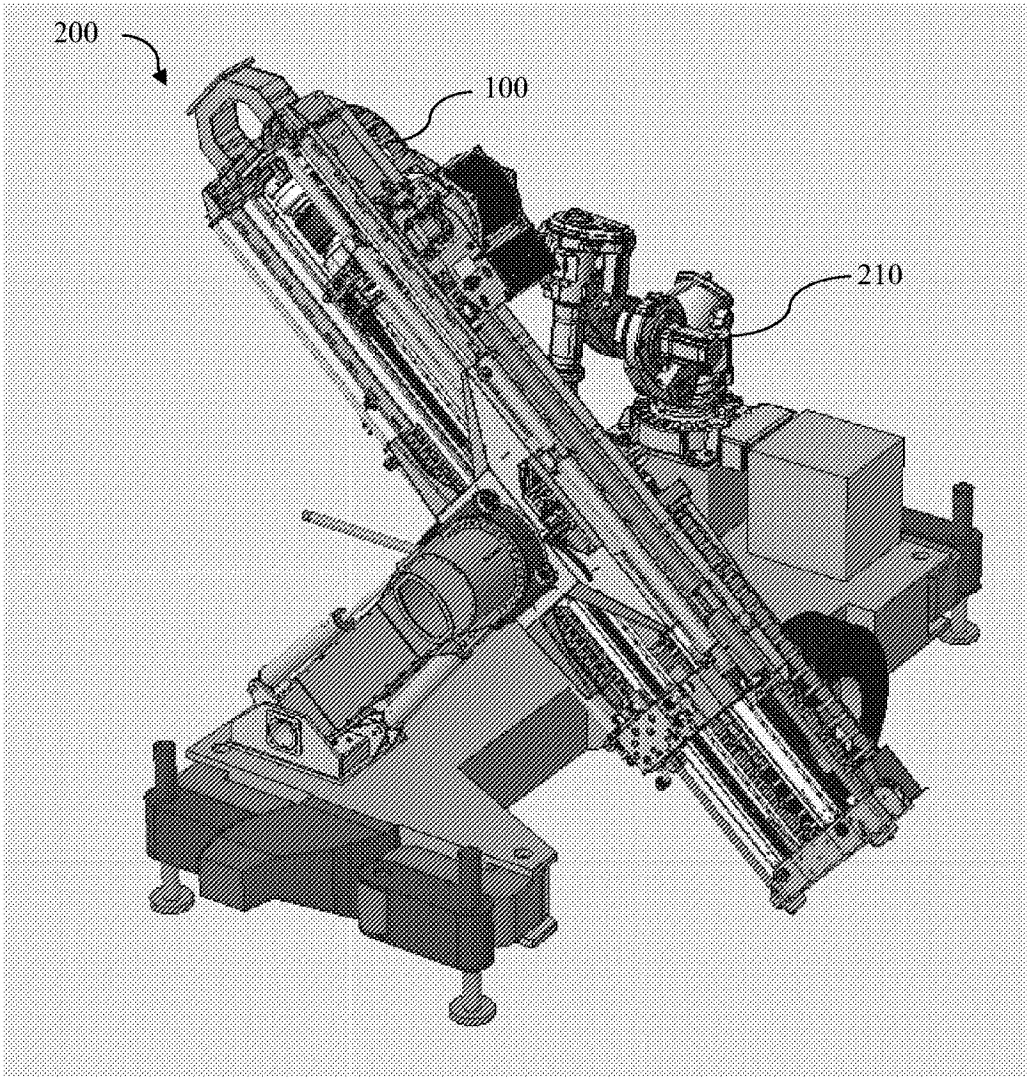
FIG. 44 is a perspective view of the drilling system of FIG. 2 with the drill rig in a second diagonally upward position.
Figure 45:
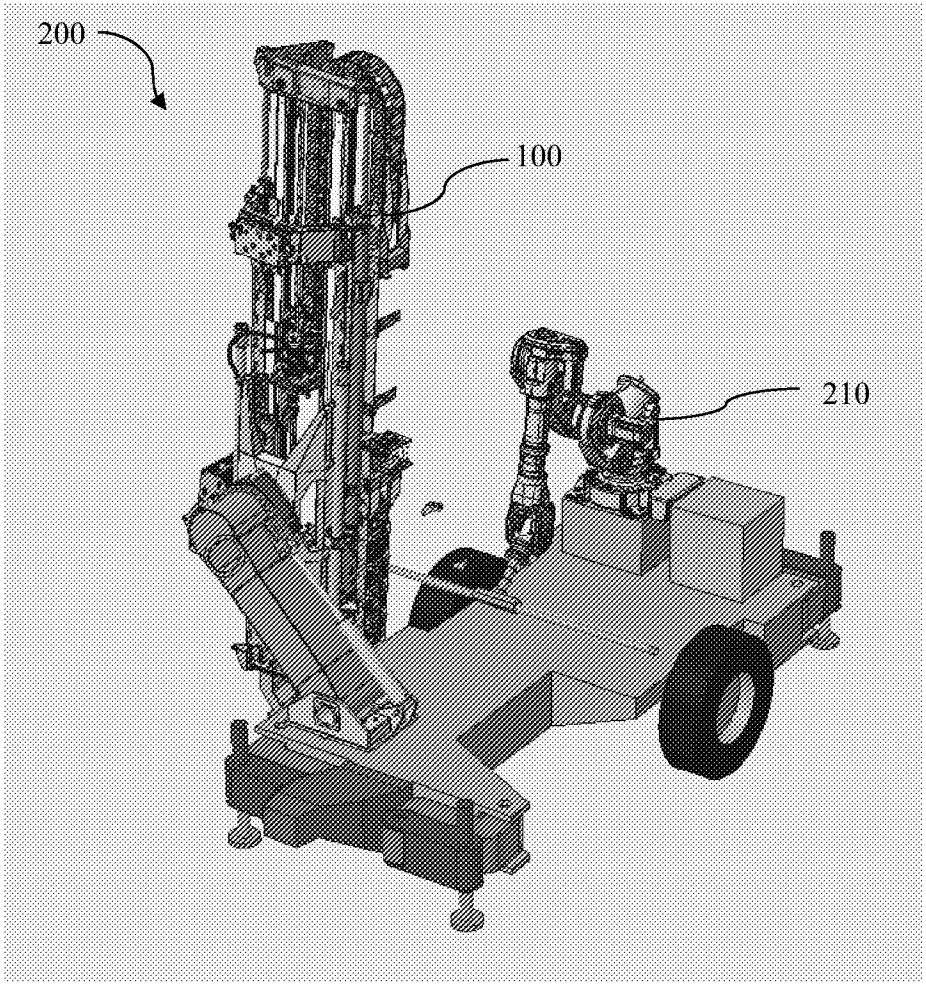
FIG. 45 is a perspective view of the drilling system of FIG. 2 with the drill rig in a second downward-facing position.
Figure 46:
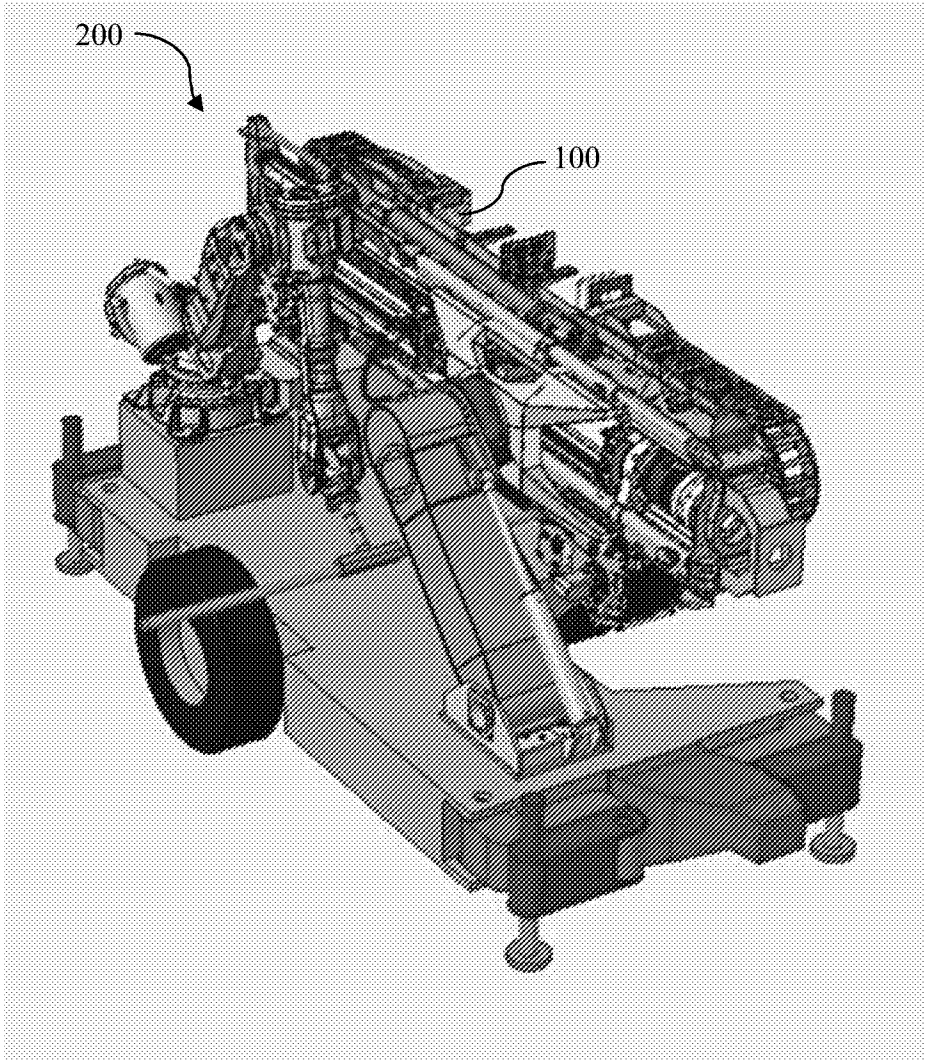
FIG. 46 is a front perspective view of the drilling system of FIG. 2 with the drill rig in a compact configuration for transportation.
Figure 47:
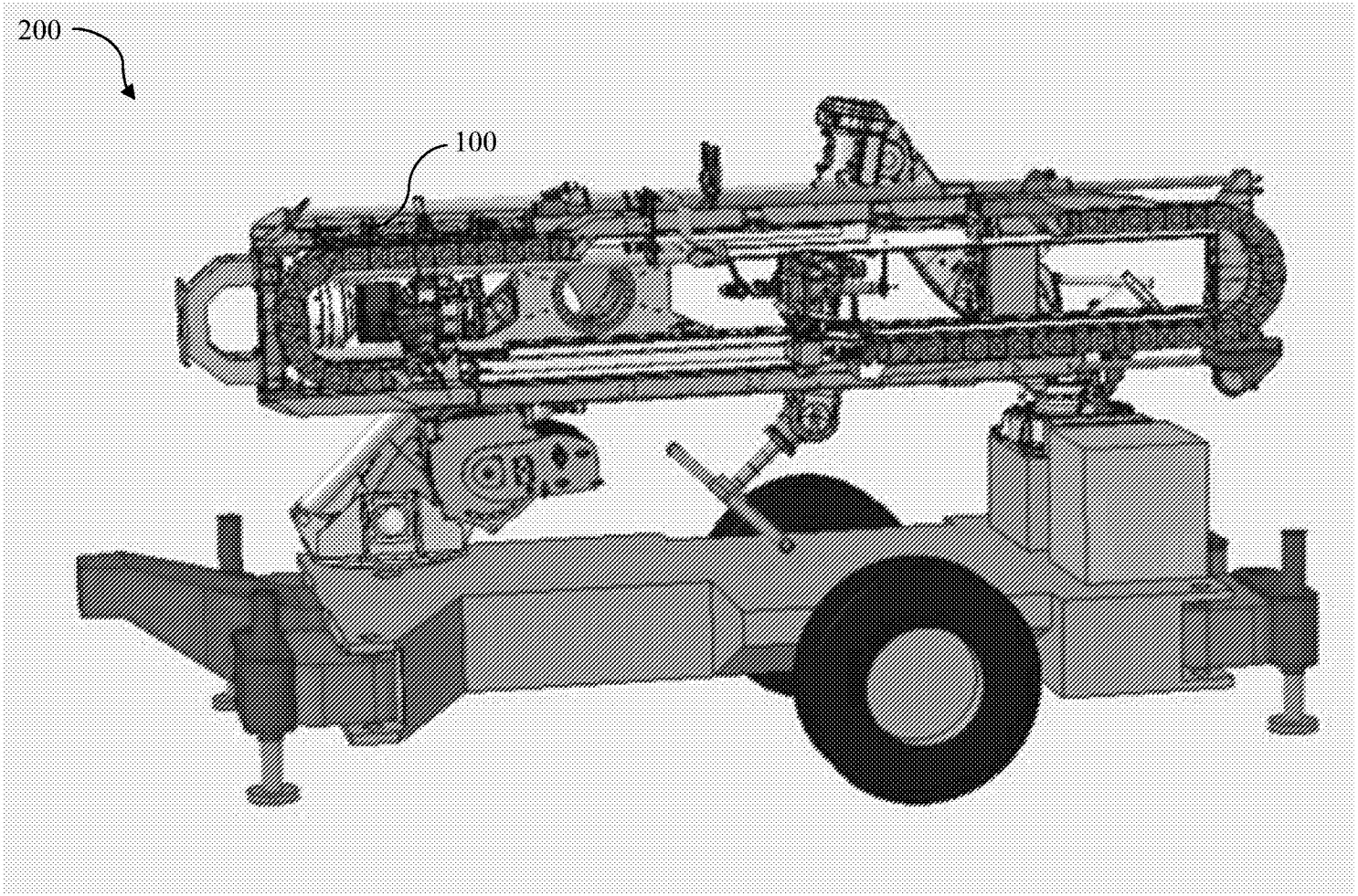
FIG. 47 is a side perspective view of the drilling system of FIG. 2 with the drill rig in the compact configuration for transportation.

FIG. 40 shows an exemplary computing system 1000 that can be configured to control operation of various aspects of the drilling system 200, including coordinating movement of the first head assembly and second head assembly, controlling the drilling feed rate, and operation of various components discussed herein. Computing system 1000 can include a computing device 1001 and a display 1011 in electronic communication with the computing device, which can be any conventional computing device, such as, for example and without limitation, a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. In some optional embodiments, a smart phone, tablet, or computer (i.e., a laptop or desktop computer) can comprise both the computing device 1001 and the display 1011. Alternatively, it is contemplated that the display 1011 can be provided as a separate component from the computing device 1001. For example, it is contemplated that the display 1011 can be in wireless communication with the computing device 1001, thereby allowing usage of the display 1011 in a manner consistent with that of the display of the smartphone as disclosed herein.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as mesh computation data 1007 and/or program modules such as operating system 1005 and drilling control software 1006 that are accessible to and/or are operated on by the one or more processors 1003.

The computing device 1001 may also comprise other removable/non-removable, volatile/non-volatile computer storage media. A mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and the drilling control software 1006 may be stored on the mass storage device 1004. One or more of the operating system 1005 and the drilling control software 1006 (or some combination thereof) may comprise program modules and the drilling control software 1006. Drilling control data 1007 may also be stored on the mass storage device 1004. The drilling control data 1007 may be stored in any of one or more databases known in the art. The databases may be centralized or distributed across multiple locations within the network 1015.

A user may enter commands and information into the computing device 1001 via an input device (not shown). Such input devices comprise, but are not limited to, a keyboard, pointing device (e.g., a computer mouse, remote control), a microphone, a joystick, a scanner, tactile input devices such as gloves, and other body coverings, motion sensor, and the like These and other input devices may be connected to the one or more processors 1003 via a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display 1011 may also be connected to the bus 1013 via an interface, such as a display adapter 1009. It is contemplated that the computing device 1001 may have more than one display adapter 1009 and the computing device 1001 may have more than one display 1011. A display 1011 may be a monitor, an LCD (Liquid Crystal Display), light emitting diode (LED) display, television, smart lens, smart glass, and/or a projector. In addition to the display 1011, other output peripheral devices may comprise components such as speakers (not shown) and a printer (not shown) which may be connected to the computing device 1001 via Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made via a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet. In further exemplary aspects, it is contemplated that the computing device 1001 can be in communication with the remote computing devices 1014*a,b,c* through a Cloud-based network.

Application programs and other executable program components such as the operating system 1005 are shown herein as discrete blocks, although it is recognized that such programs and components may reside at various times in different storage components of the computing device 1001, and are executed by the one or more processors 1003 of the computing device 1001. An implementation of the drilling control software 1006 may be stored on or sent across some form of computer readable media. Any of the disclosed methods may be performed by processor-executable instructions embodied on computer readable media.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill rig having a longitudinal drilling axis, a front portion, and a rear portion, the drill rig comprising: a feedframe aligned with the longitudinal drilling axis; a first head assembly coupled to the feedframe and configured to rotate a drill string; a rod holder proximate the front portion of the drill rig and configured to grip an outer surface of a first drill string component of the drill string; a second head assembly that is movable on the feedframe along the longitudinal axis, the second head assembly comprising: a powered water swivel assembly comprising: a spindle having an interior bore; a drill rod connector at a first end of the spindle; a motor that is configured to rotate the spindle; a clutch configured to disengage the motor from the spindle; a gearbox that couples the motor to the spindle; and a water swivel that is configured to provide drilling fluid to the interior bore of the spindle.

Aspect 2: The drill rig of aspect 1, wherein the second head assembly further comprises an overshot loading assembly comprising: an overshot loading chamber configured to receive an overshot tool; and an overshot releaser.

Aspect 3: The drill rig of aspect 2, further comprising an actuator configured to move at least a portion of the second head assembly between a first position in which the powered water swivel assembly is aligned with the longitudinal drilling axis, and a second position in which the overshot loading assembly is aligned with the longitudinal drilling axis.

Aspect 4: The drill rig of aspect 2, wherein the overshot tool is a pump-in wireline overshot or a catcher insert.

Aspect 5: The drill rig of any of aspects 1-4, wherein the spindle is a floating spindle that is configured to move along the longitudinal drilling axis.

Aspect 6: The drill rig of aspect 5, wherein the spindle is spring-biased toward the front portion of the drill rig.

Aspect 7: The drill rig of any of aspects 1-6 and 21-22, wherein the drill rod connector comprises at least one male thread.

Aspect 8: The drill rig of any of the preceding aspects and aspects 21-22, wherein the drill string component comprises a drill rod.

Aspect 9: A method of using the drill rig of aspect 7 in conjunction with a rod handler, the method comprising: retracting the second head assembly toward the rear portion of the drill rig and away from a drill string to permit receipt of the first drill string component between the second head assembly and the drill string; receiving the first drill string component from the rod handler so that the first drill string component is coaxial with the longitudinal drilling axis; moving the second head assembly until the at least one male thread of the spindle engages at least one female thread of the first drill string component; using the motor to rotate the spindle to thereby threadedly couple the spindle to the first drill string component; moving the second head assembly forward via the feed frame until the first drill string component engages the drill string; and using the motor to rotate the spindle to thereby threadedly couple the first drill string component to the drill string, thereby creating an extended drill string.

Aspect 10: The method of aspect 9, further comprising: using the clutch to decouple the motor from the spindle; and using the first head assembly to rotate the extended drill string at a drilling speed.

Aspect 11: The method of aspect 9, further comprising using the second head assembly to push the drill string into a bore.

Aspect 12: A method of using the drill rig of aspect 7 in conjunction with a rod handler to remove a rod from a drill string, the method comprising: moving, via the feed frame, the second head assembly toward the front portion of the drill rig until the at least one male thread of the spindle engages at least one female thread of the drill string; using the motor to rotate the spindle to thereby threadedly couple the spindle to the first drill string component of the drill string that is at a proximal end of the drill string; and moving, via the feed frame, the second head assembly toward the rear portion of the drill rig to thereby draw the drill string rearward until a second drill string component that is distal of the first drill string component is received within the rod holder.

Aspect 13: The method of aspect 12, further comprising: gripping the second drill rod of the drill string with the rod holder to prevent rotation of the second drill rod; and using the first head assembly, rotating the first drill string component with respect to the second drill string component to decouple the first drill string component from the second drill string component.

Aspect 14: The method of aspect 13, further comprising: gripping the first drill string component with the rod handler; using the motor to rotate the spindle to decouple the spindle from the first drill string component; and using the rod handler to remove the first drill string component from the drill rig.

Aspect 15: A method of using the drill rig of any of aspects 3-8 and 21-22 in conjunction with a rod handler comprising: gripping a drill string with the rod holder; using the motor to rotate the spindle to decouple the spindle from the drill string; moving, via the feed frame, the second head assembly toward the rear portion of the drill rig; using the actuator to align the overshot loading assembly with the longitudinal drilling axis of the drill rig; using a water pump, pumping from the overshot loading chamber, an overshot until it engages a core tube assembly; using a wireline winch, retracting the core tube assembly until the overshot is received in the overshot loading assembly; moving, via the feed frame, the second head assembly toward the rear of the drill rig until the core tube assembly is removed entirely from the drill string; and gripping the core tube assembly with the rod handler.

Aspect 16: The method of aspect 15, further comprising: using the overshot releaser to decouple the core tube assembly from the overshot; and moving, via the rod handler, the core tube assembly from the drill rig.

Aspect 17: A method of using the drill rig of any of aspects 3-8 and 21-22 in conjunction with a rod handler, wherein the rod connector comprises at least one male thread, the method comprising: using the rod handler to insert an empty core tube assembly into the drill string; moving, via the feed frame, the second head assembly toward the front portion of the drill rig until the overshot engages the empty core tube assembly; disengaging the rod handler from the empty core tube assembly; moving, via the feed frame, the second tube assembly toward the front of the drill rig to further insert the empty core head assembly into the drill string; using the overshot releaser, releasing the overshot from the empty core tube assembly; moving, via the feed frame, the second head assembly toward the rear of the drill rig; using the actuator to align the spindle with the longitudinal drilling axis of the drill rig; moving, via the feed frame, the second head assembly toward the front of the drill rig until the spindle engages the drill string; and using the motor to rotate the spindle to thereby threadedly couple the spindle to the drill string.

Aspect 18: A method of using the drill rig of any of aspects 1-8 and 21-22 to pull a stuck drill string, the method comprising: with the first head assembly engaged with the drill string and the spindle engaged with the drill string, simultaneously driving the first head assembly toward the rear of the drill rig and driving the second drill head toward the rear of the drill rig.

Aspect 19: A method of using the drill rig of any one of aspects 1-8 and 21-22, the method comprising moving the second head assembly relative to the first head assembly.

Aspect 20: The method of any of aspects 9-19, wherein the method is performed with no physical contact between the drill rig and an operator.

Aspect 21: The drill rig of any of aspects 1-8, further comprising a controller in communication with the first head assembly, the second head assembly, and the feedframe.

Aspect 22: The drill rig of any of aspects 3-8, further comprising a controller in communication with the first head assembly, the second head assembly, the feedframe, the release latch, and the actuator.

Aspect 23: The method of aspect 12, wherein using the motor to rotate the spindle to thereby threadedly couple the spindle to the first drill string component comprises: rotating the spindle in a decoupling direction until the spindle moves forward; and rotating the spindle in a coupling direction.

Aspect 24: A method comprising: drilling a first bore into a formation to a first depth, the bore having a bore wall and a first diameter that is sufficient to receive a casing pipe; driving a casing pipe into the drill bore, the casing pipe having a binder on an exterior surface of the casing pipe that is configured to secure the casing pipe to the bore wall, the casing pipe being secured to an anchoring nut at a proximal end and wherein the anchoring nut comprises a gripping feature; and engaging an anchoring clamp of a drill rig with the gripping feature of the anchoring nut to thereby anchor the drill rig to the formation.

Aspect 25: The method of aspect 24, wherein the method is performed without physical contact between the drill rig and a human operator.

Aspect 26: The method of aspect 24 or aspect 25, wherein the casing pipe is welded to the anchoring nut.

Aspect 27: The method of aspect 24 or aspect 25, wherein the casing pipe and anchoring nut are monolithically formed.

Aspect 28: The method of any of aspects 24-27, further comprising fitting a casing gland to the anchoring nut at a proximal end of the nut portion opposite the formation.

Aspect 29: The method of any of aspects 24-28, wherein drilling the bore comprises using the drill rig to drill the bore.

Aspect 30: The method of any of aspects 24-29, further comprising waiting for the binder to cure.

Aspect 31: The method of any of aspects 24-30, wherein the binder is a resin.

Aspect 32: The method of any of aspects 24-31, wherein drilling the bore comprises drilling the bore with a stepped drill bit.

Aspect 33: The method of aspect 32, wherein the stepped drill bit comprises a first cutting face between a rotational axis of the drill bit and a first radius and a second cutting face outside of the first radius, wherein the first cutting face is spaced from the second cutting face in a distal direction.

Aspect 34: The method of any of aspects 24-33, wherein the first bore has an axis, further comprising drilling a second bore into the formation through the casing pipe, wherein the second bore has a second diameter that is smaller than an inner diameter of the casing pipe, wherein the second bore has an axis that is aligned with the axis of the first bore.

Aspect 35: The method of any of aspects 24-34, wherein the anchoring clamp is attached to a feed frame of the drill rig.

Aspect 36: The method of aspects 24-35, wherein the gripping feature of the nut portion of the casing pipe comprises a first radially extending rib and a second radially extending rib spaced axially from the first radially extending rib, thereby defining a recessed groove between the first radially extending rib and the second radially extending rib.

Aspect 37: The method of any of aspects 24-36, wherein the anchoring clamp comprises a plurality of jaws that have, in cross section in a plane including a central axis of the anchoring clamp, a complementary shape to the recessed groove.

Aspect 38: The method of aspect 36, wherein the first rib and the second rib define opposing tapered surfaces so that the groove has a taper toward a central axis of the nut portion of the casing pipe.

Aspect 39: The method of any of aspects 24-38, wherein the anchoring clamp is hydraulically actuated.

Aspect 40: The method of any of aspects 24-39, wherein the drill rig comprises a rotation head configured to grip both the casing pipe and drill string component, wherein the drill string component has an outer diameter that is less than an inner diameter of the casing pipe.

Aspect 41: The method of any of aspects 24-40, wherein the binder comprises resin sticks.

Aspect 42: The method of any of aspects 24-41, wherein the nut portion of the casing pipe comprises at least one female thread that is configured to couple to a drive rod of the drill rig.

Aspect 43: The method of any of aspects 24-42, wherein drilling the bore, driving the casing pipe into the bore, and engaging the anchoring clamp of the drill rig with the nut portion of the casing pipe are performed without physical contact between the drill rig and an operator.

Aspect 44: A system comprising: a casing pipe having a binder on an exterior surface of the casing pipe that is configured to secure the casing pipe to a bore wall; an anchoring nut secured to a proximal end of the casing pipe, wherein the anchoring nut comprises a gripping feature; and an anchoring clamp configured to engage the gripping feature of the anchoring nut.

Aspect 45: The system of aspect 44, wherein the anchoring clamp is configured to couple to a drill rig.

Aspect 46: The system of claim 44, wherein the anchoring clamp is a portion of a drill rig.

Aspect 47: A drilling system comprising: a casing pipe anchored in a bore in a formation; a drill rig coupled to the casing pipe; and a rod handler configured to provide rods to the drill rig, wherein the drilling system is configured for operation without physical contact between the drill rig and an operator.

Although the foregoing invention has been described in some detail by way of illustration and example for purposes of clarity of understanding, certain changes and modifications may be practiced within the scope of the appended claims.

What is claimed is:

1. A drill rig having a longitudinal drilling axis, a front portion, and a rear portion, the drill rig comprising:

a feedframe aligned with the longitudinal drilling axis;

a first head assembly coupled to the feedframe and configured to rotate a drill string;

a rod holder proximate the front portion of the drill rig and configured to grip an outer surface of a first drill string component of the drill string;

a second head assembly that is movable on the feedframe along the longitudinal axis, the second head assembly comprising:

a powered water swivel assembly comprising:

a spindle having an interior bore;

a drill rod connector at a first end of the spindle;

a motor that is configured to rotate the spindle;

a clutch configured to disengage the motor from the spindle;

a gearbox that couples the motor to the spindle; and a water swivel that is configured to provide drilling fluid to the interior bore of the spindle; and an overshot loading assembly; and an actuator configured to move at least a portion of the second head assembly between a first position in which the powered water swivel assembly is aligned with the longitudinal drilling axis, and a second position in which the overshot loading assembly is aligned with the longitudinal drilling axis.

2. The drill rig of claim 1, wherein the overshot loading assembly comprises:

an overshot loading chamber configured to receive an overshot tool; and an overshot releaser.

3. The drill rig of claim 2, wherein the overshot tool is a pump-in wireline overshot or a catcher insert.

4. The drill rig of claim 2, further comprising a controller in communication with the first head assembly, the second head assembly, the feedframe, the overshot releaser, and the actuator.

5. The drill rig of claim 1, wherein the spindle is a floating spindle that is configured to move along the longitudinal drilling axis, and wherein the spindle is spring-biased toward the front portion of the drill rig.

6. A method of using the drill rig of claim 1 in conjunction with a rod handler, wherein the drill rod connector comprises at least one male thread, the method comprising:

retracting the second head assembly toward the rear portion of the drill rig and away from a drill string to permit receipt of the first drill string component between the second head assembly and the drill string;

receiving the first drill string component from the rod handler so that the first drill string component is coaxial with the longitudinal drilling axis;

moving the second head assembly until the at least one male thread of the spindle engages at least one female thread of the first drill string component;

rotating, using the motor, the spindle to thereby threadedly couple the spindle to the first drill string component;

moving the second head assembly forward via the feed frame until the first drill string component engages the drill string; and rotating, using the motor, the spindle to thereby threadedly couple the first drill string component to the drill string, thereby creating an extended drill string.

7. The drill rig of claim 1, further comprising a controller in communication with the first head assembly, the second head assembly, and the feedframe.

8. A method of using the drill rig of claim 1 in conjunction with a rod handler to remove a rod from a drill string, the method comprising:

moving, via the feed frame, the second head assembly toward the front portion of the drill rig until the at least one male thread of the spindle engages at least one female thread of the drill string;

rotating, by the motor the spindle to thereby threadedly couple the spindle to the first drill string component of the drill string that is at a proximal end of the drill string; and moving, via the feed frame, the second head assembly toward the rear portion of the drill rig to thereby draw the drill string rearward until a second drill string component that is distal of the first drill string component is received within the rod holder.

9. The method of claim 8, further comprising:

gripping the second drill string component of the drill string with the rod holder to prevent rotation of the second drill string component; and rotating, using the first head assembly, the first drill string component with respect to the second drill string component to decouple the first drill string component from the second drill string component.

10. The method of claim 9, further comprising:

gripping the first drill string component with the rod handler;

rotating, using the motor, the spindle to decouple the spindle from the first drill string component; and removing, using the rod handler, the first drill string component from the drill rig.

11. The method of claim 8, wherein using the motor to rotate the spindle to thereby threadedly couple the spindle to the first drill string component comprises:

rotating the spindle in a decoupling direction until the spindle moves forward; and rotating the spindle in a coupling direction.

12. A method of using the drill rig of claim 2 in conjunction with a rod handler comprising:

gripping a drill string with the rod holder;

rotating, using the motor, the spindle to decouple the spindle from the drill string;

moving, via the feed frame, the second head assembly toward the rear portion of the drill rig;

aligning, using the actuator, the overshot loading assembly with the longitudinal drilling axis of the drill rig;

pumping, from the overshot loading chamber using a water pump, an overshot until it engages a core tube assembly;

retracting, using a wireline winch, the core tube assembly until the overshot is received in the overshot loading assembly;

moving, via the feed frame, the second head assembly toward the rear of the drill rig until the core tube assembly is removed entirely from the drill string; and gripping the core tube assembly with the rod handler.

13. The method of claim 12, further comprising:

decoupling, using the overshot releaser, the core tube assembly from the overshot; and moving, via the rod handler, the core tube assembly from the drill rig.

14. A method of using the drill rig of claim 2 in conjunction with a rod handler, wherein the rod connector comprises at least one male thread, the method comprising:

inserting, using the rod handler, an empty core tube assembly into the drill string;

moving, via the feed frame, the second head assembly toward the front portion of the drill rig until the overshot engages the empty core tube assembly;

disengaging the rod handler from the empty core tube assembly;

moving, via the feed frame, the second tube assembly toward the front of the drill rig to further insert the empty core head assembly into the drill string;

releasing, using the overshot releaser, the overshot from the empty core tube assembly;

moving, via the feed frame, the second head assembly toward the rear of the drill rig;

aligning, using the actuator, the spindle with the longitudinal drilling axis of the drill rig;

moving, via the feed frame, the second head assembly toward the front of the drill rig until the spindle engages the drill string; and rotating, using the motor, the spindle to thereby threadedly couple the spindle to the drill string.

15. A method of using the drill rig of claim 1 to pull a stuck drill string, the method comprising: with the first head assembly engaged with the drill string and the spindle engaged with the drill string, simultaneously driving the first head assembly toward the rear portion of the drill rig and driving the second head assembly toward the rear portion of the drill rig.

16. A method of using the drill rig of claim 1, the method comprising moving the second head assembly relative to the first head assembly.

* * * * *